US010320083B2

(12) United States Patent
Kirino et al.

(10) Patent No.: US 10,320,083 B2
(45) Date of Patent: Jun. 11, 2019

(54) WAVEGUIDE DEVICE AND ANTENNA DEVICE INCLUDING THE WAVEGUIDE DEVICE

(71) Applicants: Nidec Corporation, Minami-ku, Kyoto (JP); WGR Co., Ltd., Shimogyo-ku, Kyoto, Kyoto (JP)

(72) Inventors: Hideki Kirino, Kyoto (JP); Hiroyuki Kamo, Kawasaki (JP)

(73) Assignees: NIDEC CORPORATION, Kyoto (JP); WGR CO., LTD., Kyoto (JP)

( * ) Notice: Subject to any disclaimer, the term of this patent is extended or adjusted under 35 U.S.C. 154(b) by 0 days.

(21) Appl. No.: 16/010,784

(22) Filed: Jun. 18, 2018

(65) Prior Publication Data

US 2018/0309207 A1 Oct. 25, 2018

Related U.S. Application Data

(63) Continuation of application No. 15/292,431, filed on Oct. 13, 2016, now Pat. No. 10,027,032.

(30) Foreign Application Priority Data

Oct. 15, 2015 (JP) ..... 2015-203453
Jul. 20, 2016 (JP) ..... 2016-142181

(51) Int. Cl.
*H01P 3/00* (2006.01)
*H01Q 13/16* (2006.01)
(Continued)

(52) U.S. Cl.
CPC ..... *H01Q 13/16* (2013.01); *H01P 3/00* (2013.01); *H01Q 11/14* (2013.01); *H01Q 21/0006* (2013.01); *H01Q 21/064* (2013.01)

(58) Field of Classification Search
CPC .... H01Q 11/14; H01Q 21/00; H01Q 21/0006; H01Q 21/0025; H01Q 21/064;
(Continued)

(56) References Cited

U.S. PATENT DOCUMENTS 7,612,638 B2 * 11/2009 Chung ..... H01P 3/12 333/236
2005/0156789 A1 * 7/2005 Mohamadi ..... H01Q 1/38 343/700 MS
2015/0194718 A1 * 7/2015 Kildal ..... H01P 3/12 333/137

OTHER PUBLICATIONS

Kirino et al., "Waveguide Device and Antenna Device Including the Waveguide Device", U.S. Appl. No. 15/292,431, filed Oct. 13, 2016.

* cited by examiner

*Primary Examiner* — Dameon E Levi
*Assistant Examiner* — Hasan Z Islam
(74) *Attorney, Agent, or Firm* — Keating & Bennett, LLP

(57) ABSTRACT

A waveguide device includes: a first conductive member having an electrically conductive surface; a second conductive member having a plurality of electrically conductive rods arrayed thereon, each conductive rod having a leading end opposing the conductive surface; and a waveguide member having an electrically conductive waveguide face opposing the conductive surface, the waveguide member being disposed among the conductive rods and extending along the conductive surface. The waveguide member includes at least one of a bend and a branching portion. A measure of an outer shape of a cross section of at least one of the plurality of conductive rods that is adjacent to the bend or the branching portion, taken perpendicular to an axial direction of the at least one conductive rod, monotonically decreases from a root that is in contact with the second conductive member toward a leading end.

20 Claims, 38 Drawing Sheets

(51) Int. Cl.
*H01Q 11/14* (2006.01)
*H01Q 21/00* (2006.01)
*H01Q 21/06* (2006.01)

(58) Field of Classification Search
CPC ..... H01Q 13/00; H01Q 13/02–13/13; H01P 3/00; H01P 3/003; H01P 3/006; H01P 3/08; H01P 3/10; H01P 3/131
USPC ..... 343/772, 786, 853, 893; 333/239, 248
See application file for complete search history.

WAVEGUIDE DEVICE AND ANTENNA DEVICE INCLUDING THE WAVEGUIDE DEVICE

BACKGROUND

1. Technical Field

The present disclosure relates to a waveguide device, and an antenna device including the waveguide device.

2. Description of the Related Art

Examples of waveguiding structures including an artificial magnetic conductor are disclosed in Patent Documents 1 to 3 and Non-Patent Documents 1 and 2 as follows.

Patent Document 1: International Publication No. 2010/050122

Patent Document 2: the specification of U.S. Pat. No. 8,803,638

Patent Document 3: the specification of European Patent Application Publication No. 1331688

Non-Patent Document 1: H. Kirino and K. Ogawa, "A 76 GHz Multi-Layered Phased Array Antenna using a Non-Metal Contact Metamaterial Waveguide", IEEE Transaction on Antenna and Propagation, Vol. 60, No. 2, pp. 840-853, February, 2012

Non-Patent Document 2: A. Uz. Zaman and P.-S. Kildal, "Ku Band Linear Slot-Array in Ridge Gapwaveguide Technology, EUCAP 2013, 7th European Conference on Antenna and Propagation An artificial magnetic conductor is a structure which artificially realizes the properties of a perfect magnetic conductor (PMC), which does not exist in nature. One property of a perfect magnetic conductor is that "a magnetic field on its surface has zero tangential component". This property is the opposite of the property of a perfect electric conductor (PEC), i.e., "an electric field on its surface has zero tangential component". Although no perfect magnetic conductor exists in nature, it can be embodied by an artificial periodic structure. An artificial magnetic conductor functions as a perfect magnetic conductor in a specific frequency band which is defined by its periodic structure. An artificial magnetic conductor restrains or prevents an electromagnetic wave of any frequency that is contained in the specific frequency band (propagation-restricted band) from propagating along the surface of the artificial magnetic conductor. For this reason, the surface of an artificial magnetic conductor may be referred to as a high impedance surface.

In the waveguide devices disclosed in Patent Documents 1 to 3 and Non-Patent Documents 1 and 2, an artificial magnetic conductor is realized by a plurality of electrically conductive rods which are arrayed along row and column directions. Such rods are projections which may also be referred to as posts or pins. Each of these waveguide devices includes, as a whole, a pair of opposing electrically conductive plates. One conductive plate has a ridge protruding toward the other conductive plate, and stretches of an artificial magnetic conductor extending on both sides of the ridge. An upper face (i.e., its electrically conductive face) of the ridge opposes, via a gap, a conductive surface of the other conductive plate. An electromagnetic wave of a wavelength which is contained in the propagation-restricted band of the artificial magnetic conductor propagates along the ridge, in the space (gap) between this conductive surface and the upper face of the ridge.

SUMMARY

In a waveguide such as an antenna feeding network, a waveguide member may have a bend(s) and/or a branching portion(s). At a bend or a branching portion, a change occurs in the direction that the waveguide member extends. At such a portion of change in the direction that the waveguide member extends, unless remedied, an impedance mismatching would occur, thus causing unwanted reflection of a propagating electromagnetic wave. Such reflection would not only cause a propagation loss in the signal, but also induce unwanted noises.

Non-Patent Document 1 discloses varying the height of the ridge at a position near a bend or a branching portion in order to enhance impedance matching at the bend or the branching portion. In a waveguide which is disclosed in Non-Patent Document 2, the ridge width varies at a portion near a branching portion of the waveguide member.

Various embodiments of the present disclosure provide a waveguide device with an enhanced degree of impedance matching at a bend or a branching portion of a waveguide member.

A waveguide device according to one aspect of the present disclosure includes: a first electrically conductive member having an electrically conductive surface which is shaped as a plane or a curved surface; a second electrically conductive member having a plurality of electrically conductive rods arrayed thereon, each conductive rod having a leading end opposing the conductive surface of the first conductive member; and a waveguide member having an electrically conductive waveguide face opposing the conductive surface of the first conductive member, the waveguide member being disposed among the plurality of conductive rods and extending along the conductive surface. The waveguide member includes at least one of a bend at which the direction that the waveguide member extends changes and a branching portion at which the direction that the waveguide member extends ramifies into two or more directions. A measure of an outer shape of a cross section of at least one of the plurality of conductive rods that is adjacent to the bend or the branching portion, taken perpendicular to an axial direction of the at least one conductive rod, monotonically decreases from a root that is in contact with the second conductive member toward the leading end.

Hereinafter, any reference to a "conductive member" is intended to mean an "electrically conductive member"; any reference to a "conductive rod" is intended to mean an "electrically conductive rod"; any reference to a "conductive surface" is intended to mean an "electrically conductive surface"; and so on.

In accordance with an embodiment of the present disclosure, a novel construction for rods that constitute an artificial magnetic conductor can enhance the degree of impedance matching at any bend or branching portion of a waveguide member.

These general and specific aspects may be implemented using a system, a method, and a computer program, and any combination of systems, methods, and computer programs.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

DETAILED DESCRIPTION

Prior to describing embodiments of the present disclosure, an exemplary fundamental construction and operation of a waveguide device which includes a plurality of conductive rods (artificial magnetic conductor) in a two-dimensional array will be described.

Figure 1:
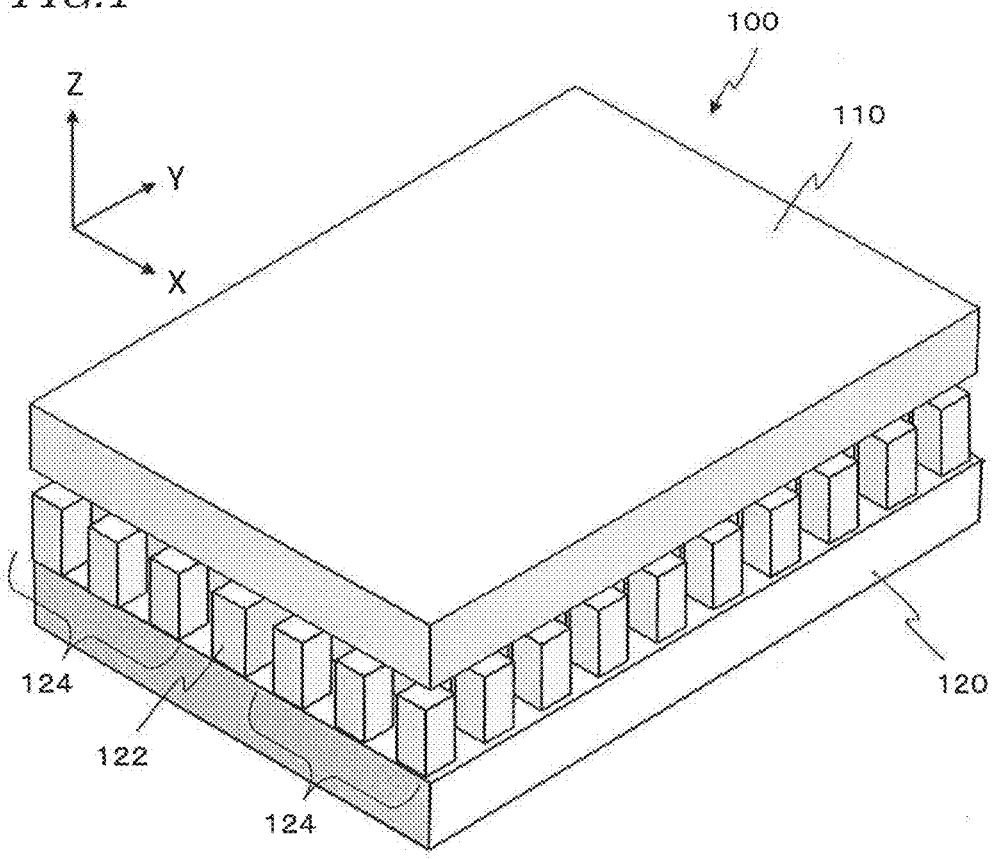
FIG. 1 is a perspective view schematically showing an exemplary schematic construction for an example of a waveguide device 100 according to the present disclosure.

FIG. 1 is a perspective view schematically showing a non-limiting example of a fundamental construction of such a waveguide device. FIG. 1 shows XYZ coordinates along X, Y and Z directions which are orthogonal to one another. The waveguide device 100 shown in the figure includes a plate-like first conductive member 110 and a plate-like second conductive member 120, which are in opposing and parallel positions to each other. A plurality of conductive rods 124 are arrayed on the second conductive member 120.

Note that any structure appearing in a figure of the present application is shown in an orientation that is selected for ease of explanation, which in no way should limit its orientation when an embodiment of the present disclosure is actually practiced. Moreover, the shape and size of a whole or a part of any structure that is shown in a figure should not limit its actual shape and size.

Figure 2A:
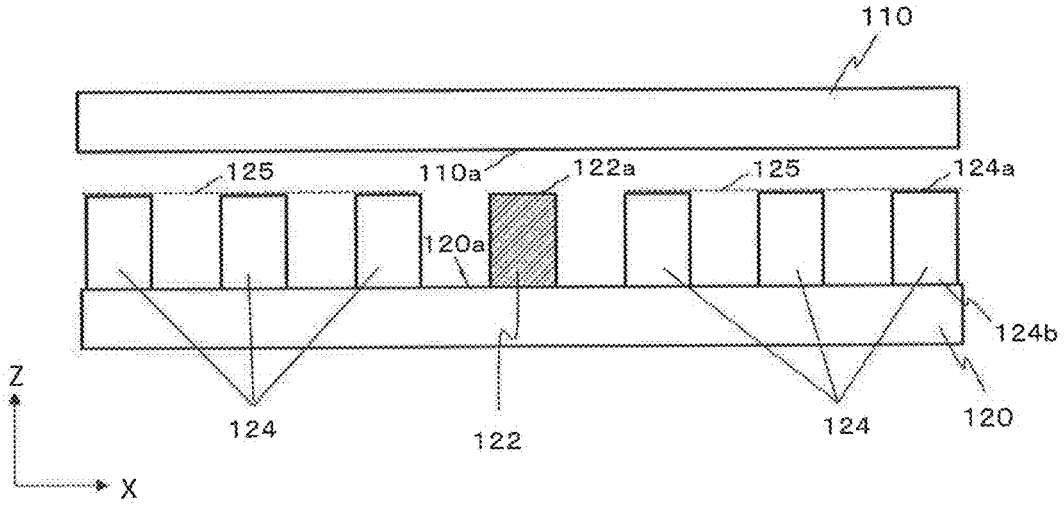
FIG. 2A is a diagram schematically showing a construction for the waveguide device 100 in FIG. 1, in a cross section parallel to the XZ plane.

FIG. 2A is a diagram schematically showing the construction of a cross section of the waveguide device 100 in FIG. 1, taken parallel to the XZ plane. As shown in FIG. 2A, the first conductive member 110 has a conductive surface 110*a* on the side facing the second conductive member 120. The conductive surface 110*a* has a two-dimensional expanse along a plane which is orthogonal to the axial direction (Z direction) of the conductive rods 124 (i.e., a plane which is parallel to the XY plane). Although the conductive surface 110*a* is shown to be a smooth plane in this example, the conductive surface 110*a* does not need to be a plane, as will be described later.

Figure 3:
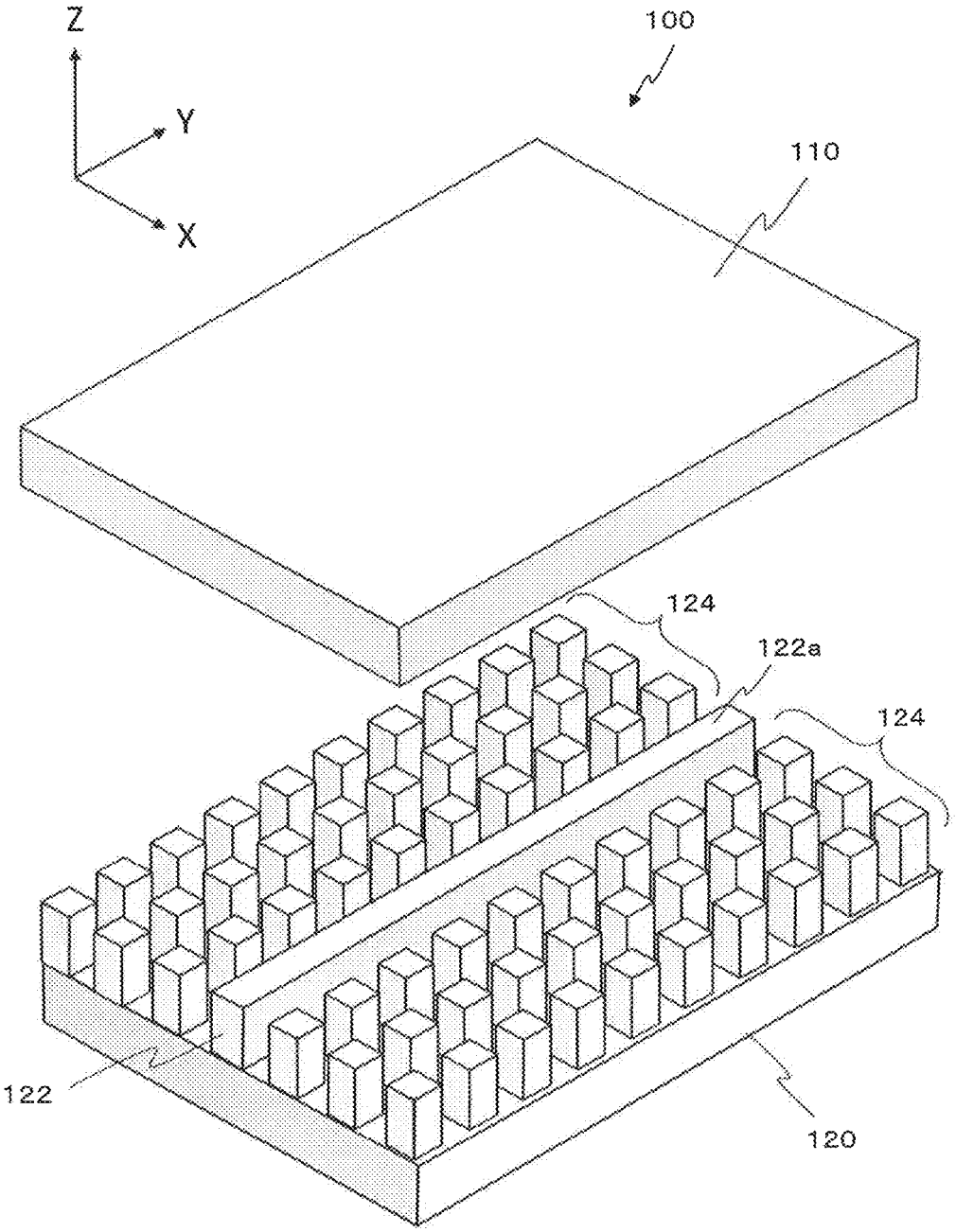
FIG. 3 is another perspective view schematically illustrating the construction of the waveguide device 100.

FIG. 3 is a perspective view schematically showing the waveguide device 100, illustrated so that the spacing between the first conductive member 110 and the second conductive member 120 is exaggerated for ease of understanding. In an actual waveguide device 100, as shown in FIG. 1 and FIG. 2A, the spacing between the first conductive member 110 and the second conductive member 120 is narrow, with the first conductive member 110 covering over all of the conductive rods 124 on the second conductive member 120.

See FIG. 2A again. The plurality of conductive rods 124 arrayed on the second conductive member 120 each have a leading end 124*a* opposing the conductive surface 110*a*. In the example shown in the figure, the leading ends 124*a* of the plurality of conductive rods 124 are on the same plane. This plane defines the surface 125 of an artificial magnetic conductor. Each conductive rod 124 does not need to be entirely electrically conductive; instead, at least the surface (the upper face and the side face) of the rod-like structure may be electrically conductive. Moreover, each second conductive member 120 does not need to be entirely electrically conductive, so long as it can support the plurality of conductive rods 124 to constitute an artificial magnetic conductor. Of the surfaces of the second conductive member 120, a face 120*a* carrying the plurality of conductive rods 124 may be electrically conductive, such that the conductor interconnects the surfaces of adjacent ones of the plurality of conductive rods 124. In other words, the entire combination of the second conductive member 120 and the plurality of conductive rods 124 may at least present a conductive surface with rises and falls opposing the conductive surface 110*a* of the first conductive member 110.

On the second conductive member 120, a ridge-like waveguide member 122 is provided among the plurality of conductive rods 124. More specifically, stretches of an artificial magnetic conductor are present on both sides of the waveguide member 122, such that the waveguide member 122 is sandwiched between the stretches of artificial magnetic conductor on both sides. As can be seen from FIG. 3, the waveguide member 122 in this example is supported on the second conductive member 120, and extends linearly along the Y direction. In the example shown in the figure, the waveguide member 122 has the same height and width as those of the conductive rods 124. As will be described later, however, the height and width of the waveguide member 122 may have different values from those of the conductive rod 124. Unlike the conductive rods 124, the waveguide member 122 extends along a direction (which in this example is the Y direction) in which to guide electromagnetic waves along the conductive surface 110*a*. Similarly, the waveguide member 122 does not need to be entirely electrically conductive, but may at least include an electrically conductive waveguide face 122*a* opposing the conductive surface 110*a* of the first conductive member 110. The second conductive member 120, the plurality of conductive rods 124, and the waveguide member 122 may be parts of a continuous single-piece body. Furthermore, the first conductive member 110 may also be a part of such a single-piece body.

On both sides of the waveguide member 122, the space between the surface 125 of each stretch of artificial magnetic conductor and the conductive surface 110*a* of the first conductive member 110 does not allow an electromagnetic wave of any frequency that is within a specific frequency band to propagate. This frequency band is called a "prohibited band". The artificial magnetic conductor is designed so that the frequency of a signal wave to propagate in the waveguide device 100 (which may hereinafter be referred to as the "operating frequency") is contained in the prohibited band. The prohibited band may be adjusted based on the following: the height of the conductive rods 124, i.e., the depth of each groove formed between adjacent conductive rods 124; the width of each conductive rod 124; the interval between conductive rods 124; and the size of the gap between the leading end 124*a* and the conductive surface 110*a* of each conductive rod 124.

With the above structure, a signal wave can be propagated along a waveguide (ridge waveguide) extending between the conductive surface 110*a* of the first conductive member 110 and the waveguide face 122*a*. Such a ridge waveguide may be referred to as a WRG (Waffle-iron Ridge waveGuide).

Next, with reference to FIG. 4, the dimensions, shape, positioning, and the like of each member will be described.

Figure 4:
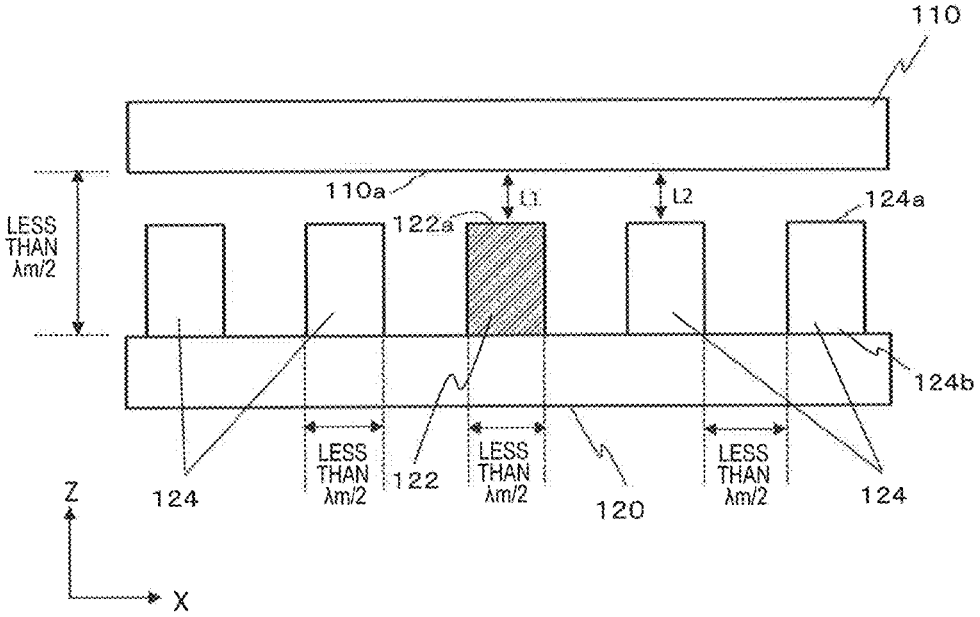
FIG. 4 is a diagram showing an exemplary range of dimension of each member in the structure shown in FIG. 2A.

FIG. 4 is a diagram showing an exemplary range of dimension of each member in the structure shown in FIG. 2A. The waveguide device is used for at least one of the transmission and the reception of an electromagnetic wave of a predetermined band (referred to as the operating frequency band). In the present specification, λo denotes a representative value of wavelengths in free space (e.g., a central wavelength corresponding to a center frequency in the operating frequency band) of an electromagnetic wave (signal wave) propagating in a waveguide extending between the conductive surface 110*a* of the first conductive member 110 and the waveguide face 122*a* of the waveguide member 122. Moreover, λm denotes a wavelength, in free space, of an electromagnetic wave of the highest frequency in the operating frequency band. The end of each conductive rod 124 that is in contact with the second conductive member 120 is referred to as the "root". As shown in FIG. 4, each conductive rod 124 has the leading end 124*a* and the root 124*b*. Examples of dimensions, shapes, positioning, and the like of the respective members are as follows.

(1) Width of the Conductive Rod

The width (i.e., the size along the X direction and the Y direction) of the conductive rod 124 may be set to less than λm/2. Within this range, resonance of the lowest order can be prevented from occurring along the X direction and the Y direction. Since resonance may possibly occur not only in the X and Y directions but also in any diagonal direction in an X-Y cross section, the diagonal length of an X-Y cross section of the conductive rod 124 is also preferably less than λm/2. The lower limit values for the rod width and diagonal length will conform to the minimum lengths that are producible under the given manufacturing method, but is not particularly limited.

(2) Distance from the Root of the Conductive Rod to the Conductive Surface of the First Conductive Member The distance from the root 124*b* of each conductive rod 124 to the conductive surface 110*a* of the first conductive member 110 may be longer than the height of the conductive rods 124, while also being less than λm/2. When the distance is λm/2 or more, resonance may occur between the root 124*b* of each conductive rod 124 and the conductive surface 110*a*, thus reducing the effect of signal wave containment.

The distance from the root 124*b* of each conductive rod 124 to the conductive surface 110*a* of the first conductive members 110 corresponds to the spacing between the first conductive member 110 and the second conductive member 120. For example, when a signal wave of 76.5±0.5 GHz (which belongs to the millimeter band or the extremely high frequency band) propagates in the waveguide, the wavelength of the signal wave is in the range from 3.8934 mm to 3.9446 mm. Therefore, λm equals 3.8934 mm in this case, so that the spacing between the first conductive member 110 and the second conductive member 120 is set to less than a half of 3.8934 mm. So long as the first conductive member 110 and the second conductive member 120 realize such a narrow spacing while being disposed opposite from each other, the first conductive member 110 and the second conductive member 120 do not need to be strictly parallel. Moreover, when the spacing between the first conductive member 110 and the second conductive member 120 is less than λm/2, a whole or a part of the first conductive member 110 and/or the second conductive member 120 may be shaped as a curved surface. On the other hand, the first and second conductive members 110 and 120 each have a planar shape (i.e., the shape of their region as perpendicularly projected onto the XY plane) and a planar size (i.e., the size of their region as perpendicularly projected onto the XY plane) which may be arbitrarily designed depending on the purpose.

Figure 2B:
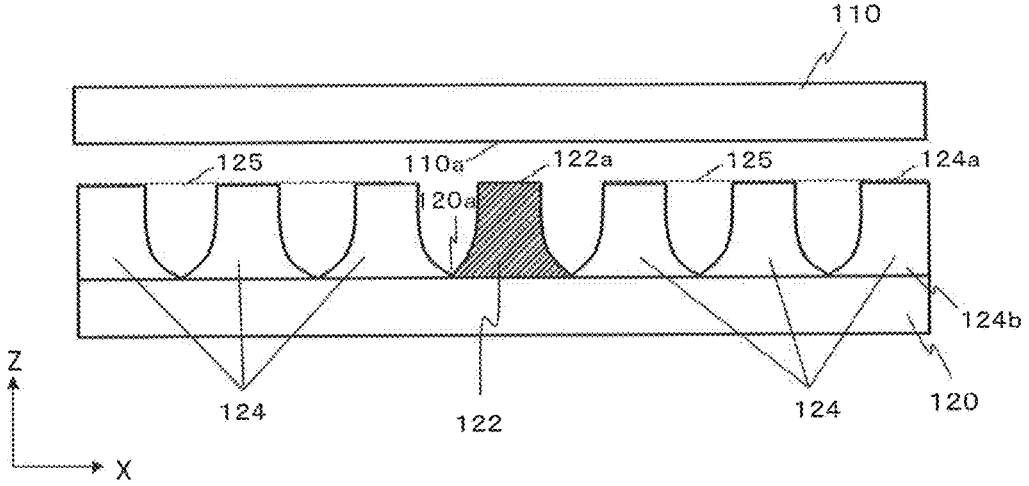
FIG. 2B is a diagram schematically showing another construction for the waveguide device 100 in FIG. 1, in a cross section parallel to the XZ plane.

Although the conductive surface 120*a* is illustrated as a plane in the example shown in FIG. 2A, embodiments of the present disclosure are not limited thereto. For example, as shown in FIG. 2B, the conductive surface 120*a* may be the bottom parts of faces each of which has a cross section similar to a U-shape or a V-shape. The conductive surface 120*a* will have such a structure when each conductive rod 124 or the waveguide member 122 is shaped with a width which increases toward the root. Even with such a structure, the device shown in FIG. 2B can function as the waveguide device according to an embodiment of the present disclosure so long as the distance between the conductive surface 110*a* and the conductive surface 120*a* is less than a half of the wavelength λm.

(3) Distance L2 from the Leading End of the Conductive Rod to the Conductive Surface The distance L2 from the leading end 124*a* of each conductive rod 124 to the conductive surface 110*a* is set to less than λm/2. When the distance is λm/2 or more, a propagation mode that reciprocates between the leading end 124*a* of each conductive rod 124 and the conductive surface 110*a* may occur, thus no longer being able to contain an electromagnetic wave.

(4) Arrangement and Shape of Conductive Rods

The interspace between two adjacent conductive rods 124 among the plurality of conductive rods 124 has a width of less than λm/2, for example. The width of the interspace between any two adjacent conductive rods 124 is defined by the shortest distance from the surface (side face) of one of the two conductive rods 124 to the surface (side face) of the other. This width of the interspace between rods is to be determined so that resonance of the lowest order will not occur in the regions between rods. The conditions under which resonance will occur are determined based by a combination of: the height of the conductive rods 124; the distance between any two adjacent conductive rods; and the capacitance of the air gap between the leading end 124*a* of each conductive rod 124 and the conductive surface 110*a*. Therefore, the width of the interspace between rods may be appropriately determined depending on other design parameters. Although there is no clear lower limit to the width of the interspace between rods, for manufacturing ease, it may be e.g. λm/16 or more when an electromagnetic wave in the extremely high frequency band is to be propagated. Note that the interspace does not need to have a constant width. So long as it remains less than λm/2, the interspace between conductive rods 124 may vary.

The arrangement of the plurality of conductive rods 124 is not limited to the illustrated example, so long as it exhibits a function of an artificial magnetic conductor. The plurality of conductive rods 124 do not need to be arranged in orthogonal rows and columns; the rows and columns may be intersecting at angles other than 90 degrees. The plurality of conductive rods 124 do not need to form a linear array along rows or columns, but may be in a dispersed arrangement which does not present any straightforward regularity. The conductive rods 124 may also vary in shape and size depending on the position on the second conductive member 120.

The surface 125 of the artificial magnetic conductor that are constituted by the leading ends 124*a* of the plurality of conductive rods 124 does not need to be a strict plane, but may be a plane with minute rises and falls, or even a curved surface. In other words, the conductive rods 124 do not need to be of uniform height, but rather the conductive rods 124 may be diverse so long as the array of conductive rods 124 is able to function as an artificial magnetic conductor.

Furthermore, each conductive rod 124 does not need to have a prismatic shape as shown in the figure, but may have a cylindrical shape, for example. Furthermore, each conductive rod 124 does not need to have a simple columnar shape. The artificial magnetic conductor may also be realized by any structure other than an array of conductive rods 124, and various artificial magnetic conductors are applicable to the waveguide device of the present disclosure. Note that, when the leading end 124*a* of each conductive rod 124 has a prismatic shape, its diagonal length is preferably less than λm/2. When the leading end 124*a* of each conductive rod 124 is shaped as an ellipse, the length of its major axis is preferably less than λm/2. Even when the leading end 124*a* has any other shape, the dimension across it is preferably less than λm/2 even at the longest position.

(5) Width of the Waveguide Face

The width of the waveguide face 122*a* of the waveguide member 122, i.e., the size of the waveguide face 122*a* along a direction which is orthogonal to the direction that the waveguide member 122 extends, may be set to less than λm/2 (e.g. λo/8). If the width of the waveguide face 122*a* is λm/2 or more, resonance will occur along the width direction, which will prevent any WRG from operating as a simple transmission line.

(6) Height of the Waveguide Member

The height (i.e., the size along the Z direction in the example shown in the figure) of the waveguide member 122 is set to less than λm/2. The reason is that, if the distance is λm/2 or more, the distance between the root 124*b* of each conductive rod 124 and the conductive surface 110*a* will be λm/2 or more. Similarly, the height of the conductive rods 124 (especially those conductive rods 124 which are adjacent to the waveguide member 122) is set to less than λm/2.

(7) Distance L1 Between the Waveguide Face and the Conductive Surface

The distance L1 between the waveguide face 122*a* of the waveguide member 122 and the conductive surface 110*a* is set to less than λm/2. If the distance is λm/2 or more, resonance will occur between the waveguide face 122*a* and the conductive surface 110*a*, which will prevent functionality as a waveguide. In one example, the distance is λm/4 or less. In order to ensure manufacturing ease, when an electromagnetic wave in the extremely high frequency band is to propagate, it is preferably λm/16 or more, for example.

The lower limit of the distance L1 between the conductive surface 110*a* and the waveguide face 122*a* and the lower limit of the distance L2 between the conductive surface 110*a* and the leading end 124*a* of each rod 124 depends on the machining precision, and also on the precision when assembling the two upper/lower conductive members 110 and 120 so as to be apart by a constant distance. When a pressing technique or an injection technique is used, the practical lower limit of the aforementioned distance is about 50 micrometers (μm). In the case of using an MEMS (Micro-Electro-Mechanical System) technique to make a product in e.g. the terahertz range, the lower limit of the aforementioned distance is about 2 to about 3 μm.

In the waveguide device 100 of the above-described construction, a signal wave of the operating frequency is unable to propagate in the space between the surface 125 of the artificial magnetic conductor and the conductive surface 110*a* of the first conductive member 110, but propagates in the space between the waveguide face 122*a* of the waveguide member 122 and the conductive surface 110*a* of the first conductive member 110. Unlike in a hollow waveguide, the width of the waveguide member 122 in such a waveguide structure does not need to be equal to or greater than a half of the wavelength of the electromagnetic wave to propagate. Moreover, the first conductive member 110 and the second conductive member 120 do not need to be interconnected by a metal wall that extends along the thickness direction (i.e., in parallel to the YZ plane).

Figure 5A:
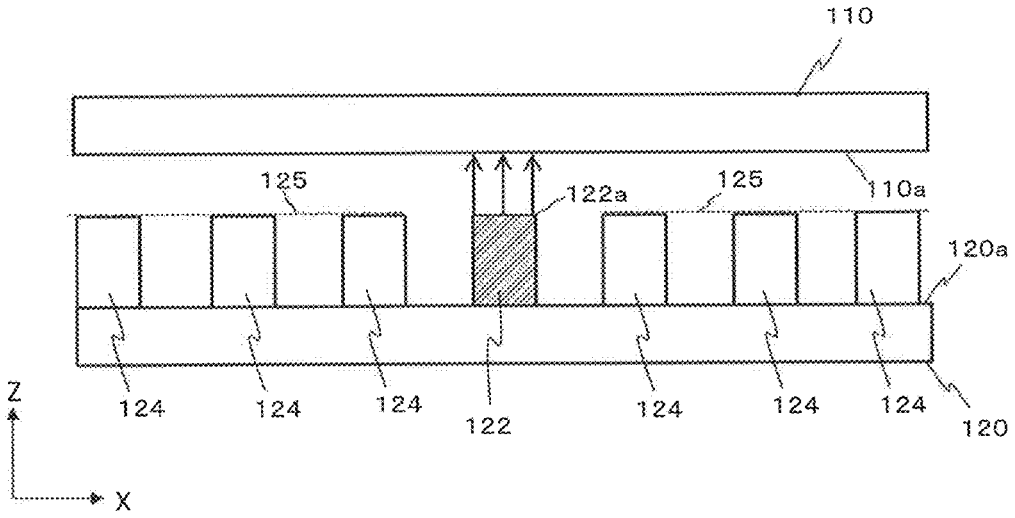
FIG. 5A is a cross-sectional view schematically showing electromagnetic waves propagating in the waveguide device 100.

FIG. 5A schematically shows an electromagnetic wave that propagates in a narrow space, i.e., a gap between the waveguide face 122*a* of the waveguide member 122 and the conductive surface 110*a* of the first conductive member 110. Three arrows in FIG. 5A schematically indicate the orientation of an electric field of the propagating electromagnetic wave. The electric field of the propagating electromagnetic wave is perpendicular to the conductive surface 110*a* of the first conductive member 110 and to the waveguide face 122*a*.

On both sides of the waveguide member 122, stretches of artificial magnetic conductor that are created by the plurality of conductive rods 124 are present. An electromagnetic wave propagates in the gap between the waveguide face 122*a* of the waveguide member 122 and the conductive surface 110*a* of the first conductive member 110. FIG. 5A is schematic, and does not accurately represent the magnitude of an electromagnetic field to be actually created by the electromagnetic wave. A part of the electromagnetic wave (electromagnetic field) propagating in the space over the waveguide face 122*a* may have a lateral expanse, to the outside (i.e., toward where the artificial magnetic conductor exists) of the space that is delineated by the width of the waveguide face 122*a*. In this example, the electromagnetic wave propagates in a direction (Y direction) which is perpendicular to the plane of FIG. 5A. As such, the waveguide member 122 does not need to extend linearly along the Y direction, but may include a bend(s) and/or a branching portion(s) not shown. Since the electromagnetic wave propagates along the waveguide face 122*a* of the waveguide member 122, the direction of propagation would change at a bend, whereas the direction of propagation would ramify into plural directions at a branching portion.

In the waveguide structure of FIG. 5A, no metal wall (electric wall), which would be indispensable to a hollow waveguide, exists on both sides of the propagating electromagnetic wave. Therefore, in the waveguide structure of this example, "a constraint due to a metal wall (electric wall)" is not included in the boundary conditions for the electromagnetic field mode to be created by the propagating electromagnetic wave, and the width (size along the X direction) of the waveguide face 122*a* is less than a half of the wavelength of the electromagnetic wave.

Figure 5B:
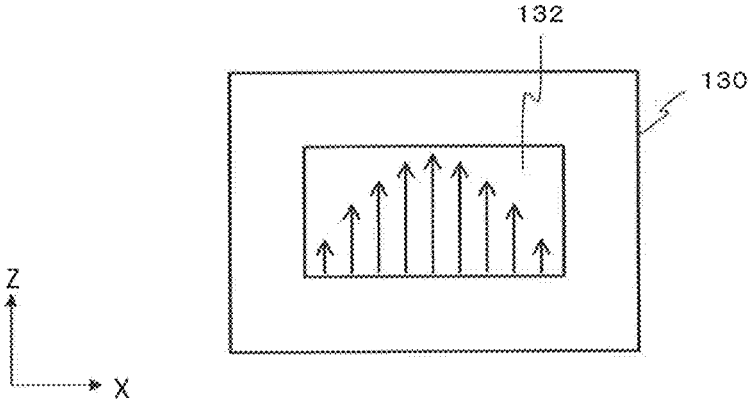
FIG. 5B is a cross-sectional view schematically showing the construction of a known hollow waveguide 130.

For reference, FIG. 5B schematically shows a cross section of a hollow waveguide 130. With arrows, FIG. 5B schematically shows the orientation of an electric field of an electromagnetic field mode ($TE_{10}$) that is created in the internal space 132 of the hollow waveguide 130. The lengths of the arrows correspond to electric field intensities. The width of the internal space 132 of the hollow waveguide 130 needs to be set to be broader than a half of the wavelength. In other words, the width of the internal space 132 of the hollow waveguide 130 cannot be set to be smaller than a half of the wavelength of the propagating electromagnetic wave.

Figure 5C:
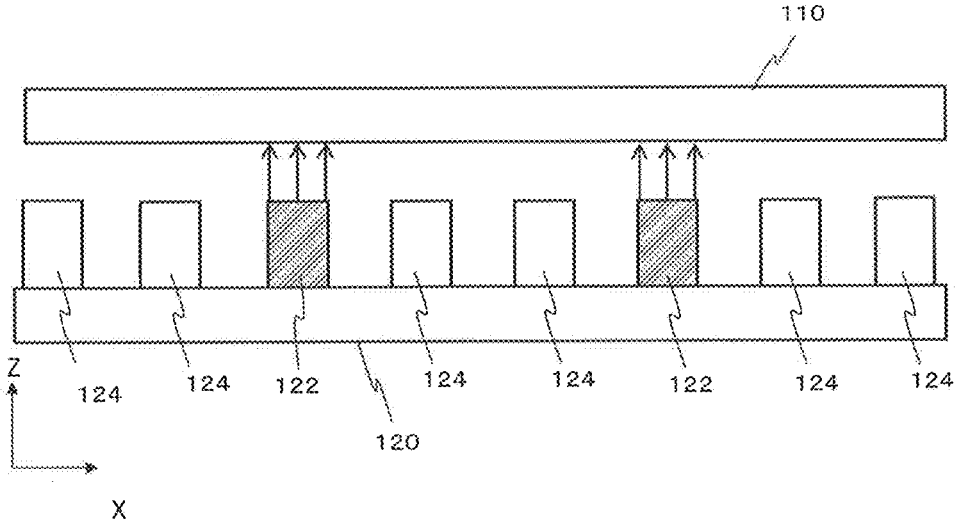
FIG. 5C is a cross-sectional view showing an implementation in which two waveguide members 122 are provided on a second conductive member 120.

FIG. 5C is a cross-sectional view showing an implementation where two waveguide members 122 are proved on the second conductive member 120. Thus, an artificial magnetic conductor that is created by the plurality of conductive rods 124 exists between the two adjacent waveguide members 122. More accurately, stretches of artificial magnetic conductor created by the plurality of conductive rods 124 are present on both sides of each waveguide member 122, such that each waveguide member 122 is able to independently propagate an electromagnetic wave.

Figure 5D:
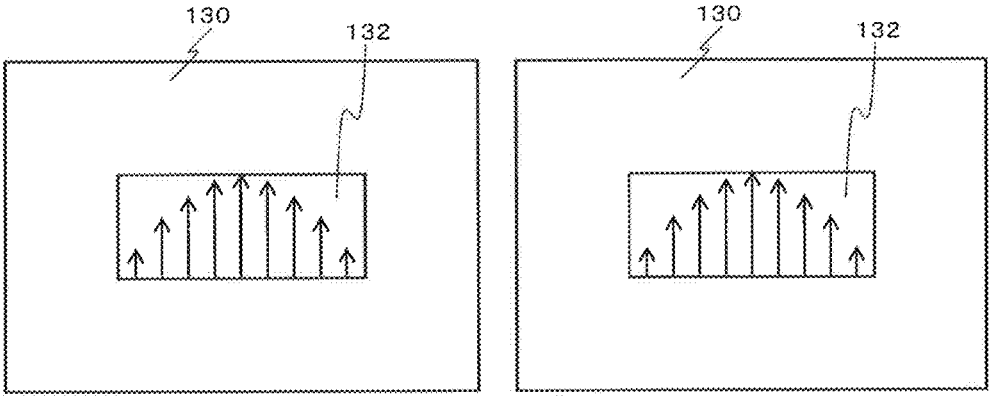
FIG. 5D is a cross-sectional view schematically showing the construction of a waveguide device in which two hollow waveguides 130 are placed side-by-side.

For reference's sake, FIG. 5D schematically shows a cross section of a waveguide device in which two hollow waveguides 130 are placed side-by-side. The two hollow waveguides 130 are electrically insulated from each other. Each space in which an electromagnetic wave is to propagate needs to be surrounded by a metal wall that defines the respective hollow waveguide 130. Therefore, the interval between the internal spaces 132 in which electromagnetic waves are to propagate cannot be made smaller than a total of the thicknesses of two metal walls. Usually, a total of the thicknesses of two metal walls is longer than a half of the wavelength of a propagating electromagnetic wave. Therefore, it is difficult for the interval between the hollow waveguides 130 (i.e., interval between their centers) to be shorter than the wavelength of a propagating electromagnetic wave. Particularly for electromagnetic waves of wavelengths in the extremely high frequency band (i.e., electromagnetic wave wavelength: 10 mm or less) or even shorter wavelengths, a metal wall which is sufficiently thin relative to the wavelength is difficult to be formed. This presents a cost problem in commercially practical implementation.

On the other hand, a waveguide device 100 including an artificial magnetic conductor can easily realize a structure in which waveguide members 122 are placed close to one another. Thus, such a waveguide device 100 can be suitably used in an array antenna that includes plural antenna elements in a close arrangement.

In order to enhance the degree of impedance matching at a bend(s) and a branching portion(s) of a waveguide member 122, the inventors have paid attention to the conductive rods 124 constituting an artificial magnetic conductor. Then, as will be described below in detail, the inventors have succeeded in enhancing the degree of impedance matching at a bend(s) and a branching portion(s) of a waveguide member 122 by improving the shape of the conductive rods 124. With an enhanced degree of impedance matching, a waveguide device having an improved propagation efficiency and less noise can be provided. It also allows to enhance the performance of an antenna device that includes such a waveguide device. More specifically, signal wave reflection is reduced through impedance matching, whereby power loss can be reduced, and in an antenna device, disorder in the phase of the electromagnetic wave to be transmitted or received can be reduced. Therefore, in communications, deteriorations in a communication signal can be suppressed; in a radar, precision of distance or azimuth-of-arrival estimation can be improved.

Hereinafter, a non-limiting and illustrative embodiment of a waveguide device according to the present disclosure will be described.

<Fundamental Construction of the Waveguide Device>

Figure 6:
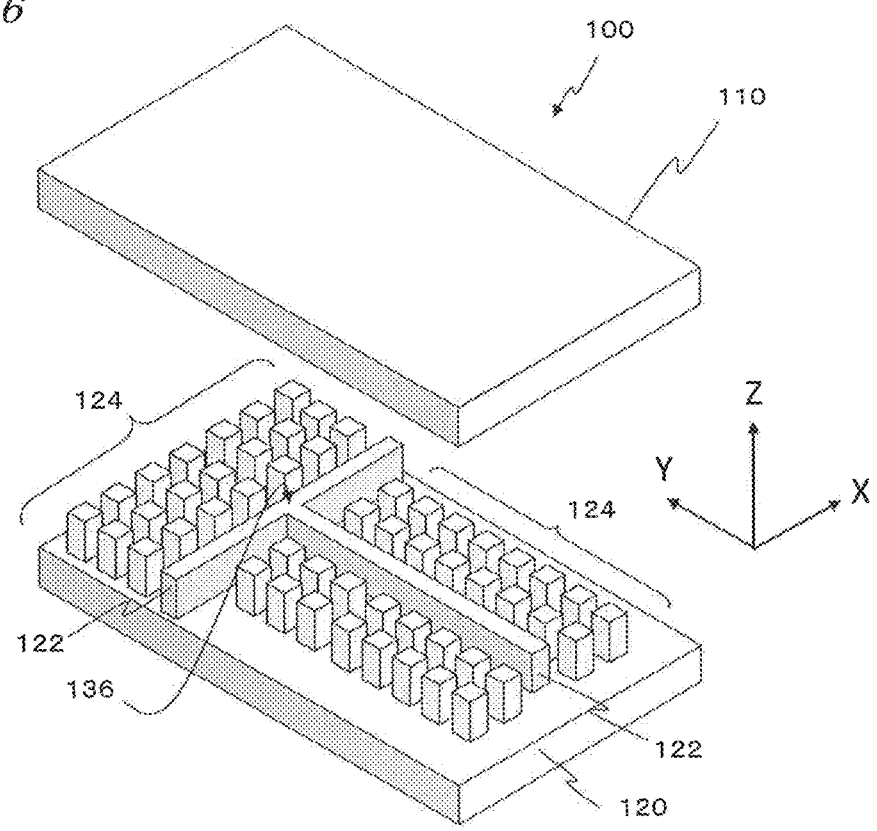
FIG. 6 is a perspective view schematically showing an exemplary construction for a waveguide device according to an embodiment of the present disclosure.
Figure 7:
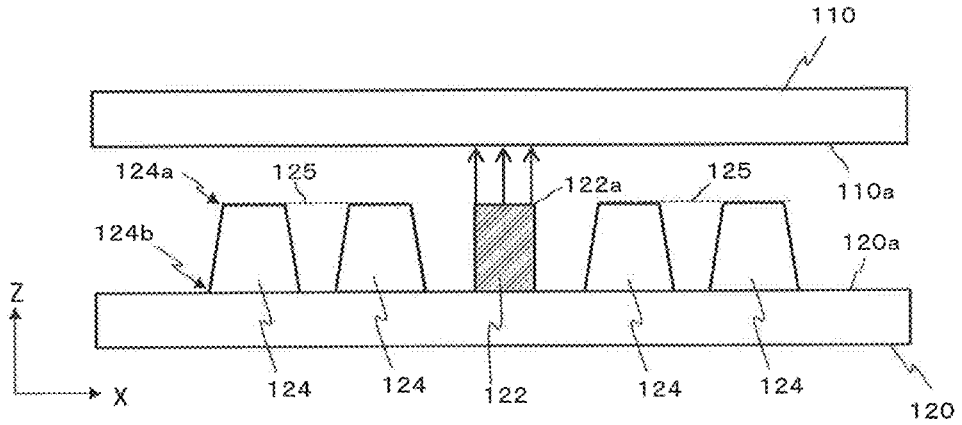
FIG. 7 is a diagram schematically showing the construction of a cross section of the waveguide device 100 taken parallel to the XZ plane.

First, see FIGS. 6 and 7. FIG. 6 is a perspective view schematically showing an exemplary construction for a waveguide device according to the present embodiment. For ease of understanding, FIG. 6 exaggerates the spacing between the first electrically conductive member 110 and the second electrically conductive member 120. FIG. 7 is a diagram schematically showing the construction of the waveguide device 100 in a cross section taken parallel to the XZ plane.

As shown in FIGS. 6 and 7, the waveguide device 100 of the present embodiment includes: a first electrically conductive member 110 having an electrically conductive surface 110*a* which is shaped as a plane; a second electrically conductive member 120 having a plurality of electrically conductive rods 124 arrayed thereon, each having a leading end 124*a* opposing the conductive surface 110*a*; and a waveguide member 122 having an electrically conductive waveguide face 122*a* opposing the conductive surface 110*a* of the first conductive member 110. The waveguide member 122, which extends along the conductive surface 110*a*, is provided among the plurality of conductive rods 124. Stretches of an artificial magnetic conductor composed of the plurality of conductive rods 124 are present on both sides of the waveguide member 122, such that the waveguide member 122 is sandwiched between the stretches of artificial magnetic conductor on both sides. In the present embodiment, the waveguide member 122 includes a branching portion 136 at which the direction that the waveguide member 122 extends ramifies into two or more directions. At the branching portion 136 in this example, the two branched waveguide members constitute an angle of 180 degrees, thus resulting in a shape resembling the letter "T"; hence, it may also be called a "T-branching". Another example of the branching portion 136 is a "Y-branching", where the two branched waveguide members extend in directions which are apart by an angle smaller than 180 degrees.

As described earlier, the plurality of conductive rods 124 arrayed on the second conductive member 120 each have a leading end 124*a* opposing the conductive surface 110*a*. In the example shown in the figure, the leading ends 124*a* of the conductive rods 124 are on substantially the same plane, thus defining the surface 125 of the artificial magnetic conductor.

<Fundamental Structure of Conductive Rods>

Branching Portion

In the present embodiment, as shown in FIG. 7, the side faces of each conductive rod 124 are tilted so that a measure of the outer shape of a cross section of each conductive rod 124 taken perpendicular to the axial direction (Z direction) monotonically decreases from the root 124*b* toward the leading end 124*a*. This enhances the degree of impedance matching at the branching portion 136 of the waveguide member 122, as has been made clear by an electromagnetic field simulation.

Figure 8A:
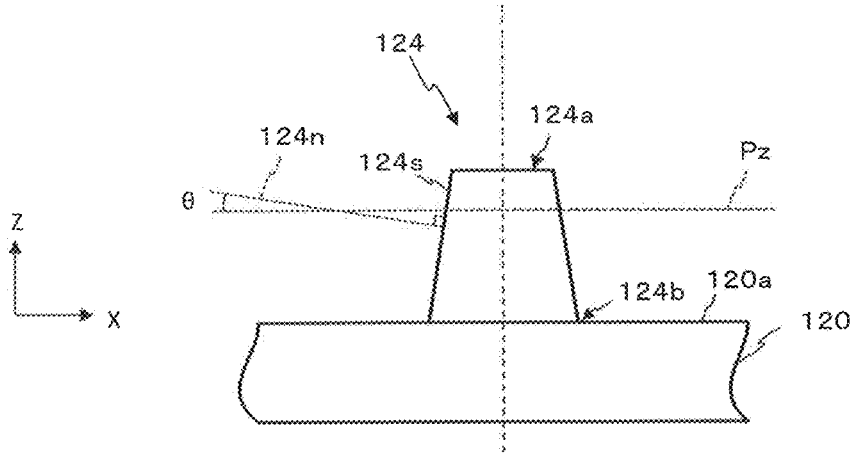
FIG. 8A is a cross-sectional view of a conductive rod 124 in a plane containing the axial direction (Z direction).
Figure 8B:
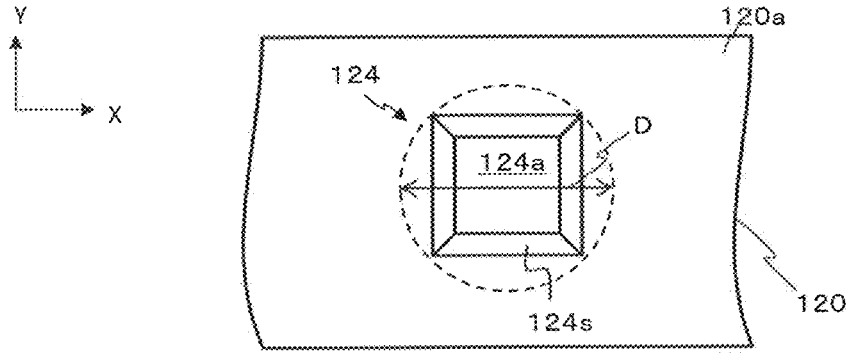
FIG. 8B is an upper plan view of the conductive rod 124 of FIG. 8A as viewed in the axial direction (Z direction).

FIG. 8A is a cross-sectional view of a conductive rod 124 in a plane containing the axial direction (Z direction). FIG. 8B is an upper plan view of the conductive rod 124 of FIG. 8A as viewed in the axial direction (Z direction). In this example, each conductive rod 124 has a frustum shape with square cross sections perpendicular to the axial direction (Z direction), such that the four side faces 124*s* of the conductive rod 124 are tilted with respect to the axial direction (Z direction). As shown in FIG. 8A, the angle of tilt of each side face 124*s* of each conductive rod is defined by an angle 9, which the normal 124*n* of the side face 124*s* constitutes with an arbitrary plane Pz that is orthogonal to the axial direction (Z direction).

The "measure of the outer shape of a cross section of the conductive rod taken perpendicular to the axial direction" is defined by the diameter of a smallest circle that is capable of containing the "outer shape of a cross section" inside. Such a circle will be a circumcircle in the case where the outer shape of a cross section is a triangle, a rectangle (including a square), or a regular polygon. In the case where the "outer shape of a cross section" is a circle or an ellipse, the "measure of the outer shape of a cross section" is the diameter of the circle or the length of the major axis of the ellipse. In the present disclosure, the "outer shape of a cross section" of a conductive rod is not limited to a shape for which a circumcircle exists. In the example shown in FIGS. 8A and 8B, the measure of the outer shape of a cross section of each conductive rod 124 taken perpendicular to the axial direction decreases from the root 124*b* of the conductive rod 124 toward the leading end 124*a*.

In the example shown in FIGS. 8A and 8B, the area of a cross section taken perpendicular to the axial direction of the conductive rod 124 is smaller at the leading end 124*a* than at the root 124*b*. As described earlier, each conductive rod 124 does not need to be entirely electrically conductive, but only the surface may be electrically conductive. Therefore, the conductive rod 124 may have a hollow structure, or include a dielectric core inside. The "area of a cross section of the conductive rod taken perpendicular to the axial direction" means the area of a region which is delineated from the exterior by the contour line of the "outer shape" of a cross section of the conductive rod taken perpendicular to the axial direction. Even if a non-electrically conductive portion is included within that region, it is irrelevant to the "area of the cross section".

Hereinafter, it will be described how use of such conductive rods 124 improves the degree of impedance matching.

The inventors have made it clear through a simulation that the construction according to the present embodiment provides an improved degree of impedance matching over the conventional construction in which the side faces of each conductive rod 124 are not tilted. Herein, the degree of impedance matching is represented by an input reflection coefficient. The lower the input reflection coefficient is, the higher the degree of impedance matching is. The input reflection coefficient is a coefficient which represents a ratio of the intensity of a reflected wave to the intensity of an input wave which is incoming to a radio frequency line or an element.

Figure 9A:
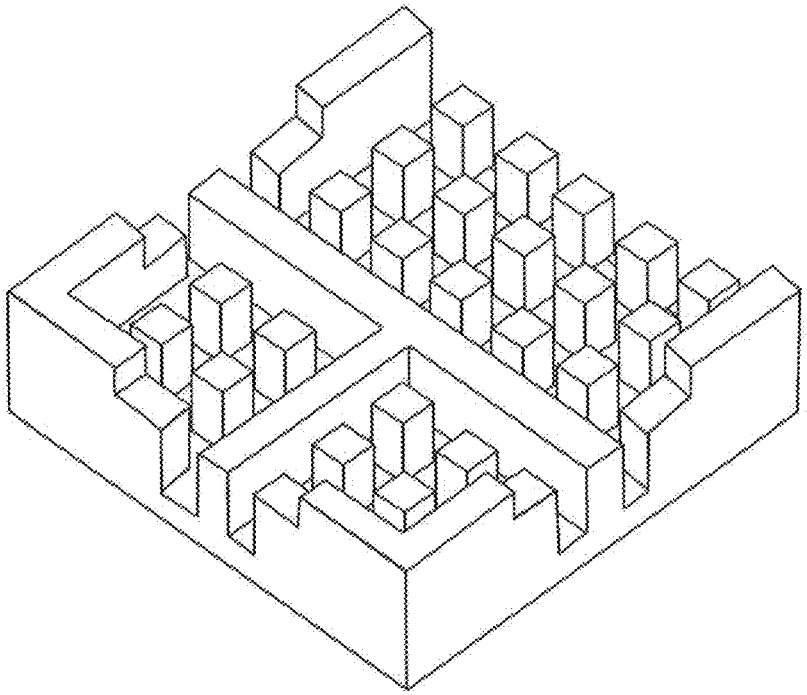
FIG. 9A is a perspective view schematically showing a conventional construction where the side faces of each conductive rod 124 are not tilted, in a construction including a branching portion.
Figure 9B:
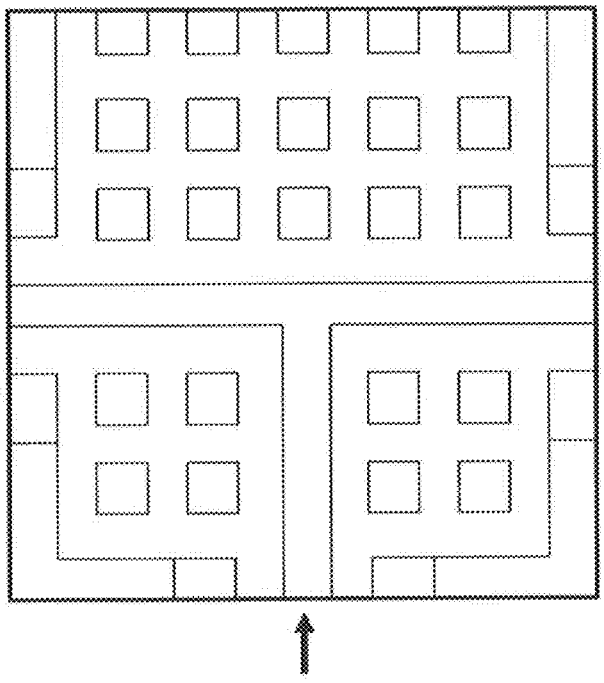
FIG. 9B is an upper plan view of the waveguide device shown in FIG. 9A.
Figure 9C:
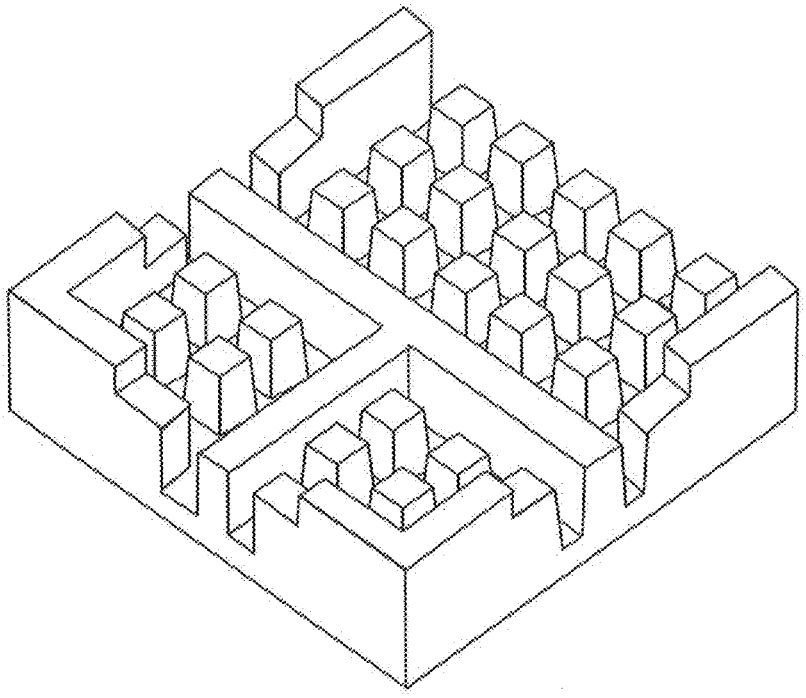
FIG. 9C is a perspective view schematically showing a construction according to the present embodiment where the side faces of each conductive rod 124 are tilted, in a construction including a branching portion.
Figure 9D:
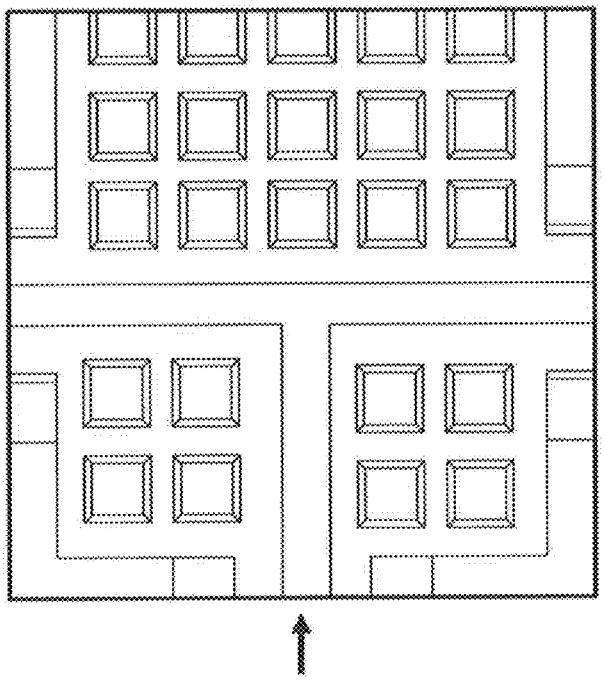
FIG. 9D is an upper plan view of the waveguide device shown in FIG. 9C.

FIGS. 9A through 9D are diagrams showing the construction of a waveguide device used in this simulation. FIG. 9A is a perspective view schematically showing a conventional construction in which the side faces of each conductive rod 124 are not tilted. FIG. 9B is an upper plan view of the waveguide device shown in FIG. 9A. FIG. 9C is a perspective view schematically showing a construction according to the present embodiment where the side faces of each conductive rod 124 are tilted. FIG. 9D is an upper plan view of the waveguide device shown in FIG. 9C.

In this simulation, an input reflection coefficient S of the branching portion was measured with respect to a number of constructions in which the four side faces of each conductive rod 124 had different angles of tilt. In this simulation, given a frequency Fo of 74.9475 GHz, an electromagnetic wave (also referred to as an "input wave") in a frequency band centered around Fo was measured. Given a wavelength $\lambda o$ in free space that corresponds to Fo, an average width of each conductive rod, an average width of interspaces between rods, and the width of the waveguide member (ridge) were $\lambda o/8$, while the height of each rod and the ridge was $\lambda o/4$. The input wave was allowed to be incident in the orientation of an arrow shown in FIG. 9D and FIG. 9B.

Figure 10:
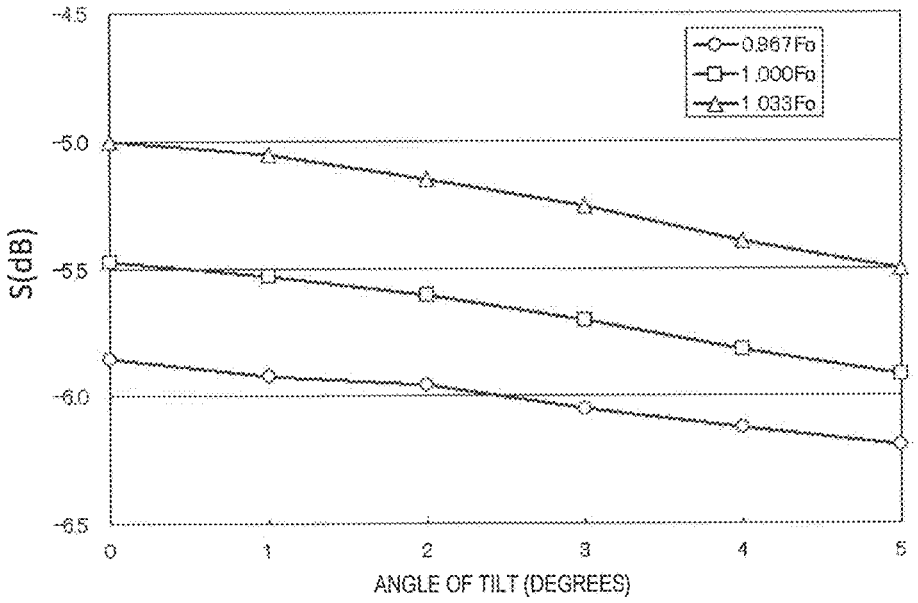
FIG. 10 is a graph showing an input reflection coefficient S for an input wave at frequencies of 0.967 Fo, 1.000 Fo and 1.033 Fo, in the respective cases where the angle of tilt θ is 0°, 1°, 2°, 3°, 4° and 5°, in a construction including a branching portion.

FIG. 10 is a graph showing results of this simulation. The graph of FIG. 10 shows an input reflection coefficient S (dB) for an input wave at frequencies of 0.967 Fo, 1.000 Fo and 1.033 Fo, in the respective cases where the angle of tilt $\theta$ is 0°, 1°, 2°, 3°, 4° and 5°.

It can be seen from FIG. 10 that, irrespective of the frequency of the input wave, the input reflection coefficient S becomes lower as the side faces of each conductive rod 124 are tilted. In other words, it was confirmed that the construction of the present embodiment improves the degree of impedance matching.

Bend

The aforementioned effect is also achieved in the case where the waveguide member 122 includes a bend(s). A bend is a portion where a change occurs in the direction that the waveguide member 122 extends. A bend is inclusive of any portion where the direction that the waveguide member 122 extends undergoes a drastic change, a gentle change, or meanders.

Figure 11:
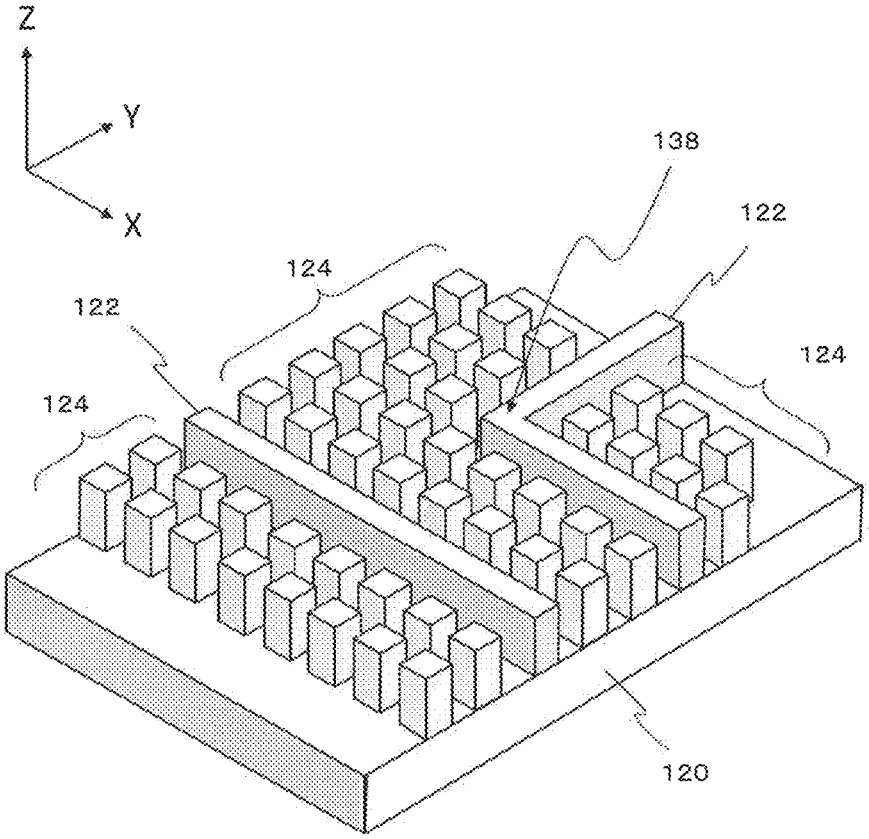
FIG. 11 is a perspective view schematically showing another exemplary construction for a waveguide device according to another embodiment of the present disclosure.

See FIG. 11. FIG. 11 is a perspective view schematically showing another exemplary construction of a waveguide device according to the present embodiment. For ease of understanding, the first conductive member 110 is omitted from illustration in FIG. 11.

The waveguide device shown in the figure includes two waveguide members 122, where one of the waveguide member 122 includes a bend 138.

By using conductive rods 124 with tilted side faces, the degree of impedance matching can also be improved at the bend 138. This will be described below.

The inventors have conducted a simulation, through which it has been made clear that a construction including a bend also improves the degree of impedance matching over that of the conventional construction in which the side faces of each conductive rod 124 are not tilted. Hereinafter, results of this simulation will be described.

Figure 12A:
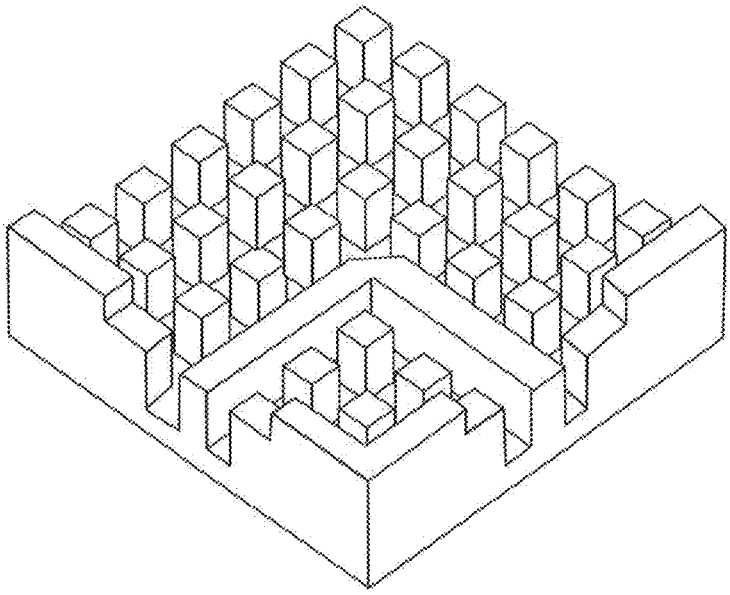
FIG. 12A is a perspective view schematically showing a conventional construction in which the side faces of each conductive rod 124 are not tilted, in a construction including a bend.
Figure 12B:
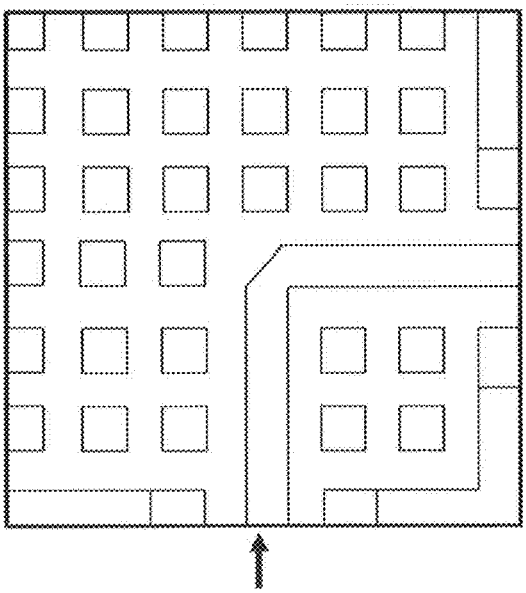
FIG. 12B is an upper plan view of the waveguide device shown in FIG. 12A.
Figure 12C:
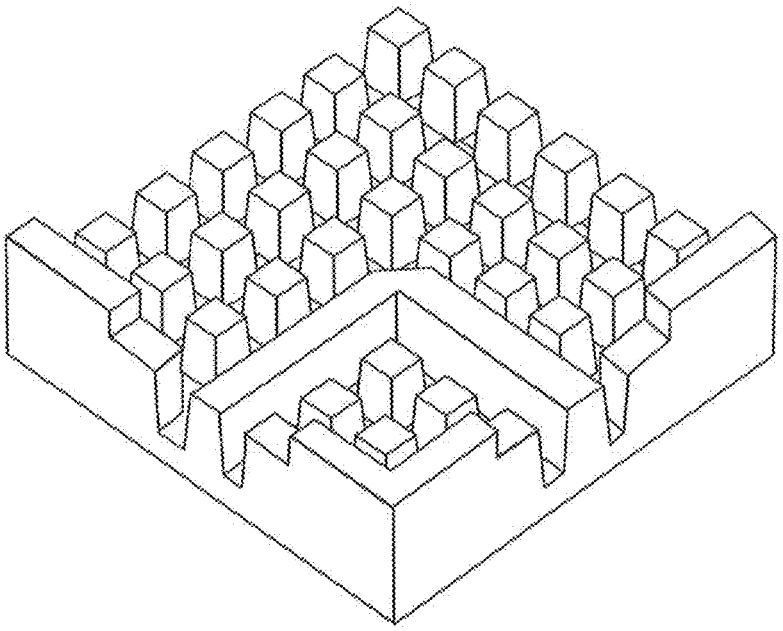
FIG. 12C is a perspective view schematically showing a construction according to the present embodiment where the side faces of each conductive rod 124 are tilted, in a construction including a bend.
Figure 12D:
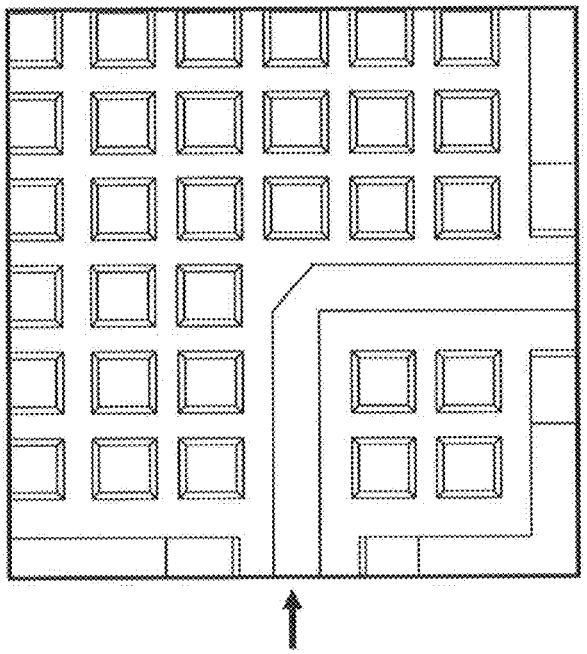
FIG. 12D is an upper plan view of the waveguide device shown in FIG. 12C.

FIGS. 12A through 12D are diagrams showing the construction of a waveguide device used in this simulation. FIG. 12A is a perspective view schematically showing a conventional construction in which the side faces of each conductive rod 124 are not tilted. FIG. 12B is an upper plan view of the waveguide device shown in FIG. 12A. FIG. 12C is a perspective view schematically showing a construction according to the present embodiment where the side faces of each conductive rod 124 are tilted. FIG. 12D is an upper plan view of the waveguide device shown in FIG. 12C. In this simulation, the input wave is allowed to be incident in the orientation of an arrow shown in FIG. 12B and FIG. 12D, and an input reflection coefficient at the bend was measured. Otherwise, the simulation conditions were similar to the conditions in the earlier-mentioned simulation.

Figure 13:
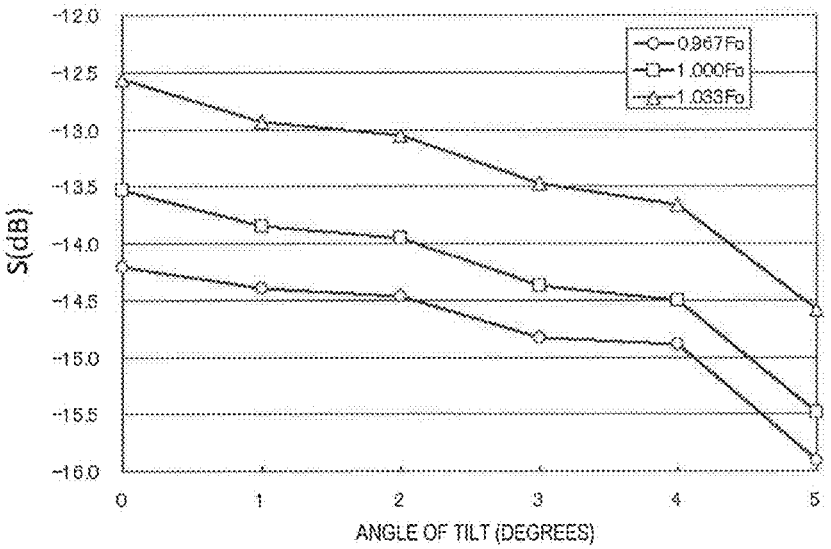
FIG. 13 is a graph showing an input reflection coefficient S for an input wave at frequencies of 0.967 Fo, 1.000 Fo and 1.033 Fo, in the respective cases where the angle of tilt θ is 0°, 1°, 2°, 3°, 4° and 5°, in a construction including a bend.

FIG. 13 is a graph showing results of this simulation. The graph of FIG. 13 shows an input reflection coefficient S (dB) for an input wave at frequencies of 0.967 Fo, 1.000 Fo and 1.033 Fo, in the respective cases where the angle of tilt θ is 0°, 1°, 2°, 3°, 4° and 5°.

It can be seen from FIG. 13 that, irrespective of the frequency of the input wave, the input reflection coefficient S becomes lower as the side faces of each conductive rod 124 are tilted. In other words, it was confirmed that the construction of the present embodiment improves the degree of impedance matching.

Note that a branching portion and a bend may both be included in one waveguide member 122. For example, the waveguide member 122 may feature a structure combining a branching portion and a bend. Moreover, the shape (e.g., height or width) of the waveguide member 122 may undergo a local change(s) in a conventional manner, at a position near a branching portion or a bend. By thus introducing local changes in the shape of the waveguide member 122, a further improvement in the degree of impedance matching can be attained, in combination with the effect of the conductive rods 124 of the waveguide device according to the present disclosure.

<Other Structures for Conductive Rods>

Next, examples of other shapes for the conductive rods that can provide the effect according to the present disclosure will be described.

Figure 14A:
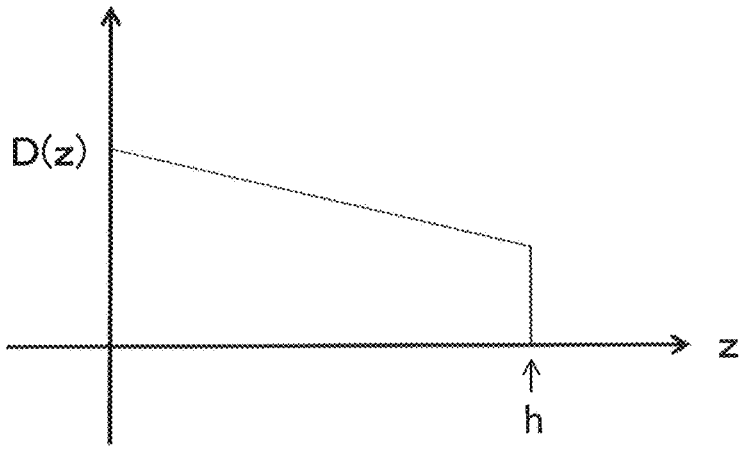
FIG. 14A is a graph showing an example of expressing a measure D of the outer shape of a cross section of a conductive rod 124 taken perpendicular to the axial direction (Z direction), as a function D(z) of distance z of the conductive rod 124 from its root 124*b*.
Figure 14B:
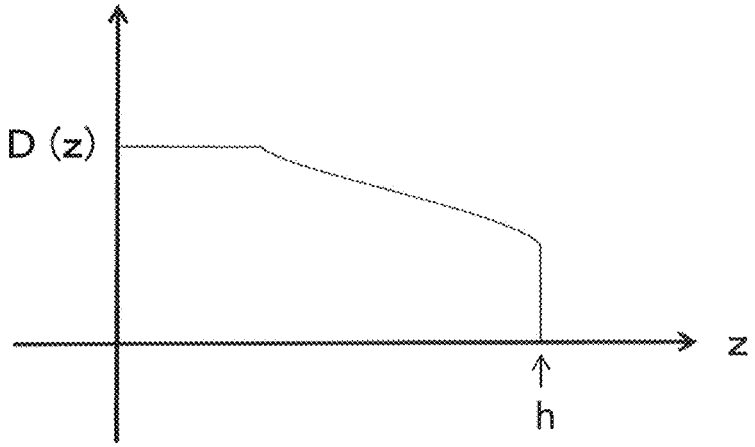
FIG. 14B is a graph representing an example where, within a specific range of z, D(z) does not change in magnitude even if z increases.

First, see FIGS. 14A and 14B. FIG. 14A is a graph showing an example of expressing a measure D of the outer shape of a cross section of a conductive rod 124 taken perpendicular to the axial direction (Z direction), as a function D(z) of distance z of the conductive rod 124 from its root 124*b*. The distance z is to be measured from the root 124*b* of each conductive rod 124, in parallel to the axial direction (Z direction) of the conductive rod 124.

FIG. 14A shows an example of a function D(z) concerning the conductive rods 124 as mentioned above. In FIG. 14A, the letter "h" means the height (i.e., size along the axial direction) of the conductive rod. D(z) has a gradient corresponding to the tilt of a side face 124*s* of each conductive rod 124. While the gradient of D(z) in the earlier-described embodiment was uniform in each conductive rod 124, the waveguide device according to the present disclosure is not limited to such an example. The aforementioned effect will be obtained so long as D(z) monotonically decreases in response to increasing z.

In the present application, the feature that "a measure of the outer shape of a cross section of a conductive rod taken perpendicular to the axial direction monotonically decreases from its root that is in contact with the second conductive member toward its leading end" means that $D(z1) \geq D(z2)$ and $D(0) > D(h)$ hold true for any arbitrary z1 and z2 that satisfies $0 < z1 < z2 < h$. As indicated by the sign "≥" consisting of an inequality sign and an equality sign, the conductive rod may have a portion whose D(z) does not change in magnitude even if z increases. FIG. 14B represents an example where, within a specific range of z, D(z) does not change in magnitude even if z increases. The aforementioned effect can also be obtained with a conductive rod having such outer dimensions.

Figure 15A:
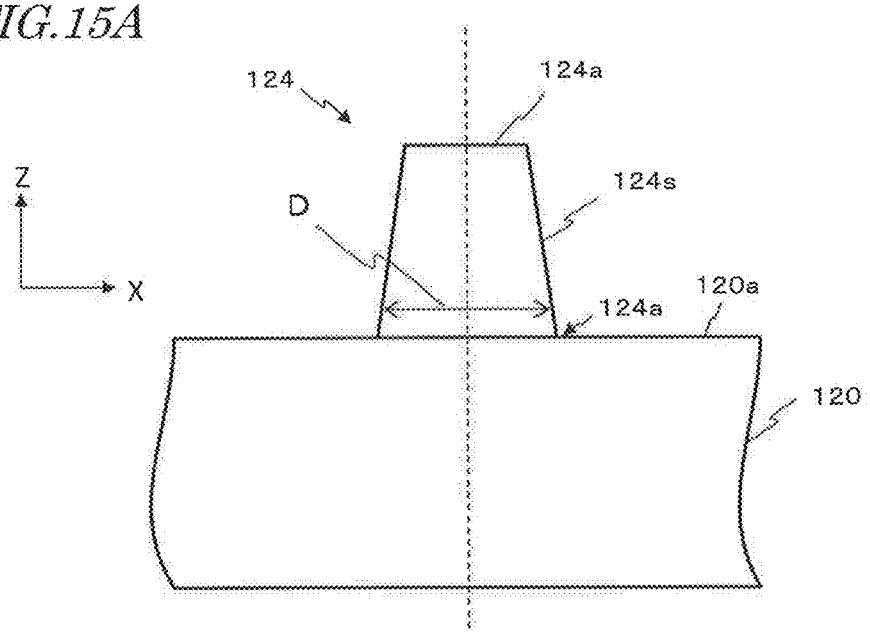
FIG. 15A is a cross-sectional view of a conductive rod 124 in a plane containing the axial direction (Z direction) in another example.
Figure 15B:
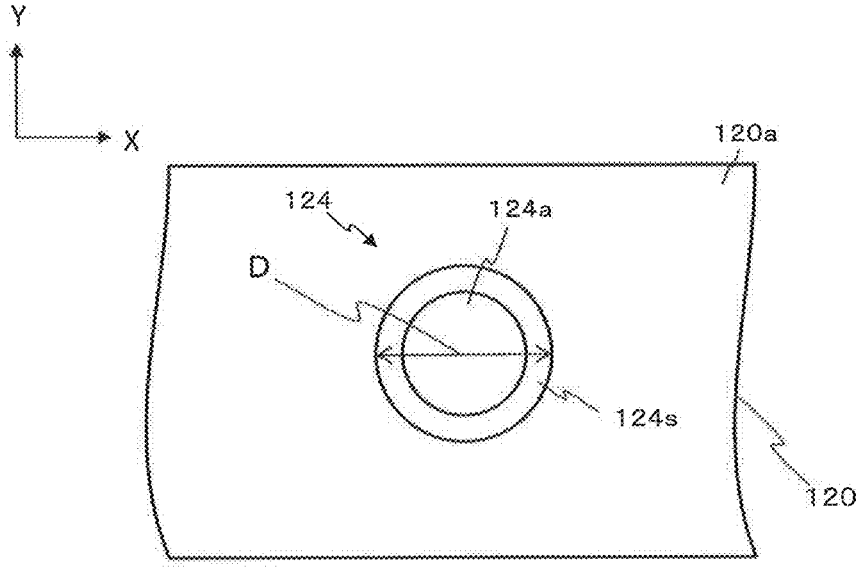
FIG. 15B is an upper plan view of the conductive rod 124 of FIG. 15A as viewed in the axial direction (Z direction).

FIG. 15A is a cross-sectional view of a conductive rod 124 in a plane containing the axial direction (Z direction) in another example. FIG. 15B is an upper plan view of the conductive rod 124 of FIG. 15A as viewed in the axial direction (Z direction). In this example, the outer shape of a cross section of the conductive rod 124 taken perpendicular to the axial direction is a circle. The "outer shape of a cross section" may also be an ellipse. In the case where the outer shape of a cross section is a circle, the "measure of the outer shape of a cross section of the conductive rod taken perpendicular to the axial direction" is equal to the diameter of the circle. In the case where the outer shape of a cross section is an ellipse, the "measure of the outer shape of a cross section of the conductive rod taken perpendicular to the axial direction" is equal to the length of the major axis of ellipse.

Thus, even when "a cross section of the conductive rod taken perpendicular to the axial direction" has a shape other than a square, the degree of impedance matching at a branching portion(s) and a bend(s) can be enhanced by tilting its side faces.

Figure 16A:
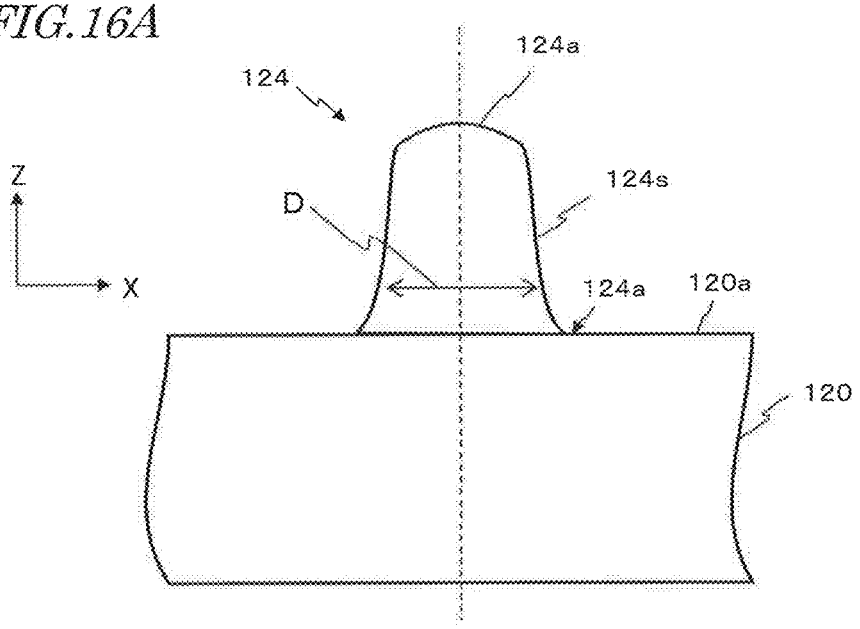
FIG. 16A is a cross-sectional view of a conductive rod 124 in a plane containing the axial direction (Z direction) in still another example.
Figure 16B:
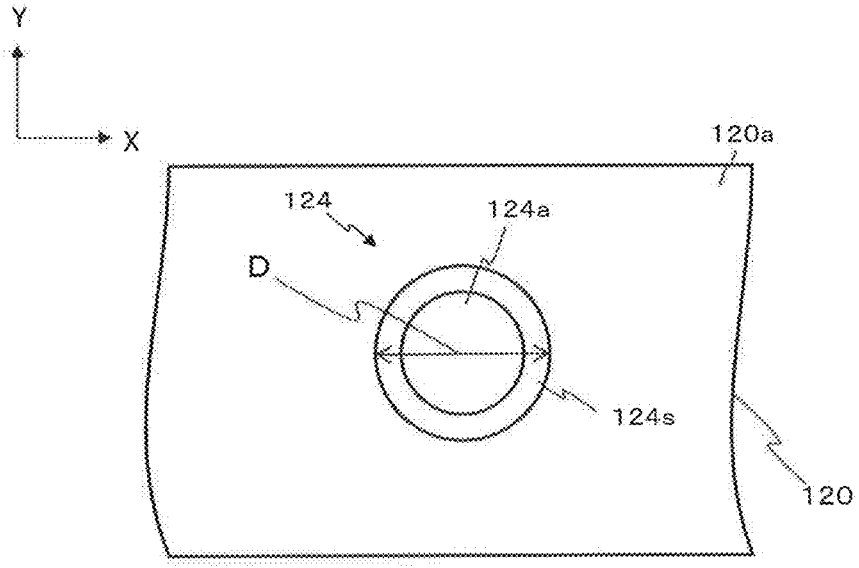
FIG. 16B is an upper plan view of the conductive rod 124 of FIG. 16A as viewed in the axial direction (Z direction).

Note that the leading end 124*a* of each conductive rod 124 does not need to be a plane; as in the example shown in FIGS. 16A and 16B, it may also be a curved surface.

Figure 17A:
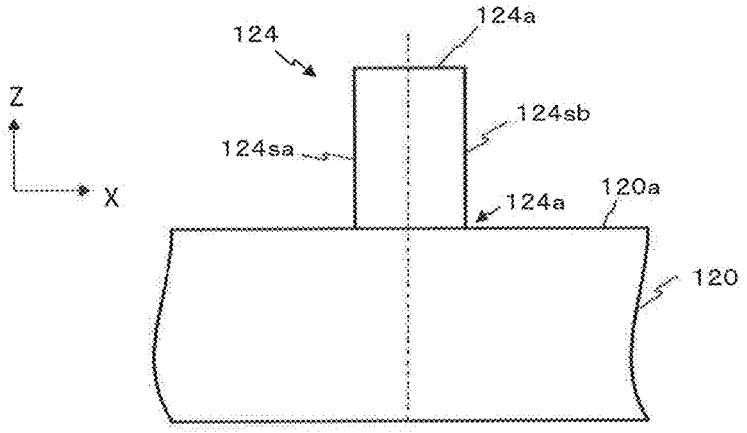
FIG. 17A is a diagram showing a cross section of a conductive rod 124 taken parallel to the XZ plane in still another example.
Figure 17B:
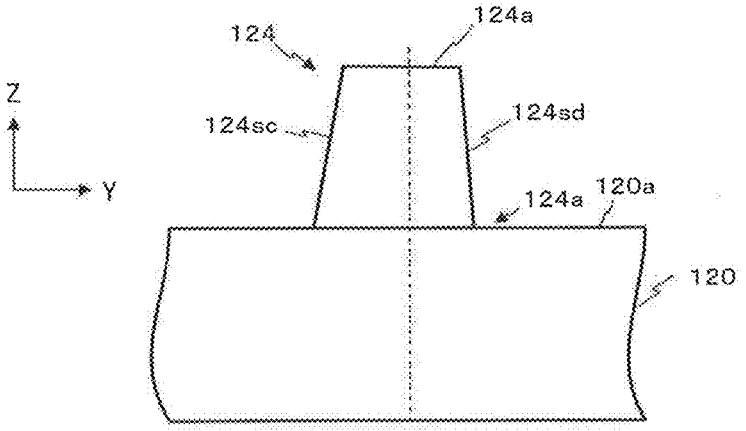
FIG. 17B is a diagram showing a cross section of the conductive rod 124 of FIG. 17A taken parallel to the YZ plane.
Figure 17C:
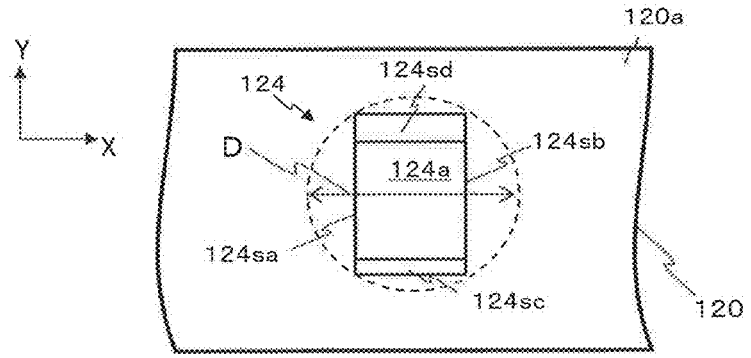
FIG. 17C is a diagram showing a cross section of the conductive rod 124 of FIG. 17A taken parallel to the XY plane.

FIGS. 17A, 17B and 17C are diagrams showing another exemplary shape of a conductive rod 124. FIG. 17A shows a cross section of a conductive rod 124 taken parallel to the XZ plane; FIG. 17B shows a cross section of the conductive rod 124 taken parallel to the YZ plane; and FIG. 17C shows a cross section of the conductive rod 124 taken parallel to the XY plane. In this example, the outer shape of a cross section of the conductive rod 124 taken perpendicular to the axial direction is a rectangle, as shown in FIG. 17C. As shown in FIGS. 17A and 17B, among the four side faces 124*sa*, 124*sb*, 124*sc* and 124*sd* of the conductive rod 124 in this example, only the faces 124*sc* and 124*sd* are tilted; the other side faces 124*sa* and 124*sb* are not tilted.

Figure 18A:
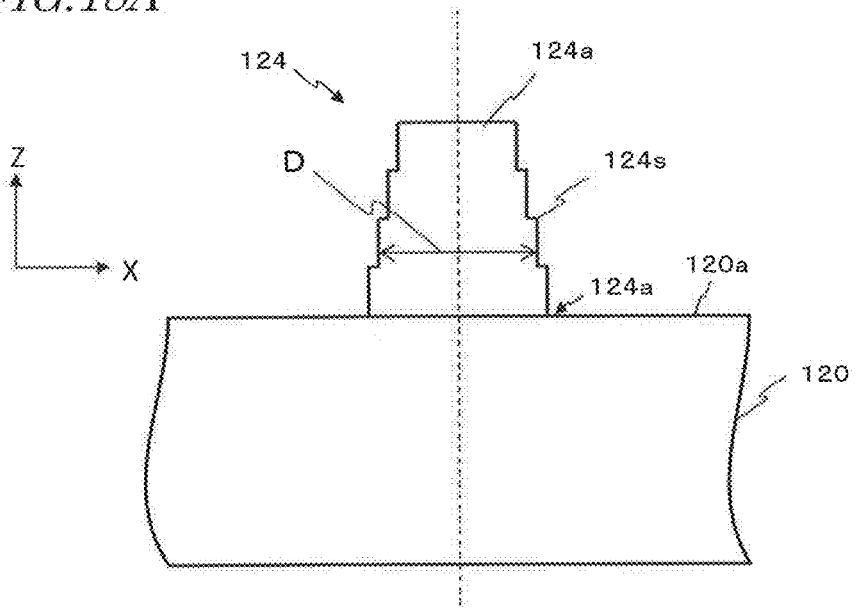
FIG. 18A is a cross-sectional view of a conductive rod 124 in a plane containing the axial direction (Z direction) in still another example.
Figure 18B:
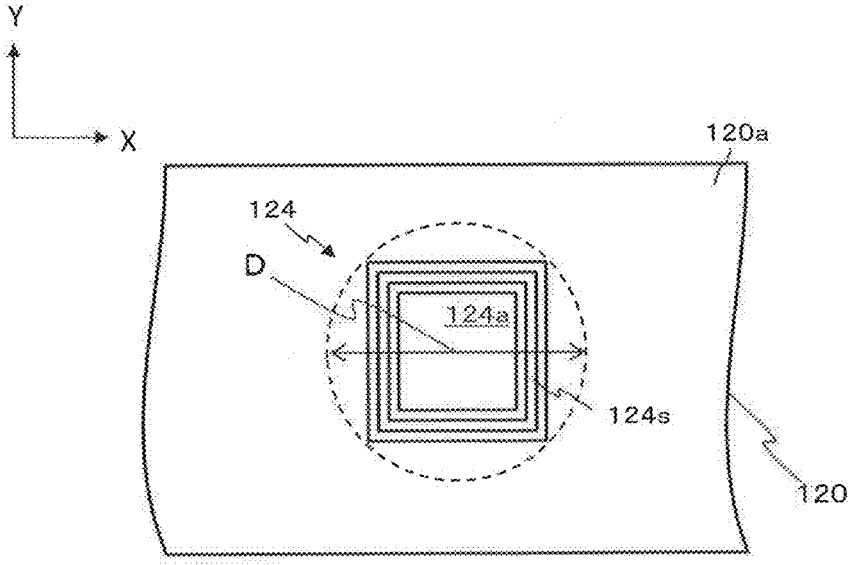
FIG. 18B is an upper plan view of the conductive rod 124 of FIG. 18A as viewed in the axial direction (Z direction).

FIG. 18A is a cross-sectional view of a conductive rod 124 in a plane containing the axial direction (Z direction) in still another example. FIG. 18B is an upper plan view of the conductive rod 124 of FIG. 18A as viewed in the axial direction (Z direction). The conductive rod 124 in this example has a stepped shape. A measure of "a cross section of the conductive rod taken perpendicular to the axial direction" undergoes drastic changes locally. In the meaning of the present application, such a shape also satisfies the feature that "a measure of the outer shape of a cross section of a conductive rod taken perpendicular to the axial direction monotonically decreases from its root that is in contact with the second conductive member toward its leading end".

Figure 19:
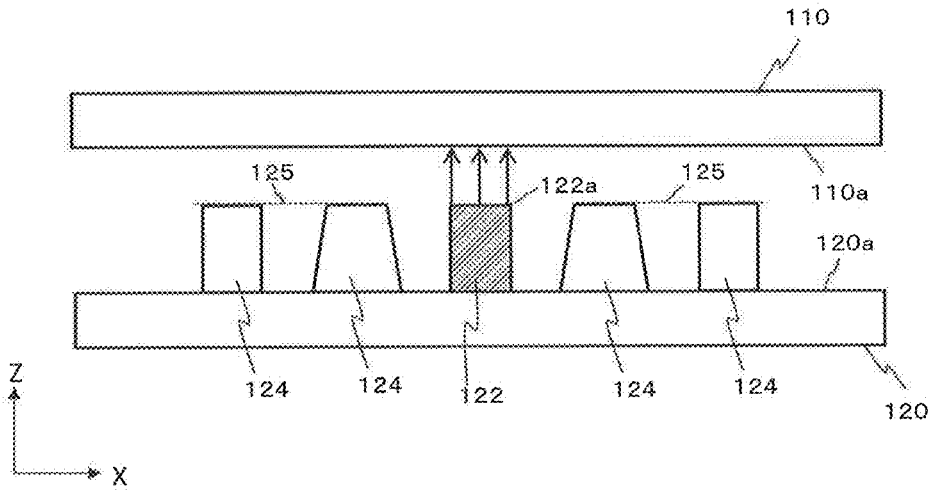
FIG. 19 is a cross-sectional view showing an exemplary construction in which an earlier-described characteristic shape is imparted to only those conductive rods 124 which are adjacent to a waveguide member 122.

In the above embodiment, the plurality of conductive rods 124 that are arrayed on the second conductive member 120 are of an identical shape. However, the waveguide device according to the present disclosure is not limited to such examples. The plurality of conductive rods 124 composing an artificial magnetic conductor may be of different shapes and/or sizes from one another. Moreover, as shown in FIG. 19, the earlier-described characteristic shape may be imparted to only those conductive rods 124 which are adjacent to the waveguide member 122. Moreover, a shape which is identical to that of a conventional conductive rod may be imparted to those conductive rods which are in any position that does not affect the degree of impedance matching at a branching portion or a bend of the waveguide member 122, while the earlier-described characteristic shape may be imparted only to those conductive rods which are in any position that affects the degree of impedance matching at a branching portion or a bend. Specifically, it suffices so long as a measure of the outer shape of a cross section of "a conductive rod that is adjacent to a branching portion or a bend" of the waveguide member 122, taken perpendicular to the axial direction, monotonically decreases from its root toward its leading end. As used herein, "a conductive rod that is adjacent to a branching portion or a bend" is defined, when there is no other intervening conductive rod between a conductive rod of interest and "a branching portion or a bend", to be that "conductive rod of interest".

<Antenna Device>

Hereinafter, a non-limiting and illustrative embodiment of an antenna device including a waveguide device according to the present disclosure will be described.

Figure 20A:
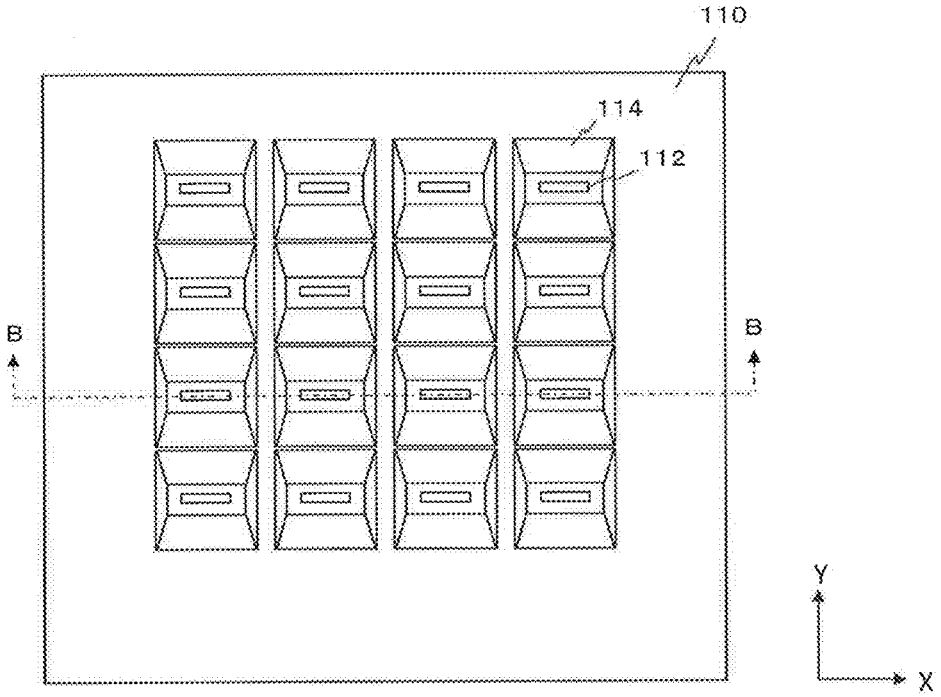
FIG. 20A is an upper plan view of an array antenna according to an embodiment of the present disclosure as viewed in the Z direction.
Figure 20B:
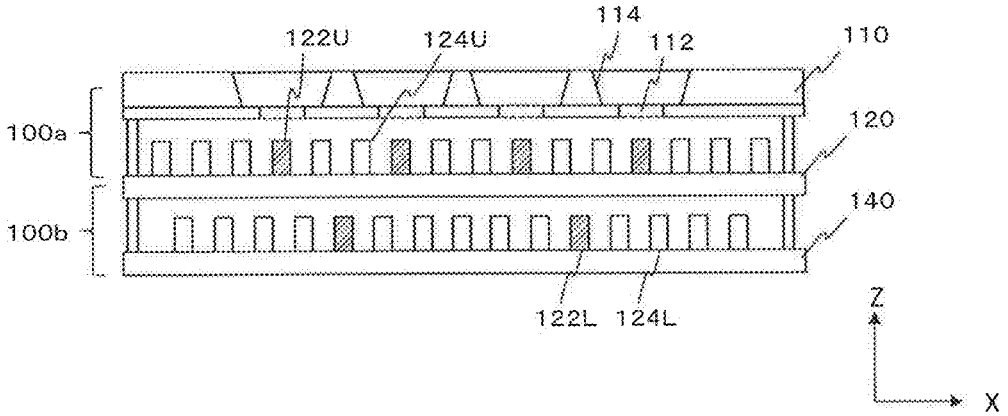
FIG. 20B is a cross-sectional view taken along line B-B in FIG. 20A.

FIG. 20A is an upper plan view of an antenna device (array antenna) including 16 slots (openings) 112 in an array of 4 rows and 4 columns, as viewed in the Z direction. FIG. 20B is a cross-sectional view taken along line B-B in FIG. 20A. In the antenna device shown in the figures, a first waveguide device 100*a* and a second waveguide device 100*b* are layered. The first waveguide device 100*a* includes waveguide members 122U that directly couple to slots 112 functioning as radiation elements (antenna elements). The second waveguide device 100*b* includes further waveguide members 122L that couple to the waveguide members 122U of the first waveguide device 100*a*. The waveguide members 122L and the conductive rods 124L of the second waveguide device 100*b* are arranged on a third conductive member 140. The second waveguide device 100*b* is basically similar in construction to the first waveguide device 100*a*.

On the first conductive member 110 in the first waveguide device 100*a*, side walls 114 surrounding each slot 112 are provided. The side walls 114 form a horn that adjusts directivity of the slot 112. The number and arrangement of slots 112 in this example are only illustrative. The orientations and shapes of the slots 112 are not limited to those of the example shown in the figures, either. It is not intended that the example shown in the figures provides any limitation as to whether the side walls 114 of each horn are tilted or not, the angles thereof, or the shape of each horn.

Figure 21:
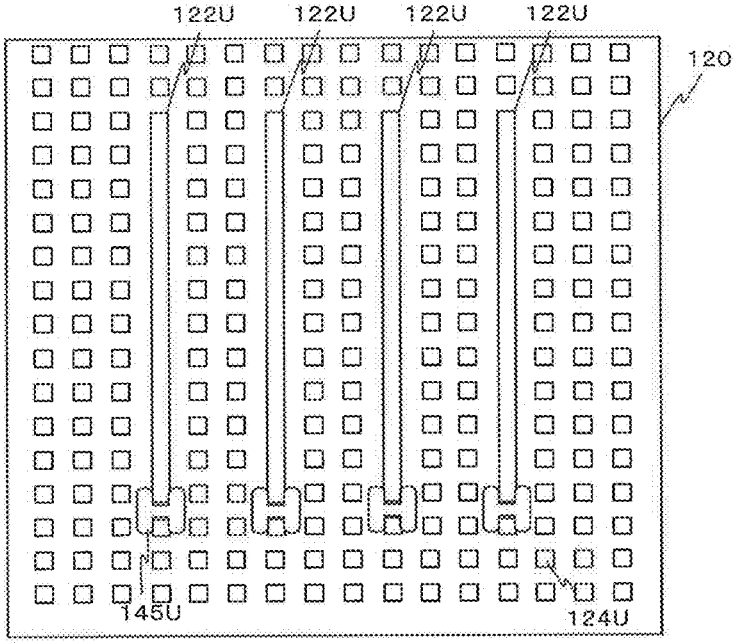
FIG. 21 is a diagram showing a planar layout of waveguide members 122 in a first waveguide device 100*a*.
Figure 22:
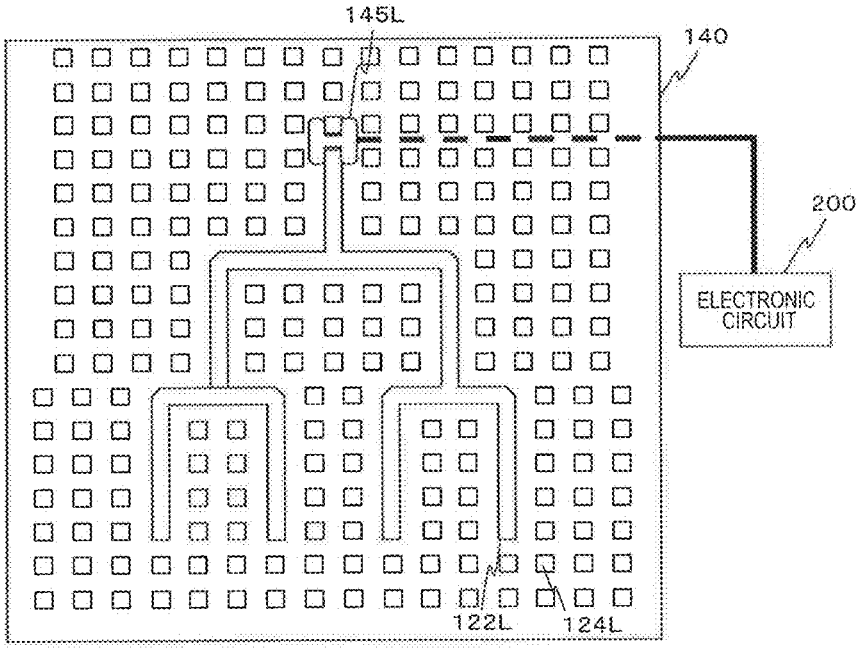
FIG. 22 is a diagram showing a planar layout of a waveguide member 122 in a second waveguide device 100*b*.

FIG. 21 is a diagram showing a planar layout of waveguide members 122U in the first waveguide device 100*a*. FIG. 22 is a diagram showing a planar layout of a waveguide member 122L in the second waveguide device 100*b*. As is clear from these figures, the waveguide members 122U of the first waveguide device 100*a* extend linearly, and include no branching portions or bends; on the other hand, the waveguide members 122L of the second waveguide device 100*b* include both branching portions and bends. In terms of fundamental construction of the waveguide device, the combination of the "second conductive member 120" and the "third conductive member 140" in the second waveguide device 100*b* corresponds to the combination in the first waveguide device 100*a* of the "first conductive member 110" and the "second conductive member 120".

What is characteristic in the array antenna shown in the figures is that each conductive rod 124L has a shape as shown in FIGS. 8A and 8B. As a result, the degree of impedance matching is improved at the branching portions and the bends of the waveguide members 122L.

Note that the shape of the conductive rods 124L is not limited to the example shown in FIGS. 8A and 8B. As mentioned earlier, the shapes, sizes, and array patterns of the conductive rods 124L may be various.

See FIGS. 21 and 22 again. The waveguide members 122U of the first waveguide device 100*a* couple to the waveguide member 122L of the second waveguide device 100*b*, through ports (openings) 145U that are provided in the second conductive member 120. Stated otherwise, an electromagnetic wave which has propagated through the waveguide member 122L of the second waveguide device 100*b* passes through a port 145U to reach a waveguide member 122U of the first waveguide device 100*a*, and propagates through the waveguide member 122U of the first waveguide device 100*a*. In this case, each slot 112 functions as an antenna element to allow an electromagnetic wave which has propagated through the waveguide to be emitted into space. Conversely, when an electromagnetic wave which has propagated in space impinges on a slot 112, the electromagnetic wave couples to the waveguide member 122U of the first waveguide device 100*a* that lies directly under that slot 112, and propagates through the waveguide member 122U of the first waveguide device 100*a*. An electromagnetic wave which has propagated through a waveguide member 122U of the first waveguide device 100*a* may also pass through a port 145U to reach the waveguide member 122L of the second waveguide device 100*b*, and propagates through the waveguide member 122L of the second waveguide device 100*b*. Via a port 145L of the third conductive member 140, the waveguide member 122L of the second waveguide device 100*b* may couple to an external waveguide device or radio frequency circuit (electronic circuit). As one example, FIG. 22 illustrates an electronic circuit 200 which is connected to the port 145L. Without being limited to a specific position, the electronic circuit 200 may be provided at any arbitrary position. The electronic circuit 200 may be provided on a circuit board which is on the rear surface side (i.e., the lower side in FIG. 20B) of the third conductive member 140, for example. Such an electronic circuit may be an MMIC (Monolithic Microwave Integrated Circuit) that generates millimeter waves, for example.

The first conductive member 110 shown in FIG. 20A may be called an "emission layer". Moreover, the entirety of the second conductive member 120, the waveguide members 122U, and the conductive rods 124U shown in FIG. 21 may be called an "excitation layer", whereas the entirety of the third conductive member 140, the waveguide member 122L, and the conductive rods 124L shown in FIG. 22 may be called a "distribution layer". Moreover, the "excitation layer" and the "distribution layer" may be collectively called a "feeding layer". Each of the "emission layer", the "excitation layer", and the "distribution layer" can be mass-produced by processing a single metal plate.

In the array antenna of this example, as can be seen from FIG. 20B, an emission layer, an excitation layer, and a distribution layer are layered, which are in plate form; therefore, a flat and low-profile flat panel antenna is realized as a whole. For example, the height (thickness) of a multilayer structure having a cross-sectional construction as shown in FIG. 20B can be set to 10 mm or less.

With the waveguide member 122L shown in FIG. 22, the distances from the port 145L of the third conductive member 140 to the respective ports 145U (see FIG. 21) of the second conductive member 120 measured along the waveguide member 122L are all set to an identical value. Therefore, a signal wave which is input to the waveguide member 122L reaches the four ports 145U of the second conductive member 120 all in the same phase, from the port 145L of the third conductive member 140. As a result, the four waveguide members 122U on the second conductive member 120 can be excited in the same phase.

It is not necessary for all slots 112 functioning as antenna elements to emit electromagnetic waves in the same phase. The network patterns of the waveguide members 122U and 122L in the excitation layer and the distribution layer may be arbitrary, and they may be arranged so that the respective waveguide members 122U and 122L independently propagate different signals.

Although the waveguide members 122U of the first waveguide device 100*a* in this example include neither a branching portion nor a bend, the waveguide device functioning as an excitation layer may also include a waveguide member having at least one of a branching portion and a bend. As mentioned earlier, it is not necessary for all conductive rods in the waveguide device to be similar in shape.

<Other Variants>

Next, variants of the waveguide member 122, the conductive members 110 and 120, and the conductive rods 124 will be described.

Figure 23A:
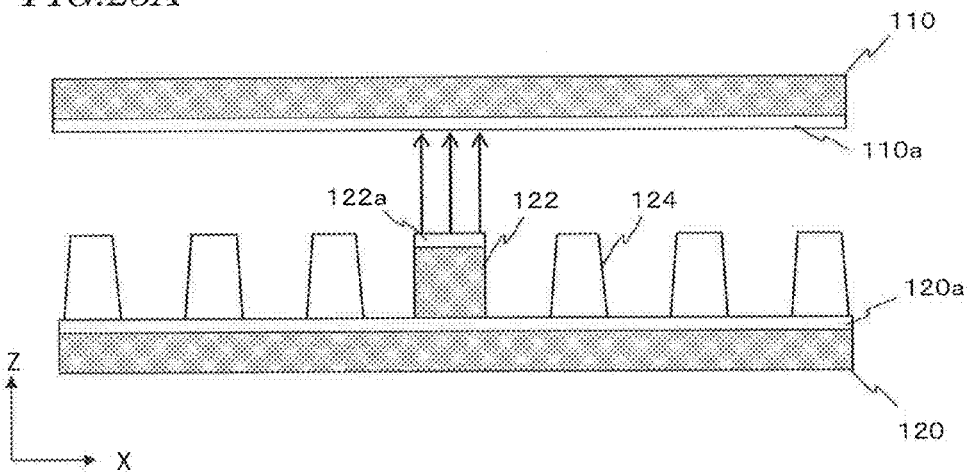
FIG. 23A is a cross-sectional view showing an exemplary structure where only a waveguide face 122*a*, defining an upper face of the waveguide member 122, is electrically conductive, while any portion of the waveguide member 122 other than the waveguide face 122*a* is not electrically conductive.

FIG. 23A is a cross-sectional view showing an exemplary structure where only a waveguide face 122*a*, defining an upper face of the waveguide member 122, is electrically conductive, while any portion of the waveguide member 122 other than the waveguide face 122*a* is not electrically conductive. Similarly, the first conductive member 110 and the second conductive member 120 are electrically conductive only at their surface (conductive surface 110*a*, 120*a*) that carries or faces the waveguide member 122, but not in any other portion. Thus, each of the waveguide member 122, the first conductive member 110, and the second conductive member 120 does not need to be entirely electrically conductive.

Figure 23B:
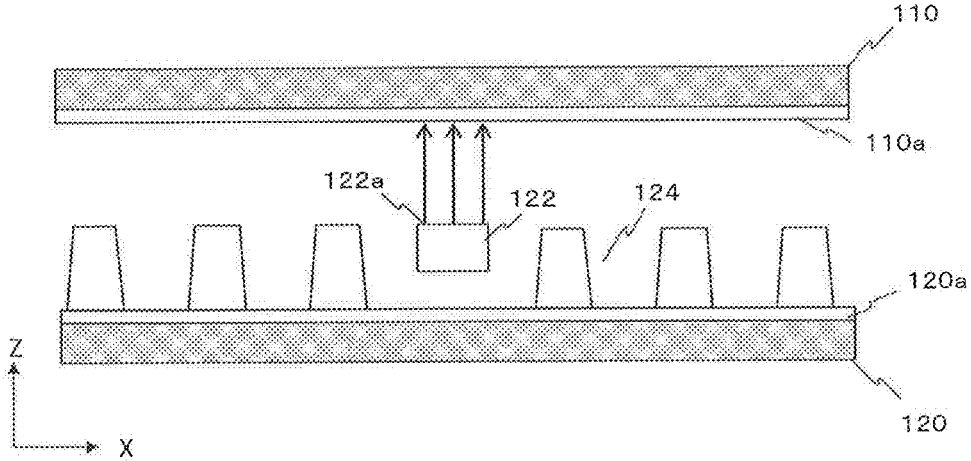
FIG. 23B is a diagram showing a variant in which the waveguide member 122 is not formed on the second conductive member 120.

FIG. 23B is a diagram showing a variant in which the waveguide member 122 is not formed on the second conductive member 120. In this example, the waveguide member 122 is fixed to a supporting member (e.g., a wall in the outer periphery of the housing) that supports the first conductive member 110 and the second conductive member 120. A gap exists between the waveguide member 122 and the second conductive member 120. Thus, the waveguide member 122 does not need to be connected to the second conductive member 120.

Figure 23C:
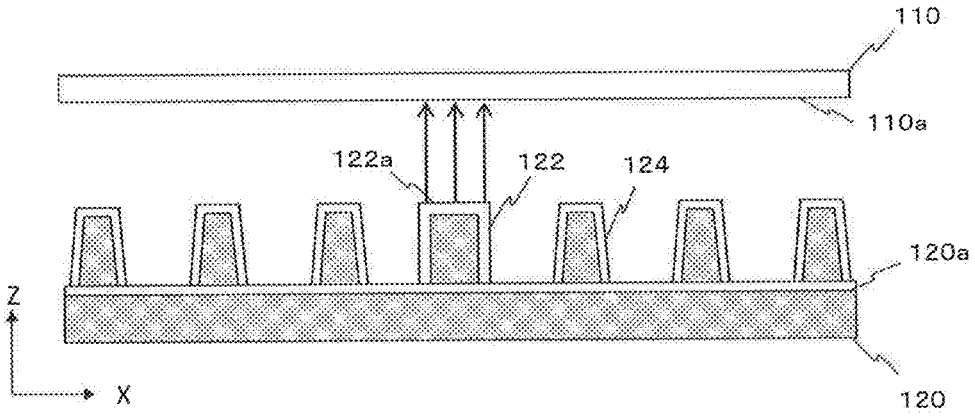
FIG. 23C is a diagram showing an exemplary structure where the second conductive member 120, the waveguide member 122, and each of the plurality of conductive rods 124 are composed of a dielectric surface that is coated with an electrically conductive material such as a metal.

FIG. 23C is a diagram showing an exemplary structure where the second conductive member 120, the waveguide member 122, and each of the plurality of conductive rods 124 are composed of a dielectric surface that is coated with an electrically conductive material such as a metal. The second conductive member 120, the waveguide member 122, and the plurality of conductive rods 124 are connected to one another via a conductor. On the other hand, the first conductive member 110 is composed of an electrically conductive material such as a metal.

Figure 23D:
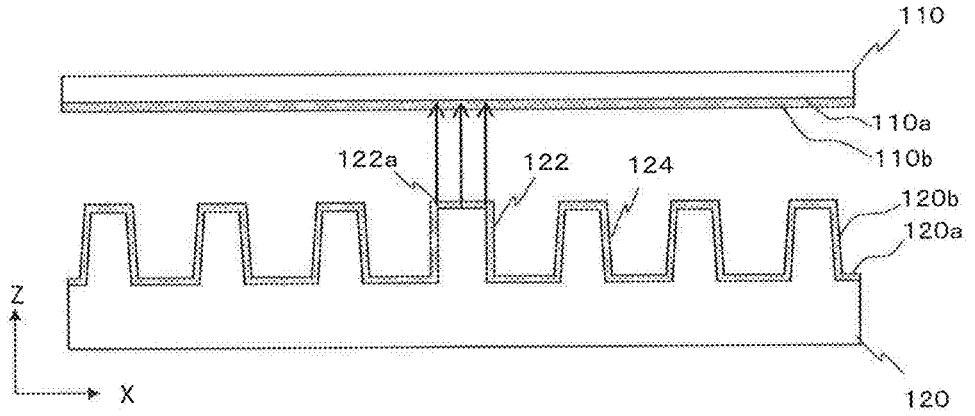
FIG. 23D is a diagram showing an exemplary structure in which dielectric layers 110*b* and 120*b* are respectively provided on the outermost surfaces of conductive members 110 and 120, a waveguide member 122, and conductive rods 124.
Figure 23E:
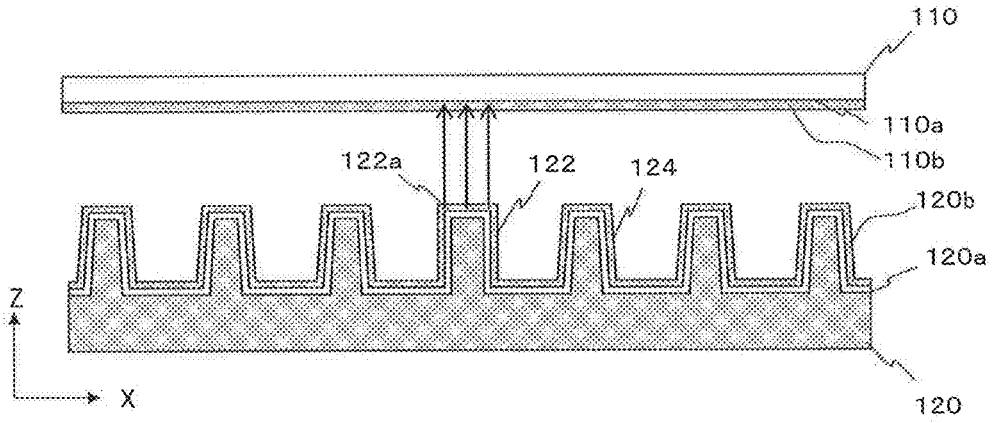
FIG. 23E is a diagram showing another exemplary structure in which dielectric layers 110*b* and 120*b* are respectively provided on the outermost surfaces of conductive members 110 and 120, a waveguide member 122, and conductive rods 124.

FIGS. 23D and 23E are diagrams showing example structures in which dielectric layers 110*b* and 120*b* are respectively provided on the outermost surfaces of conductive members 110 and 120, a waveguide member 122, and conductive rods 124. FIG. 23D shows an example structure where the surface of metal conductive members, which are conductors, are covered with a dielectric layer. FIG. 23E shows an example where the conductive member 120 is structured so that the surface of members which are composed of a dielectric, e.g., resin, is covered with a conductor such as a metal, this metal layer being further covered with a dielectric layer. The dielectric layer that covers the metal surface may be a coating of resin or the like, or an oxide film of passivation coating or the like which is generated as the metal becomes oxidized.

The dielectric layer on the outermost surface will allow losses to be increased in the electromagnetic wave propagating through the WRG waveguide, but is able to protect the conductive surfaces 110*a* and 120*a* (which are electrically conductive) from corrosion. Moreover, even if a conductor line to carry a DC voltage, or an AC voltage of such a low frequency that it is not capable of propagation on certain WRG waveguides, may exist in places that may come in contact with the conductive rods 124, short-circuiting can be prevented.

Figure 23F:
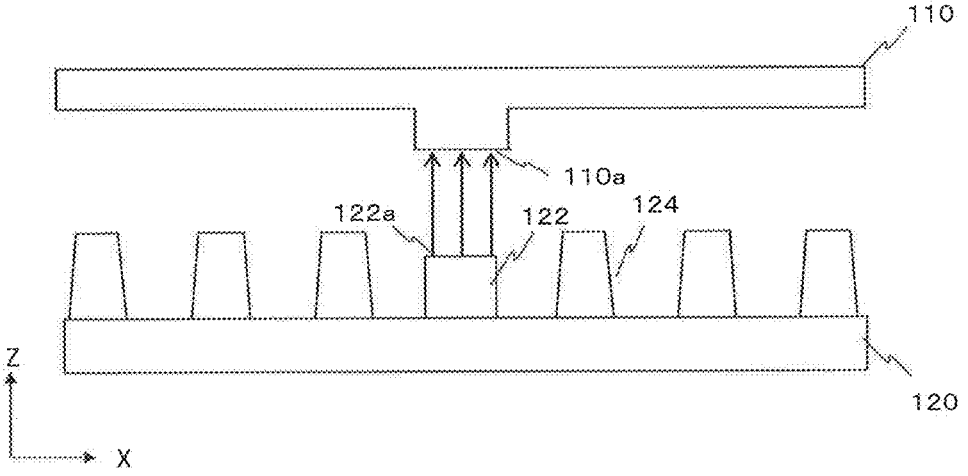
FIG. 23F is a diagram showing an example where the height of the waveguide member 122 is lower than the height of the conductive rods 124 and a conductive surface 110*a* of the first conductive member 110 protrudes toward the waveguide member 122.

FIG. 23F is a diagram showing an example where the height of the waveguide member 122 is lower than the height of the conductive rods 124 and the conductive surface 110*a* of the first conductive member 110 protrudes toward the waveguide member 122. Even such a structure will operate in a similar manner to the above-described embodiment, so long as the ranges of dimensions depicted in FIG. 4 are satisfied.

Figure 24A:
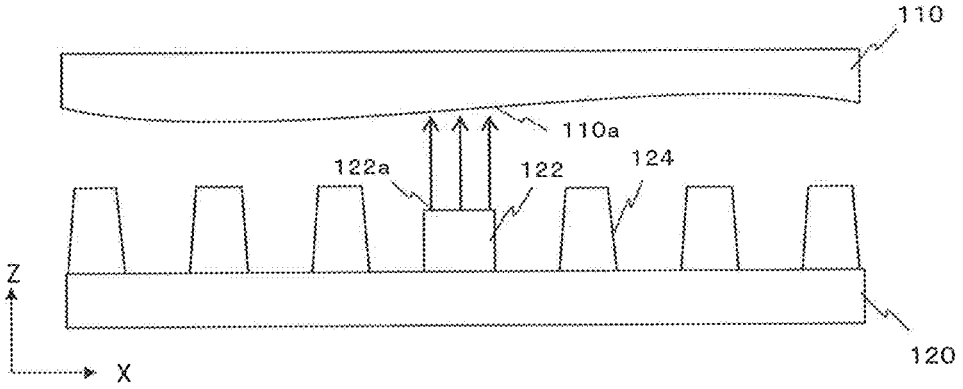
FIG. 24A is a diagram showing an example where a conductive surface 110*a* of the first conductive member 110 is shaped as a curved surface.
Figure 24B:
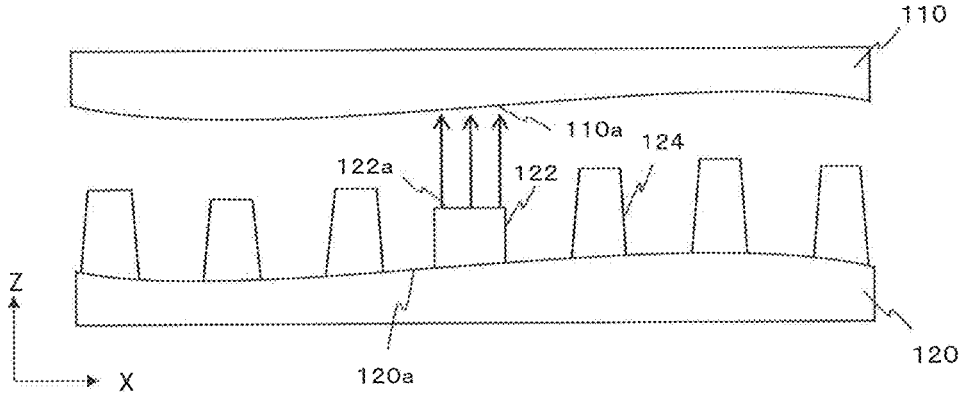
FIG. 24B is a diagram showing an example where also a conductive surface 120*a* of the second conductive member 120 is shaped as a curved surface.

FIG. 24A is a diagram showing an example where the conductive surface 110*a* of the first conductive member 110 is shaped as a curved surface. FIG. 24B is a diagram showing an example where also a conductive surface 120*a* of the second conductive member 120 is shaped as a curved surface. As demonstrated by these examples, the conductive surface(s) 110*a*, 120*a* may not be shaped as a plane(s), but may shaped as a curved surface(s).

Application Example: Onboard Radar System

Next, as an Application Example of utilizing the above-described array antenna, an instance of an onboard radar system including an array antenna will be described. A transmission wave used in an onboard radar system may have a frequency of e.g. 76 gigahertz (GHz) band, which will have a wavelength $\lambda o$ of about 4 mm in free space.

In safety technology of automobiles, e.g., collision avoidance systems or automated driving, it is particularly essential to identify one or more vehicles (targets) that are traveling ahead of the driver's vehicle. As a method of identifying vehicles, techniques of estimating the directions of arriving waves by using a radar system have been under development.

Figure 25:
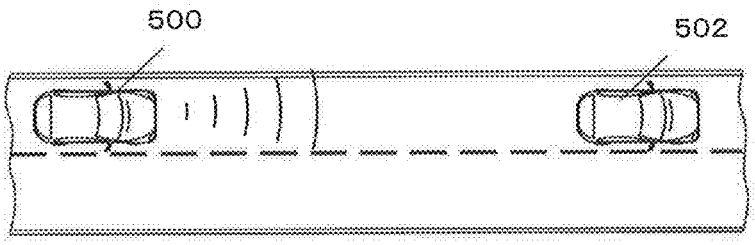
FIG. 25 is a diagram showing a driver's vehicle 500, and a preceding vehicle 502 that is traveling in the same lane as the driver's vehicle 500.

FIG. 25 shows a driver's vehicle 500, and a preceding vehicle 502 that is traveling in the same lane as the driver's vehicle 500. The driver's vehicle 500 includes an onboard radar system which incorporates an array antenna according to the above-described embodiment. When the onboard radar system of the driver's vehicle 500 emits a radio frequency transmission signal, the transmission signal reaches the preceding vehicle 502 and is reflected therefrom, so that a part of the signal returns to the driver's vehicle 500. The onboard radar system receives this signal to calculate a position of the preceding vehicle 502, a distance ("range") to the preceding vehicle 502, velocity, etc.

Figure 26:
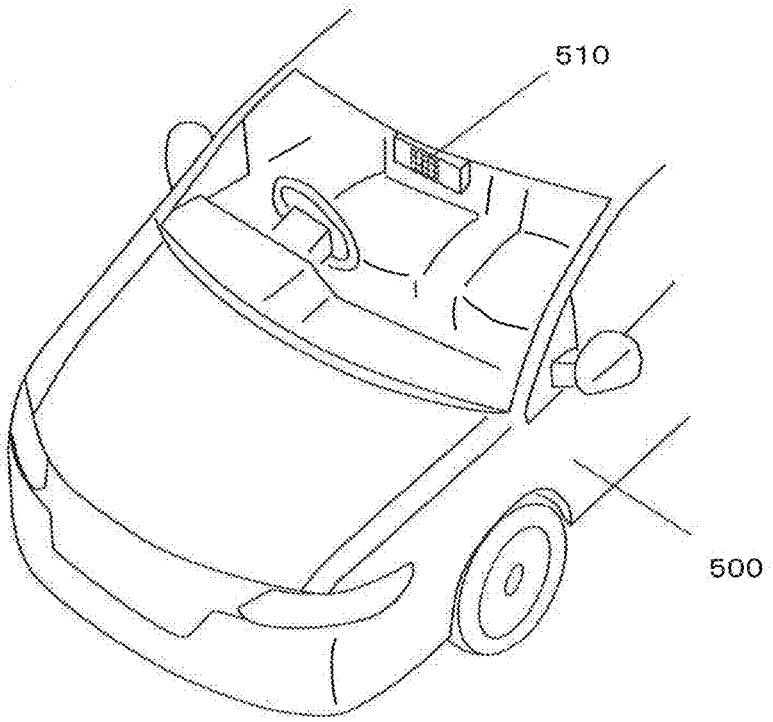
FIG. 26 is a diagram showing an onboard radar system 510 of the driver's vehicle 500.

FIG. 26 shows the onboard radar system 510 of the driver's vehicle 500. The onboard radar system 510 is provided within the vehicle. More specifically, the onboard radar system 510 is disposed on a face of the rearview mirror that is opposite to its specular surface. From within the vehicle, the onboard radar system 510 emits a radio frequency transmission signal in the direction of travel of the vehicle 500, and receives a signal(s) which arrives from the direction of travel.

The onboard radar system 510 of this Application Example includes an array antenna according to the above embodiment. In the Application Example, it is arranged so that the direction that each of the plurality of waveguide members extends coincides with the vertical direction, and that the direction in which the plurality of waveguide members are arrayed coincides with the horizontal direction. As a result, the lateral dimension of the plurality of slots as viewed from the front can be reduced. Exemplary dimensions of an antenna device including the above array antenna may be 60 mm (wide)×30 mm (long)×10 mm (deep). It will be appreciated that this is a very small size for a millimeter wave radar system of the 76 GHz band.

Note that many a conventional onboard radar system is provided outside the vehicle, e.g., at the tip of the front nose. The reason is that the onboard radar system is relatively large in size, and thus is difficult to be provided within the vehicle as in the present disclosure. Note that the onboard radar system 510 of this Application Example may be mounted at the tip of the front nose. Since the footprint of the onboard radar system on the front nose is reduced, other parts can be more easily placed.

The Application Example allows the interval between a plurality of waveguide members (ridges) that are used in the transmission antenna to be narrow, which also narrows the interval between a plurality of slots to be provided opposite from a number of adjacent waveguide members. This reduces the influences of grating lobes. For example, when the interval between the centers of two laterally adjacent slots is less than the wavelength λo of the transmission wave (i.e., less than about 4 mm), no grating lobes will occur frontward. As a result, influences of grating lobes are reduced. Note that grating lobes will occur when the interval at which the antenna elements are arrayed is greater than a half of the wavelength of an electromagnetic wave. If the interval at which the antenna elements are arrayed is less than the wavelength, no grating lobes will occur frontward. Therefore, in the case where each antenna element composing an array antenna is only frontward-sensitive, as in the Application Example, grating lobes will exert substantially no influences so long as the interval at which the antenna elements are arrayed is smaller than the wavelength. By adjusting the array factor of the transmission antenna, the directivity of the transmission antenna can be adjusted. A phase shifter may be provided so as to be able to individually adjust the phases of electromagnetic waves that are transmitted on plural waveguide members. By providing a phase shifter, the directivity of the transmission antenna can be changed in any desired direction. Since the construction of a phase shifter is well-known, description thereof will be omitted.

A reception antenna according to the Application Example is able to reduce unwanted reception of reflected waves associated with grating lobes, thereby being able to improve the precision of the below-described processing. Hereinafter, an example of a reception process will be described.

Figure 27A:
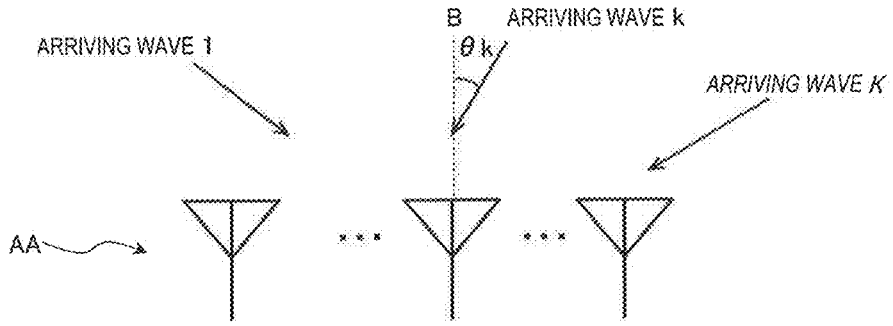
FIG. 27A is a diagram showing a relationship between an array antenna AA of the onboard radar system 510 and plural arriving waves k.

FIG. 27A shows a relationship between an array antenna AA of the onboard radar system 510 and plural arriving waves k (k: an integer from 1 to K; the same will always apply below. K is the number of targets that are present in different azimuths). The array antenna AA includes M antenna elements in a linear array. Principlewise, an antenna can be used for both transmission and reception, and therefore the array antenna AA can be used for both a transmission antenna and a reception antenna. Hereinafter, an example method of processing an arriving wave which is received by the reception antenna will be described.

The array antenna AA receives plural arriving waves that simultaneously impinge at various angles. Some of the plural arriving waves may be arriving waves which have been emitted from the transmission antenna of the same onboard radar system 510 and reflected by a target(s). Furthermore, some of the plural arriving waves may be direct or indirect arriving waves that have been emitted from other vehicles.

The incident angle of each arriving wave (i.e., an angle representing its direction of arrival) is an angle with respect to the broadside B of the array antenna AA. The incident angle of an arriving wave represents an angle with respect to a direction which is perpendicular to the direction of the line along which antenna elements are arrayed.

Now, consider a $k^{th}$ arriving wave. Where K arriving waves are impinging on the array antenna from K targets existing at different azimuths, a "$k^{th}$ arriving wave" means an arriving wave which is identified by an incident angle $\theta_k$.

Figure 27B:
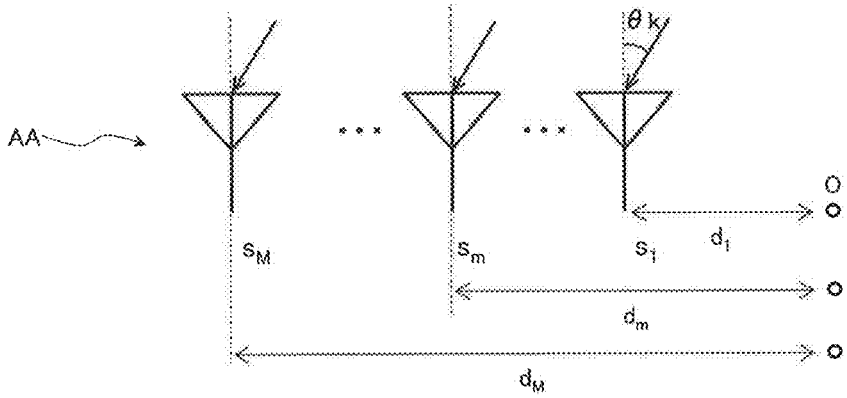
FIG. 27B is a diagram showing the array antenna AA receiving the $k^{th}$ arriving wave.

FIG. 27B shows the array antenna AA receiving the $k^{th}$ arriving wave. The signals received by the array antenna AA can be expressed as a "vector" having M elements, by eq. 1.

$$S=[s_1,s_2,\ldots,s_M]^T \quad \text{(eq. 1)}$$

In the above, $s_m$ (where m is an integer from 1 to M; the same will also be true hereinbelow) is the value of a signal which is received by an $m^{th}$ antenna element. The superscript $^T$ means transposition. S is a column vector. The column vector S is defined by a product of multiplication between a direction vector (referred to as a steering vector or a mode vector) as determined by the construction of the array antenna and a complex vector representing a signal from each target (also referred to as a wave source or a signal source). When the number of wave sources is K, the waves of signals arriving at each individual antenna element from the respective K wave sources are linearly superposed. In this state, $s_m$ can be expressed by eq. 2.

$$s_m = \sum_{k=1}^{K} a_k \exp\left\{ j\left( \frac{2\pi}{\lambda} d_m \sin\theta_k + \varphi_k \right) \right\} \quad \text{[eq. 2]}$$

In eq. 2, $a_k$, $\theta_k$ and $\phi_k$ respectively denote the amplitude, incident angle, and initial phase of the $k^{th}$ arriving wave. Moreover, λ denotes the wavelength of an arriving wave, and j is an imaginary unit.

As will be understood from eq. 2, $s_m$ is expressed as a complex number consisting of a real part (Re) and an imaginary part (Im).

When this is further generalized by taking noise (internal noise or thermal noise) into consideration, the array reception signal X can be expressed as eq. 3.

$$X=S+N \quad \text{(eq. 3)}$$

N is a vector expression of noise.

The signal processing circuit generates a spatial covariance matrix Rxx (eq. 4) of arriving waves by using the array reception signal X expressed by eq. 3, and further determines eigenvalues of the spatial covariance matrix Rxx.

$$R_{xx} = XX^H \quad \text{[eq. 4]}$$

$$= \begin{bmatrix} Rxx_{11} & \dots & Rxx_{1M} \\ \vdots & \ddots & \vdots \\ Rxx_{M1} & \dots & Rxx_{MM} \end{bmatrix}$$

In the above, the superscript $^H$ means complex conjugate transposition (Hermitian conjugate).

Among the eigenvalues, the number of eigenvalues which have values equal to or greater than a predetermined value that is defined based on thermal noise (signal space eigenvalues) corresponds to the number of arriving waves. Then, angles that produce the highest likelihood as to the directions of arrival of reflected waves (i.e. maximum likelihood) are calculated, whereby the number of targets and the angles at which the respective targets are present can be identified. This process is known as a maximum likelihood estimation technique.

Figure 28:
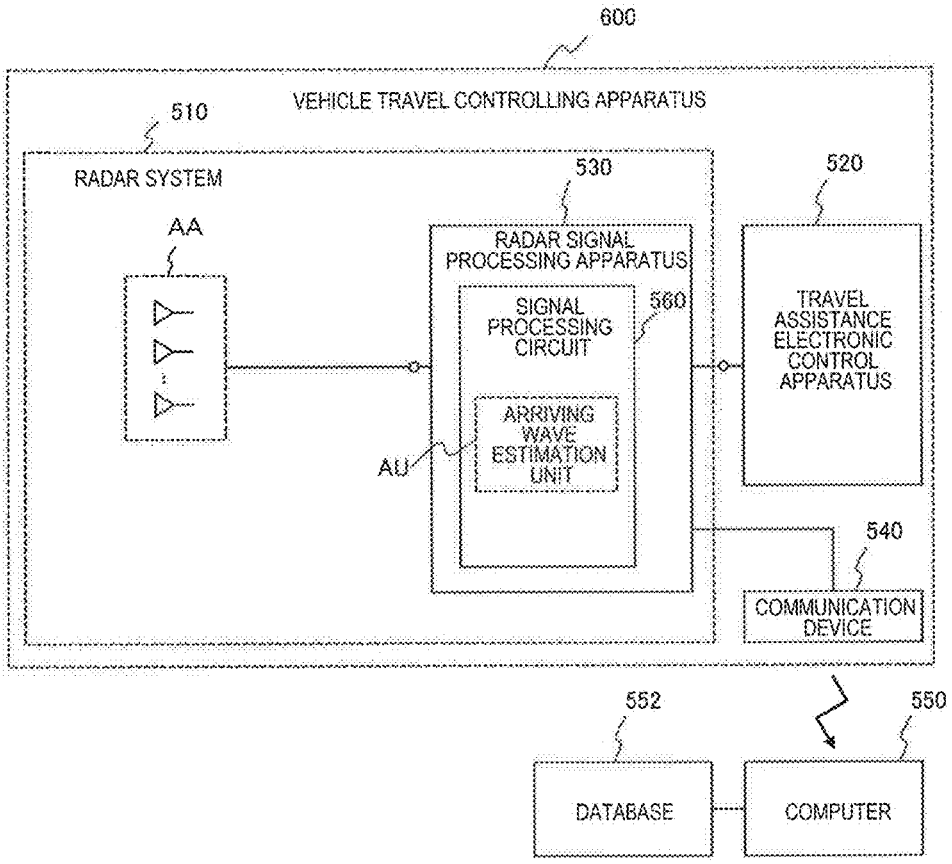
FIG. 28 is a block diagram showing an exemplary fundamental construction of a vehicle travel controlling apparatus 600 according to the present disclosure.

Next, see FIG. 28. FIG. 28 is a block diagram showing an exemplary fundamental construction of a vehicle travel controlling apparatus 600 according to the present disclosure. The vehicle travel controlling apparatus 600 shown in FIG. 28 includes a radar system 510 which is mounted in a vehicle, and a travel assistance electronic control apparatus 520 which is connected to the radar system 510. The radar system 510 includes an array antenna AA and a radar signal processing apparatus 530.

The array antenna AA includes a plurality of antenna elements, each of which outputs a reception signal in response to one or plural arriving waves. As mentioned earlier, the array antenna AA is capable of emitting a millimeter wave of a high frequency.

In the radar system 510, the array antenna AA needs to be attached to the vehicle, while at least some of the functions of the radar signal processing apparatus 530 may be implemented by a computer 550 and a database 552 which are provided externally to the vehicle travel controlling apparatus 600 (e.g., outside of the driver's vehicle). In that case, the portions of the radar signal processing apparatus 530 that are located within the vehicle may be perpetually or occasionally connected to the computer 550 and database 552 external to the vehicle so that bidirectional communications of signal or data are possible. The communications are to be performed via a communication device 540 of the vehicle and a commonly-available communications network.

The database 552 may store a program which defines various signal processing algorithms. The content of the data and program needed for the operation of the radar system 510 may be externally updated via the communication device 540. Thus, at least some of the functions of the radar system 510 can be realized externally to the driver's vehicle (which is inclusive of the interior of another vehicle), by a cloud computing technique. Therefore, an "onboard" radar system in the meaning of the present disclosure does not require that all of its constituent elements be mounted within the (driver's) vehicle. However, for simplicity, the present application will describe an implementation in which all constituent elements according to the present disclosure are mounted in a single vehicle (i.e., the driver's vehicle), unless otherwise specified.

The radar signal processing apparatus 530 includes a signal processing circuit 560. The signal processing circuit 560 directly or indirectly receives reception signals from the array antenna AA, and inputs the reception signals, or a secondary signal(s) which has been generated from the reception signals, to an arriving wave estimation unit AU. A part or a whole of the circuit (not shown) which generates a secondary signal(s) from the reception signals does not need to be provided inside of the signal processing circuit 560. A part or a whole of such a circuit (preprocessing circuit) may be provided between the array antenna AA and the radar signal processing apparatus 530.

The signal processing circuit 560 is configured to perform computation by using the reception signals or secondary signal(s), and output a signal indicating the number of arriving waves. As used herein, a "signal indicating the number of arriving waves" can be said to be a signal indicating the number of preceding vehicles (which may be one preceding vehicle or plural preceding vehicles) ahead of the driver's vehicle.

The signal processing circuit 560 may be configured to execute various signal processing which is executable by known radar signal processing apparatuses. For example, the signal processing circuit 560 may be configured to execute "super-resolution algorithms" such as the MUSIC method, the ESPRIT method, or the SAGE method, or other algorithms for direction-of-arrival estimation of relatively low resolution.

The arriving wave estimation unit AU shown in FIG. 28 estimates an angle representing the azimuth of each arriving wave by an arbitrary algorithm for direction-of-arrival estimation, and outputs a signal indicating the estimation result. The signal processing circuit 560 estimates the distance to each target as a wave source of an arriving wave, the relative velocity of the target, and the azimuth of the target by using a known algorithm which is executed by the arriving wave estimation unit AU, and output a signal indicating the estimation result.

In the present disclosure, the term "signal processing circuit" is not limited to a single circuit, but encompasses any implementation in which a combination of plural circuits is conceptually regarded as a single functional part. The signal processing circuit 560 may be realized by one or more System-on-Chips (SoCs). For example, a part or a whole of the signal processing circuit 560 may be an FPGA (Field-Programmable Gate Array), which is a programmable logic device (PLD). In that case, the signal processing circuit 560 includes a plurality of computation elements (e.g., general-purpose logics and multipliers) and a plurality of memory elements (e.g., look-up tables or memory blocks). Alternatively, the signal processing circuit 560 may be a set of a general-purpose processor(s) and a main memory device(s). The signal processing circuit 560 may be a circuit which includes a processor core(s) and a memory device(s). These may function as the signal processing circuit 560.

The travel assistance electronic control apparatus 520 is configured to provide travel assistance for the vehicle based on various signals which are output from the radar signal processing apparatus 530. The travel assistance electronic control apparatus 520 instructs various electronic control units to fulfill predetermined functions, e.g., a function of issuing an alarm to prompt the driver to make a braking operation when the distance to a preceding vehicle (vehicular gap) has become shorter than a predefined value; a function of controlling the brakes; and a function of controlling the accelerator. For example, in the case of an operation mode which performs adaptive cruise control of the driver's vehicle, the travel assistance electronic control apparatus 520 sends predetermined signals to various electronic control units (not shown) and actuators, to maintain the distance of the driver's vehicle to a preceding vehicle at a predefined value, or maintain the traveling velocity of the driver's vehicle at a predefined value.

In the case of the MUSIC method, the signal processing circuit 560 determines eigenvalues of the spatial covariance matrix, and, as a signal indicating the number of arriving waves, outputs a signal indicating the number of those eigenvalues ("signal space eigenvalues") which are greater than a predetermined value (thermal noise power) that is defined based on thermal noise.

Figure 29:
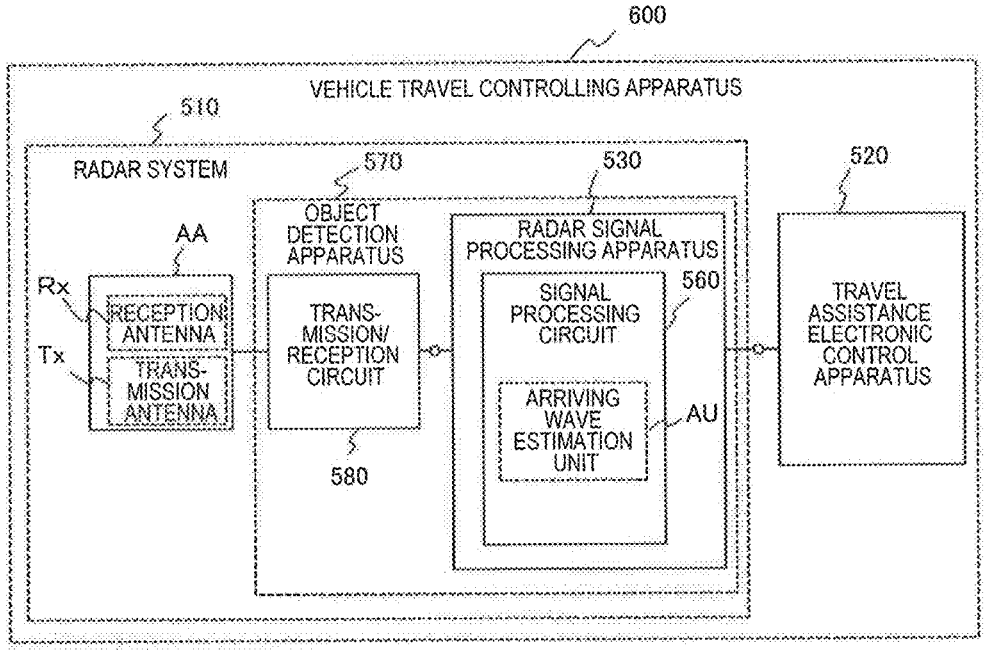
FIG. 29 is a block diagram showing another exemplary construction for the vehicle travel controlling apparatus 600.

Next, see FIG. 29. FIG. 29 is a block diagram showing another exemplary construction for the vehicle travel controlling apparatus 600. The radar system 510 in the vehicle travel controlling apparatus 600 of FIG. 29 includes an array antenna AA, which includes an array antenna that is dedicated to reception only (also referred to as a reception antenna) Rx and an array antenna that is dedicated to transmission only (also referred to as a transmission antenna) Tx; and an object detection apparatus 570.

At least one of the transmission antenna Tx and the reception antenna Rx has the aforementioned waveguide structure. The transmission antenna Tx emits a transmission wave, which may be a millimeter wave, for example. The reception antenna Rx that is dedicated to reception only outputs a reception signal in response to one or plural arriving waves (e.g., a millimeter wave(s)).

A transmission/reception circuit 580 sends a transmission signal for a transmission wave to the transmission antenna Tx, and performs "preprocessing" for reception signals of reception waves received at the reception antenna Rx. A part or a whole of the preprocessing may be performed by the signal processing circuit 560 in the radar signal processing apparatus 530. A typical example of preprocessing to be performed by the transmission/reception circuit 580 may be generating a beat signal from a reception signal, and converting a reception signal of analog format into a reception signal of digital format.

Note that the radar system according to the present disclosure may, without being limited to the implementation where it is mounted in the driver's vehicle, be used while being fixed on the road or a building.

Next, an example of a more specific construction of the vehicle travel controlling apparatus 600 will be described.

Figure 30:
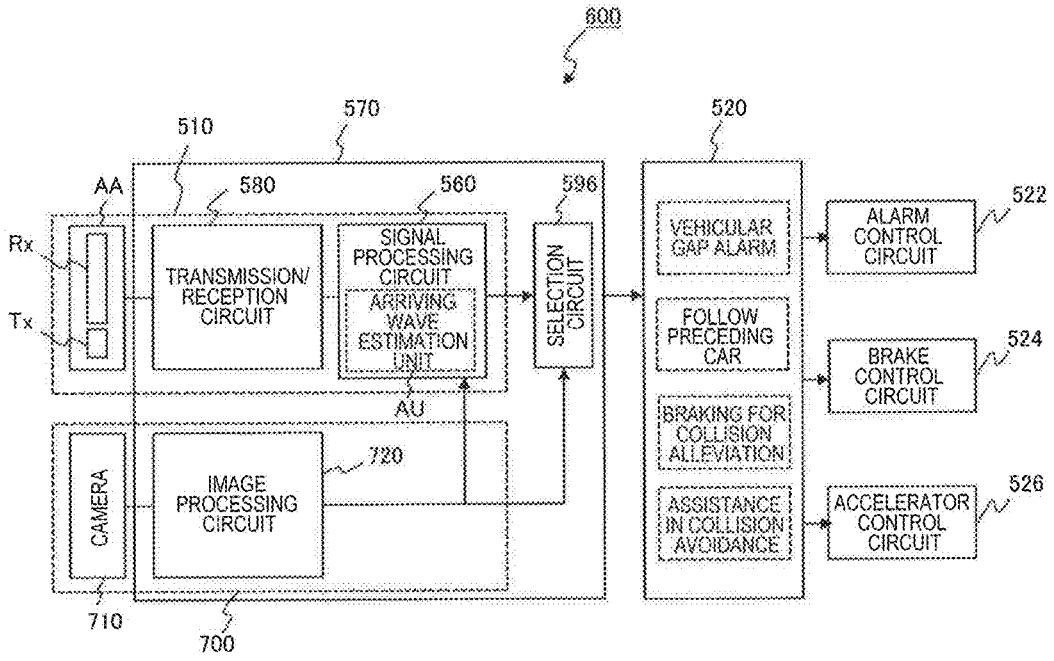
FIG. 30 is a block diagram showing an example of a more specific construction of the vehicle travel controlling apparatus 600.

FIG. 30 is a block diagram showing an example of a more specific construction of the vehicle travel controlling apparatus 600. The vehicle travel controlling apparatus 600 shown in FIG. 30 includes a radar system 510 and an onboard camera system 700. The radar system 510 includes an array antenna AA, a transmission/reception circuit 580 which is connected to the array antenna AA, and a signal processing circuit 560.

The onboard camera system 700 includes an onboard camera 710 which is mounted in a vehicle, and an image processing circuit 720 which processes an image or video that is acquired by the onboard camera 710.

The vehicle travel controlling apparatus 600 of this Application Example includes an object detection apparatus 570 which is connected to the array antenna AA and the onboard camera 710, and a travel assistance electronic control apparatus 520 which is connected to the object detection apparatus 570. The object detection apparatus 570 includes a transmission/reception circuit 580 and an image processing circuit 720, in addition to the above-described radar signal processing apparatus 530 (including the signal processing circuit 560). The object detection apparatus 570 detects a target on the road or near the road, by using not only the information is obtained by the radar system 510 but also the information which is obtained by the image processing circuit 720. For example, while the driver's vehicle is traveling in one of two or more lanes of the same direction, the image processing circuit 720 can distinguish which lane the driver's vehicle is traveling in, and supply that result of distinction to the signal processing circuit 560. When the number and azimuth(s) of preceding vehicles are to be recognized by using a predetermined algorithm for direction-of-arrival estimation (e.g., the MUSIC method), the signal processing circuit 560 is able to provide more reliable information concerning a spatial distribution of preceding vehicles by referring to the information from the image processing circuit 720.

Note that the onboard camera system 700 is an example of a means for identifying which lane the driver's vehicle is traveling in. The lane position of the driver's vehicle may be identified by any other means. For example, by utilizing an ultra-wide band (UWB) technique, it is possible to identify which one of a plurality of lanes the driver's vehicle is traveling in. It is widely known that the ultra-wide band technique is applicable to position measurement and/or radar. Using the ultra-wide band technique enhances the range resolution of the radar, so that, even when a large number of vehicles exist ahead, each individual target can be detected with distinction, based on differences in distance. This makes it possible to identify distance from a guardrail on the road shoulder, or from the median strip, with good precision. The width of each lane is predefined based on each country's law or the like. By using such information, it becomes possible to identify where the lane in which the driver's vehicle is currently traveling is. Note that the ultra-wide band technique is an example. A radio wave based on any other wireless technique may be used. Moreover, a LIDAR (Light Detection and Ranging) may be used together with a radar. LIDAR is sometimes called "laser radar".

The array antenna AA may be a generic millimeter wave array antenna for onboard use. The transmission antenna Tx in this Application Example emits a millimeter wave as a transmission wave ahead of the vehicle. A portion of the transmission wave is reflected off a target which is typically a preceding vehicle, whereby a reflected wave occurs from the target being a wave source. A portion of the reflected wave reaches the array antenna (reception antenna) AA as an arriving wave. Each of the plurality of antenna elements of the array antenna AA outputs a reception signal in response to one or plural arriving waves. In the case where the number of targets functioning as wave sources of reflected waves is K (where K is an integer of one or more), the number of arriving waves is K, but this number K of arriving waves is not known beforehand.

The example of FIG. 28 assumes that the radar system 510 is provided as an integral piece, including the array antenna AA, on the rearview mirror. However, the number and positions of array antennas AA are not limited to any specific number or specific positions. An array antenna AA may be disposed on the rear surface of the vehicle so as to be able to detect targets that are behind the vehicle. Moreover, a plurality of array antennas AA may be disposed on the front surface and the rear surface of the vehicle. The array antenna(s) AA may be disposed inside the vehicle. Even in the case where a horn antenna whose respective antenna elements include horns as mentioned above is to be adopted as the array antenna(s) AA, the array antenna(s) with such antenna elements may be situated inside the vehicle.

The signal processing circuit 560 receives and processes the reception signals which have been received by the reception antenna Rx and subjected to preprocessing by the transmission/reception circuit 580. This process encompasses inputting the reception signals to the arriving wave estimation unit AU, or alternatively, generating a secondary signal(s) from the reception signals and inputting the secondary signal(s) to the arriving wave estimation unit AU.

In the example of FIG. 30, a selection circuit 596 which receives the signal being output from the signal processing circuit 560 and the signal being output from the image processing circuit 720 is provided in the object detection apparatus 570. The selection circuit 596 allows one or both of the signal being output from the signal processing circuit 560 and the signal being output from the image processing circuit 720 to be fed to the travel assistance electronic control apparatus 520.

Figure 31:
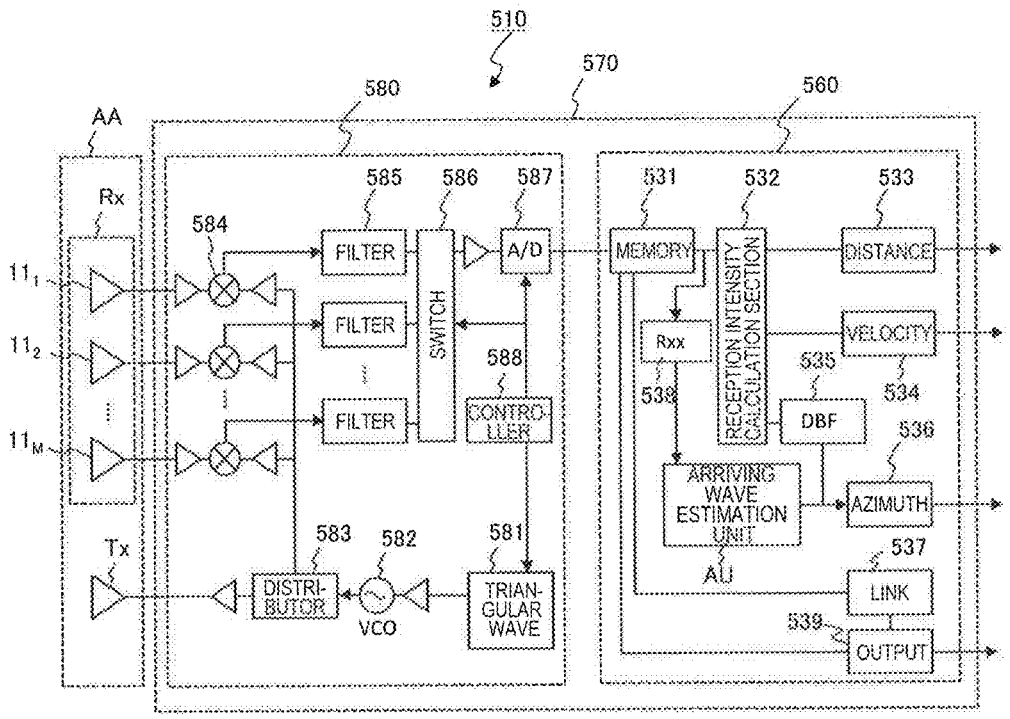
FIG. 31 is a block diagram showing a more detailed exemplary construction of the radar system 510 according to this Application Example.

FIG. 31 is a block diagram showing a more detailed exemplary construction of the radar system 510 according to this Application Example.

As shown in FIG. 31, the array antenna AA includes a transmission antenna Tx which transmits a millimeter wave and reception antennas Rx which receive arriving waves reflected from targets. Although only one transmission antenna Tx is illustrated in the figure, two or more kinds of transmission antennas with different characteristics may be provided. The array antenna AA includes M antenna elements $\mathbf{11}_1$, $\mathbf{11}_2$, . . . , $\mathbf{11}_M$ (where M is an integer of 3 or more). In response to the arriving waves, the plurality of antenna elements $\mathbf{11}_1$, $\mathbf{11}_2$, . . . , $\mathbf{11}_M$ respectively output reception signals $s_1$, $s_2$, . . . , $s_M$ (FIG. 27B).

In the array antenna AA, the antenna elements $\mathbf{11}_1$ to $\mathbf{11}_M$ are arranged in a linear array or a two-dimensional array at fixed intervals, for example. Each arriving wave will impinge on the array antenna AA from a direction at an angle θ with respect to the normal of the plane in which the antenna elements $\mathbf{11}_1$ to $\mathbf{11}_M$ are arrayed. Thus, the direction of arrival of an arriving wave is defined by this angle θ.

When an arriving wave from one target impinges on the array antenna AA, this approximates to a plane wave impinging on the antenna elements $\mathbf{11}_1$ to $\mathbf{11}_M$ from azimuths of the same angle θ. When K arriving waves impinge on the array antenna AA from K targets with different azimuths, the individual arriving waves can be identified in terms of respectively different angles $\theta_1$ to $\theta_K$.

As shown in FIG. 31, the object detection apparatus 570 includes the transmission/reception circuit 580 and the signal processing circuit 560.

The transmission/reception circuit 580 includes a triangular wave generation circuit 581, a VCO (voltage controlled oscillator) 582, a distributor 583, mixers 584, filters 585, a switch 586, an A/D converter 587, and a controller 588. Although the radar system in this Application Example is configured to perform transmission and reception of millimeter waves by the FMCW method, the radar system of the present disclosure is not limited to this method. The transmission/reception circuit 580 is configured to generate a beat signal based on a reception signal from the array antenna AA and a transmission signal from the transmission antenna Tx.

The signal processing circuit 560 includes a distance detection section 533, a velocity detection section 534, and an azimuth detection section 536. The signal processing circuit 560 is configured to process a signal from the A/D converter 587 in the transmission/reception circuit 580, and output signals respectively indicating the detected distance to the target, the relative velocity of the target, and the azimuth of the target.

First, the construction and operation of the transmission/reception circuit 580 will be described in detail.

Figure 32:
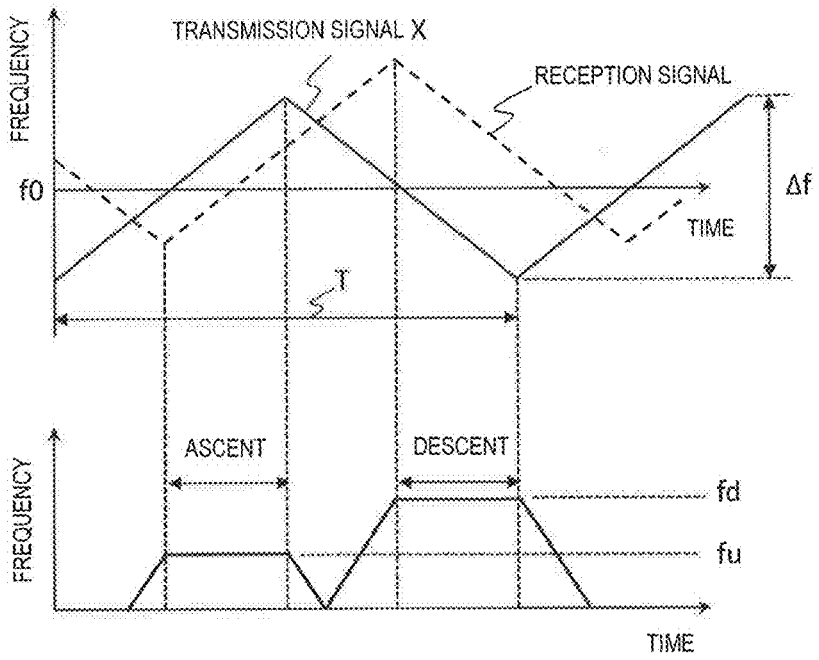
FIG. 32 is a diagram showing change in frequency of a transmission signal which is modulated based on the signal that is generated by a triangular wave generation circuit 581.

The triangular wave generation circuit 581 generates a triangular wave signal, and supplies it to the VCO 582. The VCO 582 outputs a transmission signal having a frequency as modulated based on the triangular wave signal. FIG. 32 is a diagram showing change in frequency of a transmission signal which is modulated based on the signal that is generated by the triangular wave generation circuit 581. This waveform has a modulation width Δf and a center frequency of f0. The transmission signal having a thus modulated frequency is supplied to the distributor 583. The distributor 583 allows the transmission signal obtained from the VCO 582 to be distributed among the mixers 584 and the transmission antenna Tx. Thus, the transmission antenna emits a millimeter wave having a frequency which is modulated in triangular waves, as shown in FIG. 32.

In addition to the transmission signal, FIG. 32 also shows an example of a reception signal from an arriving wave which is reflected from a single preceding vehicle. The reception signal is delayed from the transmission signal. This delay is in proportion to the distance between the driver's vehicle and the preceding vehicle. Moreover, the frequency of the reception signal increases or decreases in accordance with the relative velocity of the preceding vehicle, due to the Doppler effect.

When the reception signal and the transmission signal are mixed, a beat signal is generated based on their frequency difference. The frequency of this beat signal (beat frequency) differs between a period in which the transmission signal increases in frequency (ascent) and a period in which the transmission signal decreases in frequency (descent). Once a beat frequency for each period is determined, based on such beat frequencies, the distance to the target and the relative velocity of the target are calculated.

Figure 33:
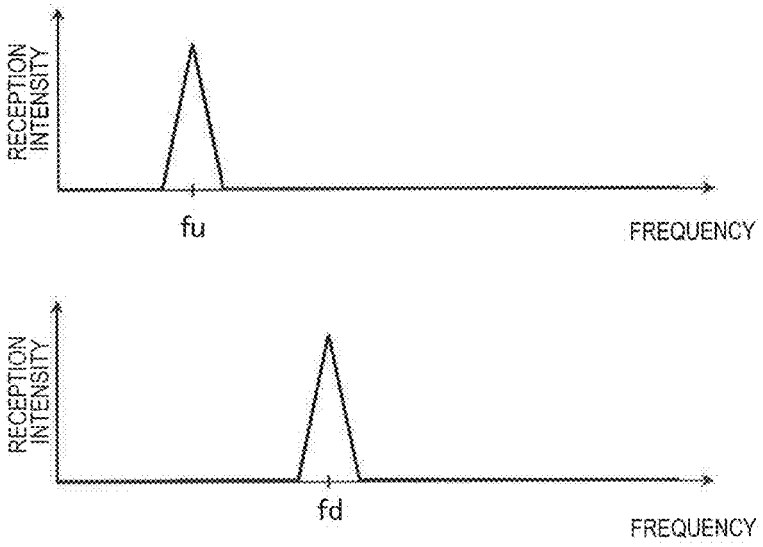
FIG. 33 is a diagram showing a beat frequency fu in an "ascent" period and a beat frequency fd in a "descent" period.

FIG. 33 shows a beat frequency fu in an "ascent" period and a beat frequency fd in a "descent" period. In the graph of FIG. 33, the horizontal axis represents frequency, and the vertical axis represents signal intensity. This graph is obtained by subjecting the beat signal to time-frequency conversion. Once the beat frequencies fu and fd are obtained, based on a known equation, the distance to the target and the relative velocity of the target are calculated. In this Application Example, with the construction and operation described below, beat frequencies corresponding to each antenna element of the array antenna AA are obtained, thus enabling estimation of the position information of a target.

In the example shown in FIG. 31, reception signals from channels $Ch_1$ to $Ch_M$ corresponding to the respective antenna elements $\mathbf{11}_1$ to $\mathbf{11}_M$ are each amplified by an amplifier, and input to the corresponding mixers 584. Each mixer 584 mixes the transmission signal into the amplified reception signal. Through this mixing, a beat signal is generated corresponding to the frequency difference between the reception signal and the transmission signal. The generated beat signal is fed to the corresponding filter 585. The filters 585 apply bandwidth control to the beat signals on the channels $Ch_1$ to $Ch_M$, and supply bandwidth-controlled beat signals to the switch 586.

The switch 586 performs switching in response to a sampling signal which is input from the controller 588. The controller 588 may be composed of a microcomputer, for example. Based on a computer program which is stored in a memory such as a ROM, the controller 588 controls the entire transmission/reception circuit 580. The controller 588 does not need to be provided inside the transmission/ reception circuit 580, but may be provided inside the signal processing circuit 560. In other words, the transmission/reception circuit 580 may operate in accordance with a control signal from the signal processing circuit 560. Alternatively, some or all of the functions of the controller 588 may be realized by a central processing unit which controls the entire transmission/reception circuit 580 and signal processing circuit 560.

The beat signals on the channels $Ch_1$ to $Ch_M$ having passed through the respective filters 585 are consecutively supplied to the A/D converter 587 via the switch 586. In synchronization with the sampling signal, the A/D converter 587 converts the beat signals on the channels $Ch_1$ to $Ch_M$, which are input from the switch 586, into digital signals.

Hereinafter, the construction and operation of the signal processing circuit 560 will be described in detail. In this Application Example, the distance to the target and the relative velocity of the target are estimated by the FMCW method. Without being limited to the FMCW method as described below, the radar system can also be implemented by using other methods, e.g., 2 frequency CW and spread spectrum methods.

In the example shown in FIG. 31, the signal processing circuit 560 includes a memory 531, a reception intensity calculation section 532, a distance detection section 533, a velocity detection section 534, a DBF (digital beam forming) processing section 535, an azimuth detection section 536, a target link processing section 537, a matrix generation section 538, a target output processing section 539, and an arriving wave estimation unit AU. As mentioned earlier, a part or a whole of the signal processing circuit 560 may be implemented by FPGA, or by a set of a general-purpose processor(s) and a main memory device(s). The memory 531, the reception intensity calculation section 532, the DBF processing section 535, the distance detection section 533, the velocity detection section 534, the azimuth detection section 536, the target link processing section 537, and the arriving wave estimation unit AU may be individual parts that are implemented in distinct pieces of hardware, or functional blocks of a single signal processing circuit.

Figure 34:
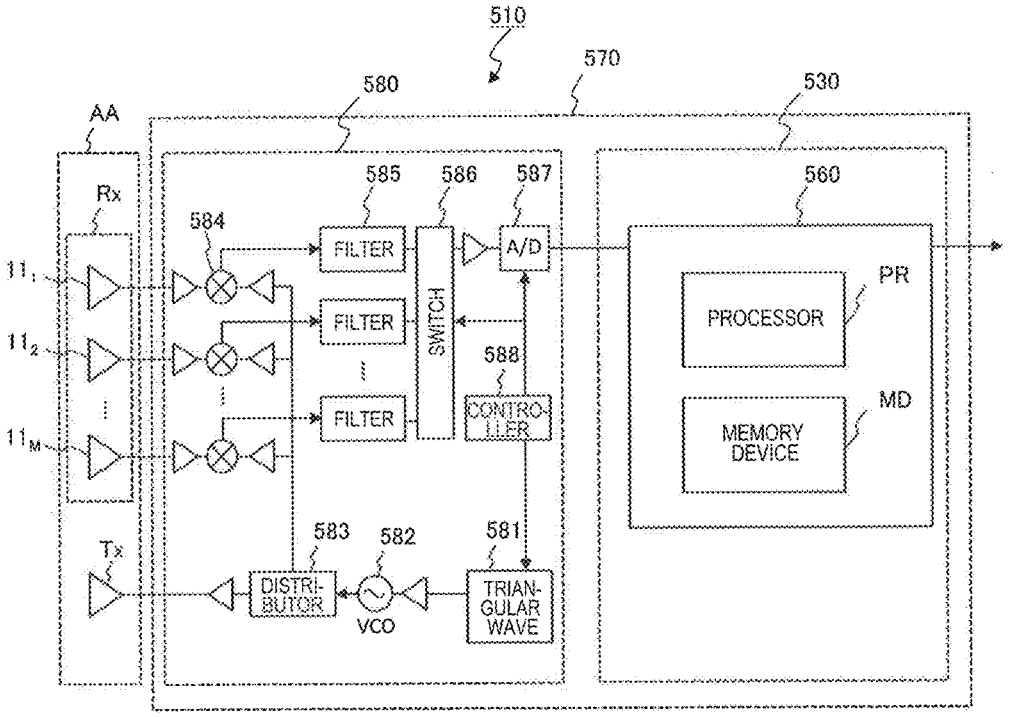
FIG. 34 is a diagram showing an exemplary implementation in which a signal processing circuit 560 is implemented in hardware including a processor PR and a memory device MD.

FIG. 34 shows an exemplary implementation in which the signal processing circuit 560 is implemented in hardware including a processor PR and a memory device MD. In the signal processing circuit 560 with this construction, too, a computer program that is stored in the memory device MD may fulfill the functions of the reception intensity calculation section 532, the DBF processing section 535, the distance detection section 533, the velocity detection section 534, the azimuth detection section 536, the target link processing section 537, the matrix generation section 538, and the arriving wave estimation unit AU shown in FIG. 31.

The signal processing circuit 560 in this Application Example is configured to estimate the position information of a preceding vehicle by using each beat signal converted into a digital signal as a secondary signal of the reception signal, and output a signal indicating the estimation result. Hereinafter, the construction and operation of the signal processing circuit 560 in this Application Example will be described in detail.

For each of the channels $Ch_1$ to $Ch_M$, the memory 531 in the signal processing circuit 560 stores a digital signal which is output from the A/D converter 587. The memory 531 may be composed of a generic storage medium such as a semiconductor memory or a hard disk and/or an optical disk.

The reception intensity calculation section 532 applies Fourier transform to the respective beat signals for the channels $Ch_1$ to $Ch_M$ (shown in the lower graph of FIG. 32) that are stored in the memory 531. In the present specification, the amplitude of a piece of complex number data after the Fourier transform is referred to as "signal intensity". The reception intensity calculation section 532 converts the complex number data of a reception signal from one of the plurality of antenna elements, or a sum of the complex number data of all reception signals from the plurality of antenna elements, into a frequency spectrum. In the resultant spectrum, beat frequencies corresponding to respective peak values, which are indicative of presence and distance of targets (preceding vehicles), can be detected. Taking a sum of the complex number data of the reception signals from all antenna elements will allow the noise components to average out, whereby the S/N ratio is improved.

In the case where there is one target, i.e., one preceding vehicle, as shown in FIG. 33, the Fourier transform will produce a spectrum having one peak value in a period of increasing frequency (the "ascent" period) and one peak value in a period of decreasing frequency ("the descent" period). The beat frequency of the peak value in the "ascent" period is denoted by "fu", whereas the beat frequency of the peak value in the "descent" period is denoted by "fd".

From the signal intensities of beat frequencies, the reception intensity calculation section 532 detects any signal intensity that exceeds a predefined value (threshold value), thus determining the presence of a target. Upon detecting a signal intensity peak, the reception intensity calculation section 532 outputs the beat frequencies (fu, fd) of the peak values to the distance detection section 533 and the velocity detection section 534 as the frequencies of the object of interest. The reception intensity calculation section 532 outputs information indicating the frequency modulation width Δf to the distance detection section 533, and outputs information indicating the center frequency f0 to the velocity detection section 534.

In the case where signal intensity peaks corresponding to plural targets are detected, the reception intensity calculation section 532 find associations between the ascents peak values and the descent peak values based on predefined conditions. Peaks which are determined as belonging to signals from the same target are given the same number, and thus are fed to the distance detection section 533 and the velocity detection section 534.

When there are plural targets, after the Fourier transform, as many peaks as there are targets will appear in the ascent portions and the descent portions of the beat signal. In proportion to the distance between the radar and a target, the reception signal will become more delayed and the reception signal in FIG. 32 will shift more toward the right. Therefore, a beat signal will have a greater frequency as the distant between the target and the radar increases.

Based on the beat frequencies fu and fd which are input from the reception intensity calculation section 532, the distance detection section 533 calculates a distance R through the equation below, and supplies it to the target link processing section 537.

$$R=\{C\cdot T/(2\cdot\Delta f)\}\cdot\{(fu+fd)/2\}$$

Moreover, based on the beat frequencies fu and fd being input from the reception intensity calculation section 532, the velocity detection section 534 calculates a relative velocity V through the equation below, and supplies it to the target link processing section 537.

$$V=\{C/(2;f0)\}\cdot\{(fu-fd)/2\}$$

In the equation which calculates the distance R and the relative velocity V, C is velocity of light, and T is the modulation period.

Note that the lower limit resolution of distance R is expressed as C/(2Δf). Therefore, as Δf increases, the resolution of distance R increases. In the case where the frequency f0 is in the 76 GHz band, when Δf is set on the order of 660 megahertz (MHz), the resolution of distance R will be on the order of 0.23 meters (m), for example. Therefore, if two preceding vehicles are traveling abreast of each other, it may be difficult with the FMCW method to identify whether there is one vehicle or two vehicles. In such a case, it might be possible to run an algorithm for direction-of-arrival estimation that has an extremely high angular resolution to separate between the azimuths of the two preceding vehicles and enable detection.

By utilizing phase differences between signals from the antenna elements $\mathbf{11}_1$, $\mathbf{11}_2$, . . . , $\mathbf{11}_M$, the DBF processing section 535 allows the incoming complex data corresponding to the respective antenna elements, which has been Fourier transformed with respect to the time axis, to be Fourier transformed with respect to the direction in which the antenna elements are arrayed. Then, the DBF processing section 535 calculates spatial complex number data indicating the spectrum intensity for each angular channel as determined by the angular resolution, and outputs it to the azimuth detection section 536 for the respective beat frequencies.

The azimuth detection section 536 is provided for the purpose of estimating the azimuth of a preceding vehicle. Among the values of spatial complex number data that has been calculated for the respective beat frequencies, the azimuth detection section 536 chooses an angle θ that takes the largest value, and outputs it to the target link processing section 537 as the azimuth at which an object of interest exists.

Note that the method of estimating the angle θ indicating the direction of arrival of an arriving wave is not limited to this example. Various algorithms for direction-of-arrival estimation that have been mentioned earlier can be employed.

The target link processing section 537 calculates absolute values of the differences between the respective values of distance, relative velocity, and azimuth of the object of interest as calculated in the current cycle and the respective values of distance, relative velocity, and azimuth of the object of interest as calculated 1 cycle before, which are read from the memory 531. Then, if the absolute value of each difference is smaller than a value which is defined for the respective value, the target link processing section 537 determines that the target that was detected 1 cycle before and the target detected in the current cycle are an identical target. In that case, the target link processing section 537 increments the count of target link processes, which is read from the memory 531, by one.

If the absolute value of a difference is greater than predetermined, the target link processing section 537 determines that a new object of interest has been detected. The target link processing section 537 stores the respective values of distance, relative velocity, and azimuth of the object of interest as calculated in the current cycle and also the count of target link processes for that object of interest to the memory 531.

In the signal processing circuit 560, the distance to the object of interest and its relative velocity can be detected by using a spectrum which is obtained through a frequency analysis of beat signals, which are signals generated based on received reflected waves.

The matrix generation section 538 generates a spatial covariance matrix by using the respective beat signals for the channels $Ch_1$ to $Ch_M$ (lower graph in FIG. 32) stored in the memory 531. In the spatial covariance matrix of eq. 4, each component is the value of a beat signal which is expressed in terms of real and imaginary parts. The matrix generation section 538 further determines eigenvalues of the spatial covariance matrix Rxx, and inputs the resultant eigenvalue information to the arriving wave estimation unit AU.

When a plurality of signal intensity peaks corresponding to plural objects of interest have been detected, the reception intensity calculation section 532 numbers the peak values respectively in the ascent portion and in the descent portion, beginning from those with smaller frequencies first, and output them to the target output processing section 539. In the ascent and descent portions, peaks of any identical number correspond to the same object of interest. The identification numbers are to be regarded as the numbers assigned to the objects of interest. For simplicity of illustration, a leader line from the reception intensity calculation section 532 to the target output processing section 539 is conveniently omitted from FIG. 31.

When the object of interest is a structure ahead, the target output processing section 539 outputs the identification number of that object of interest as indicating a target. When receiving results of determination concerning plural objects of interest, such that all of them are structures ahead, the target output processing section 539 outputs the identification number of an object of interest that is in the lane of the driver's vehicle as the object position information indicating where a target is. Moreover, When receiving results of determination concerning plural objects of interest, such that all of them are structures ahead and that two or more objects of interest are in the lane of the driver's vehicle, the target output processing section 539 outputs the identification number of an object of interest that is associated with the largest count of target being read from the link processes memory 531 as the object position information indicating where a target is.

Referring back to FIG. 30, an example where the onboard radar system 510 is incorporated in the exemplary construction shown in FIG. 30 will be described. The image processing circuit 720 (FIG. 30) acquires information of an object from the video, and detects target position information from the object information. For example, the image processing circuit 720 is configured to estimate distance information of an object by detecting the depth value of an object within an acquired video, or detect size information and the like of an object from characteristic amounts in the video, thus detecting position information of the object.

The selection circuit 596 selectively feeds position information which is received from the signal processing circuit 560 or the image processing circuit 720 to the travel assistance electronic control apparatus 520. For example, the selection circuit 596 compares a first distance, i.e., the distance from the driver's vehicle to a detected object as contained in the object position information from the signal processing circuit 560, against a second distance, i.e., the distance from the driver's vehicle to the detected object as contained in the object position information from the image processing circuit 720, and determines which is closer to the driver's vehicle. For example, based on the result of determination, the selection circuit 596 may select the object position information which indicates a closer distance to the driver's vehicle, and output it to the travel assistance electronic control apparatus 520. If the result of determination indicates the first distance and the second distance to be of the same value, the selection circuit 596 may output either one, or both of them, to the travel assistance electronic control apparatus 520.

If information indicating that there is no prospective target is input from the reception intensity calculation section 532, the target output processing section 539 (FIG. 31) outputs zero, indicating that there is no target, as the object position information. Then, on the basis of the object position information from the target output processing section 539, through comparison against a predefined threshold value, the selection circuit 596 chooses either the object position information from the signal processing circuit 560 or the object position information from the image processing circuit 720 to be used.

Based on predefined conditions, the travel assistance electronic control apparatus 520 having received the position information of a preceding object from the object detection apparatus 570 performs control to make the operation safer or easier for the driver who is driving the driver's vehicle, in accordance with the distance and size indicated by the object position information, the velocity of the driver's vehicle, road surface conditions such as rainfall, snowfall or clear weather, or other conditions. For example, if the object position information indicates that no object has been detected, the travel assistance electronic control apparatus 520 may send a control signal to an accelerator control circuit 526 to increase speed up to a predefined velocity, thereby controlling the accelerator control circuit 526 to make an operation that is equivalent to stepping on the accelerator pedal.

In the case where the object position information indicates that an object has been detected, if it is found to be at a predetermined distance from the driver's vehicle, the travel assistance electronic control apparatus 520 controls the brakes via a brake control circuit 524 through a brake-by-wire construction or the like. In other words, it makes an operation of decreasing the velocity to maintain a constant vehicular gap. Upon receiving the object position information, the travel assistance electronic control apparatus 520 sends a control signal to an alarm control circuit 522 so as to control lamp illumination or control audio through a loudspeaker which is provided within the vehicle, so that the driver is informed of the nearing of a preceding object. Upon receiving object position information including a spatial distribution of preceding vehicles, the travel assistance electronic control apparatus 520 may, if the traveling velocity is within a predefined range, automatically make the steering wheel easier to operate to the right or left, or control the hydraulic pressure on the steering wheel side so as to force a change in the direction of the wheels, thereby providing assistance in collision avoidance with respect to the preceding object.

The object detection apparatus 570 may be arranged so that, if a piece of object position information which was being continuously detected by the selection circuit 596 for a while in the previous detection cycle but which is not detected in the current detection cycle becomes associated with a piece of object position information from a camera-detected video indicating a preceding object, then continued tracking is chosen, and object position information from the signal processing circuit 560 is output with priority.

An exemplary specific construction and an exemplary operation for the selection circuit 596 to make a selection between the outputs from the signal processing circuit 560 and the image processing circuit 720 are disclosed in the specification of U.S. Pat. No. 8,446,312, the specification of U.S. Pat. No. 8,730,096, and the specification of U.S. Pat. No. 8,730,099. The entire disclosure thereof is incorporated herein by reference.

<First Variant of Application Example>

In the radar system for onboard use of the above Application Example, the (sweep) condition for a single instance of FMCW (Frequency Modulated Continuous Wave) frequency modulation, i.e., a time span required for such a modulation (sweep time), is e.g. 1 millisecond, although the sweep time could be shortened to about 100 microseconds.

However, in order to realize such a rapid sweep condition, not only the constituent elements involved in the emission of a transmission wave, but also the constituent elements involved in the reception under that sweep condition must also be able to rapidly operate. For example, an A/D converter 587 (FIG. 31) which rapidly operates under that sweep condition will be needed. The sampling frequency of the A/D converter 587 may be 10 MHz, for example. The sampling frequency may be faster than 10 MHz.

In the present variant, a relative velocity with respect to a target is calculated without utilizing any Doppler shift-based frequency component. In the present embodiment, the sweep time is Tm=100 microseconds, which is very short. The lowest frequency of a detectable beat signal, which is 1/Tm, equals 10 kHz in this case. This would correspond to a Doppler shift of a reflected wave from a target which has a relative velocity of approximately 20 m/second. In other words, so long as one relies on a Doppler shift, it would be impossible to detect relative velocities that are equal to or smaller than this. Thus, the inventors have found that a method of calculation which is different from a Doppler shift-based method of calculation is preferably adopted.

As an example, this variant illustrates a process that utilizes a signal (upbeat signal) representing a difference between a transmission wave and a reception wave which is obtained in an upbeat (ascent) portion where the transmission wave increases in frequency. A single sweep time of FMCW is 100 microseconds, and its waveform is a sawtooth shape which is composed only of an upbeat portion. In other words, in the present embodiment, the signal wave which is generated by the triangular wave/CW wave generation circuit 581 has a sawtooth shape. The sweep width in frequency is 500 MHz. Since no peaks are to be utilized that are associated with Doppler shifts, the process is not one that generates an upbeat signal and a downbeat signal to utilize the peaks of both, but will rely on only one of such signals. Although a case of utilizing an upbeat signal will be illustrated herein, a similar process can also be performed by using a downbeat signal.

The A/D converter 587 (FIG. 31) samples each upbeat signal at a sampling frequency of 10 MHz, and outputs several hundred pieces of digital data (hereinafter referred to as "sampling data"). The sampling data is generated based on upbeat signals after a point in time where a reception wave is obtained and until a point in time at which a transmission wave completes transmission, for example. Note that the process may be ended as soon as a certain number of pieces of sampling data are obtained.

In this variant, 128 upbeat signals are transmitted/received in series, for each of which some several hundred pieces of sampling data are obtained. The number of upbeat signals is not limited to 128. It may be 256, or 8. An arbitrary number may be selected depending on the purpose.

The resultant sampling data is stored to the memory 531. The reception intensity calculation section 532 applies a two-dimensional fast Fourier transform (FFT) to the sampling data. Specifically, first, for each of the sampling data pieces that have been obtained through a single sweep, a first FFT process (frequency analysis process) is performed to generate a power spectrum. Next, the velocity detection section 534 performs a second FFT process for the processing results that have been collected from all sweeps.

When the reflected waves are from the same target, peak components in the power spectrum to be detected in each sweep period will be of the same frequency. On the other hand, for different targets, the peak components will differ in frequency. Through the first FFT process, plural targets that are located at different distances can be separated.

In the case where a relative velocity with respect to a target is non-zero, the phase of the upbeat signal changes slightly from sweep to sweep. In other words, through the second FFT process, a power spectrum whose elements are the data of frequency components that are associated with such phase changes will be obtained for the respective results of the first FFT process.

The reception intensity calculation section 532 extracts peak values in the second power spectrum above, and sends them to the velocity detection section 534.

The velocity detection section 534 determines a relative velocity from the phase changes. For example, suppose that a series of obtained upbeat signals undergo phase changes by every phase $\theta$ [RXd]. Assuming that the transmission wave has an average wavelength $\lambda$, this means there is a $\lambda/(4\pi/\theta)$ change in distance every time an upbeat signal is obtained. Since this change has occurred over an interval of upbeat signal transmission Tm (=100 microseconds), the relative velocity is determined to be $\{\lambda/(4\pi/\theta)\}/Tm$.

Through the above processes, a relative velocity with respect to a target as well as a distance from the target can be obtained.

<Second Variant of Application Example>

The radar system 510 is able to detect a target by using a continuous wave(s) CW of one or plural frequencies. This method is especially useful in an environment where a multitude of reflected waves impinge on the radar system 510 from still objects in the surroundings, e.g., when the vehicle is in a tunnel.

The radar system 510 has an antenna array for reception purposes, including five channels of independent reception elements. In such a radar system, the azimuth-of-arrival estimation for incident reflected waves is only possible if there are four or fewer reflected waves that are simultaneously incident. In an FMCW-type radar, the number of reflected waves to be simultaneously subjected to an azimuth-of-arrival estimation can be reduced by exclusively selecting reflected waves from a specific distance. However, in an environment where a large number of still objects exist in the surroundings, e.g., in a tunnel, it is as if there were a continuum of objects to reflect radio waves; therefore, even if one narrows down on the reflected waves based on distance, the number of reflected waves may still not be equal to or smaller than four. However, any such still object in the surroundings will have an identical relative velocity with respect to the driver's vehicle, and the relative velocity will be greater than that associated with any other vehicle that is traveling ahead. On this basis, such still objects can be distinguished from any other vehicle based on the magnitudes of Doppler shifts.

Therefore, the radar system 510 performs a process of: emitting continuous waves CW of plural frequencies; and, while ignoring Doppler shift peaks that correspond to still objects in the reception signals, detecting a distance by using a Doppler shift peak(s) of any smaller shift amount(s). Unlike in the FMCW method, in the CW method, a frequency difference between a transmission wave and a reception wave is ascribable only to a Doppler shift. In other words, any peak frequency that appears in a beat signal is ascribable only to a Doppler shift.

In the description of this variant, too, a continuous wave to be used in the CW method will be referred to as a "continuous wave CW". As described above, a continuous wave CW has a constant frequency; that is, it is unmodulated.

Suppose that the radar system 510 has emitted a continuous wave CW of a frequency fp, and detected a reflected wave of a frequency fq that has been reflected off a target. The difference between the transmission frequency fp and the reception frequency fq is called a Doppler frequency, which approximates to $fp-fq=2\cdot Vr\cdot fp/c$. Herein, Vr is a relative velocity between the radar system and the target, and c is the velocity of light. The transmission frequency fp, the Doppler frequency (fp−fq), and the velocity of light c are known. Therefore, from this equation, the relative velocity $Vr=(fp-fq)\cdot c/2fp$ can be determined. The distance to the target is calculated by utilizing phase information as will be described later.

In order to detect a distance to a target by using continuous waves CW, a 2 frequency CW method is adopted. In the 2 frequency CW method, continuous waves CW of two frequencies which are slightly apart are emitted each for a certain period, and their respective reflected waves are acquired. For example, in the case of using frequencies in the 76 GHz band, the difference between the two frequencies would be several hundred kHz. As will be described later, it is more preferable to determine the difference between the two frequencies while taking into account the minimum distance at which the radar used is able to detect a target.

Suppose that the radar system 510 has sequentially emitted continuous waves CW of frequencies fp1 and fp2 ($fp1<fp2$), and that the two continuous waves CW have been reflected off a single target, resulting in reflected waves of frequencies fq1 and fq2 being received by the radar system 510.

Based on the continuous wave CW of the frequency fp1 and the reflected wave (frequency fq1) thereof, a first Doppler frequency is obtained. Based on the continuous wave CW of the frequency fp2 and the reflected wave (frequency fq2) thereof, a second Doppler frequency is obtained. The two Doppler frequencies have substantially the same value. However, due to the difference between the frequencies fp1 and fp2, the complex signals of the respective reception waves differ in phase. By utilizing this phase information, a distance (range) to the target can be calculated.

Specifically, the radar system 10 is able to determine the distance R as $R=c\cdot\Delta\varphi/4\pi(fp2-fp1)$. Herein, $\Delta\varphi$ denotes the phase difference between two beat signals, i.e., a beat signal fb1 which is obtained as a difference between the continuous wave CW of the frequency fp1 and the reflected wave (frequency fq1) thereof and a beat signal fb2 which is obtained as a difference between the continuous wave CW of the frequency fp2 and the reflected wave (frequency fq2) thereof. The method of identifying the frequencies fb1 and fb2 of the respective beat signals is identical to that in the aforementioned instance of a beat signal from a continuous wave CW of a single frequency.

Note that a relative velocity Vr under the 2 frequency CW method is determined as follows.

$Vr=fb1\cdot c/2\cdot fp1$ or $Vr=fb2\cdot c/2\cdot fp2$

Moreover, the range in which a distance to a target can be uniquely identified is limited to the range defined by Rmax<c/2(fp2−fp1). The reason is that beat signals resulting from a reflected wave from any farther target would produce a Δφ which is greater than 2π, such that they are indistinguishable from beat signals associated with targets at closer positions. Therefore, it is more preferable to adjust the difference between the frequencies of the two continuous waves CW so that Rmax becomes greater than the minimum detectable distance of the radar. In the case of a radar whose minimum detectable distance is 100 m, fp2−fp1 may be made e.g. 1.0 MHz. In this case, Rmax=150 m, so that a signal from any target from a position beyond Rmax is not detected. In the case of mounting a radar which is capable of detection up to 250 m, fp2−fp1 may be made e.g. 500 kHz. In this case, Rmax=300 m, so that a signal from any target from a position beyond Rmax is not detected, either. In the case where the radar has both of an operation mode in which the minimum detectable distance is 100 m and the horizontal viewing angle is 120 degrees and an operation mode in which the minimum detectable distance is 250 m and the horizontal viewing angle is 5 degrees, it is preferable to switch the fp2−fp1 value be 1.0 MHz and 500 kHz for operation in the respective operation modes.

A detection approach is known which, by transmitting continuous waves CW at N different frequencies (where N is an integer of 3 or more), and utilizing phase information of the respective reflected waves, detects a distance to each target. Under this detection approach, distance can be properly recognized up to N−1 targets. As the processing to enable this, a fast Fourier transform (FFT) is used, for example. Given N=64 or 128, an FFT is performed for sampling data of a beat signal as a difference between a transmission signal and a reception signal for each frequency, thus obtaining a frequency spectrum (relative velocity). Thereafter, at the frequency of the CW wave, a further FFT is performed for peaks of the same frequency, thus to derive distance information.

Hereinafter, this will be described more specifically.

Figure 35:
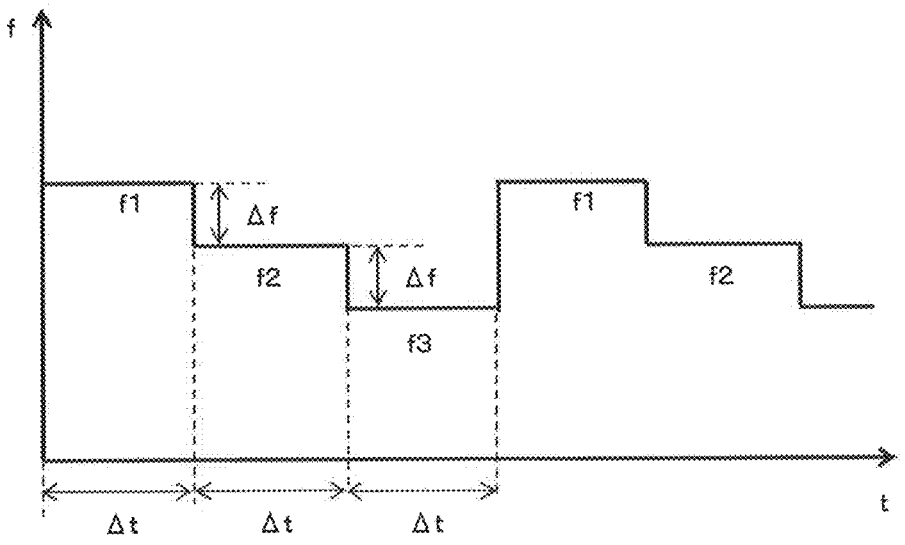
FIG. 35 is a diagram showing a relationship between three frequencies f1, f2 and f3.

For ease of explanation, first, an instance will be described where signals of three frequencies f1, f2 and f3 are transmitted while being switched over time. It is assumed that f1>f2>f3, and f1−f2=f2−f3=Δf. A transmission time Δt is assumed for the signal wave for each frequency. FIG. 35 shows a relationship between three frequencies f1, f2 and f3.

Via the transmission antenna Tx, the triangular wave/CW wave generation circuit 581 (FIG. 31) transmits continuous waves CW of frequencies f1, f2 and f3, each lasting for the time Δt. The reception antennas Rx receive reflected waves resulting by the respective continuous waves CW being reflected off one or plural targets.

Each mixer 584 mixes a transmission wave and a reception wave to generate a beat signal. The A/D converter 587 converts the beat signal, which is an analog signal, into several hundred pieces of digital data (sampling data), for example.

Using the sampling data, the reception intensity calculation section 532 performs FFT computation. Through the FFT computation, frequency spectrum information of reception signals is obtained for the respective transmission frequencies f1, f2 and f3.

Thereafter, the reception intensity calculation section 532 separates peak values from the frequency spectrum information of the reception signals. The frequency of any peak value which is predetermined or greater is in proportion to a relative velocity with respect to a target. Separating a peak value(s) from the frequency spectrum information of reception signals is synonymous with separating one or plural targets with different relative velocities.

Next, with respect to each of the transmission frequencies f1 to f3, the reception intensity calculation section 532 measures spectrum information of peak values of the same relative velocity or relative velocities within a predefined range.

Now, consider a scenario where two targets A and B exist which have about the same relative velocity but are at respectively different distances. A transmission signal of the frequency f1 will be reflected from both of targets A and B to result in reception signals being obtained. The reflected waves from targets A and B will result in substantially the same beat signal frequency. Therefore, the power spectra at the Doppler frequencies of the reception signals, corresponding to their relative velocities, are obtained as a synthetic spectrum F1 into which the power spectra of two targets A and B have been merged.

Similarly, for each of the frequencies f2 and f3, the power spectra at the Doppler frequencies of the reception signals, corresponding to their relative velocities, are obtained as a synthetic spectrum F1 into which the power spectra of two targets A and B have been merged.

Figure 36:
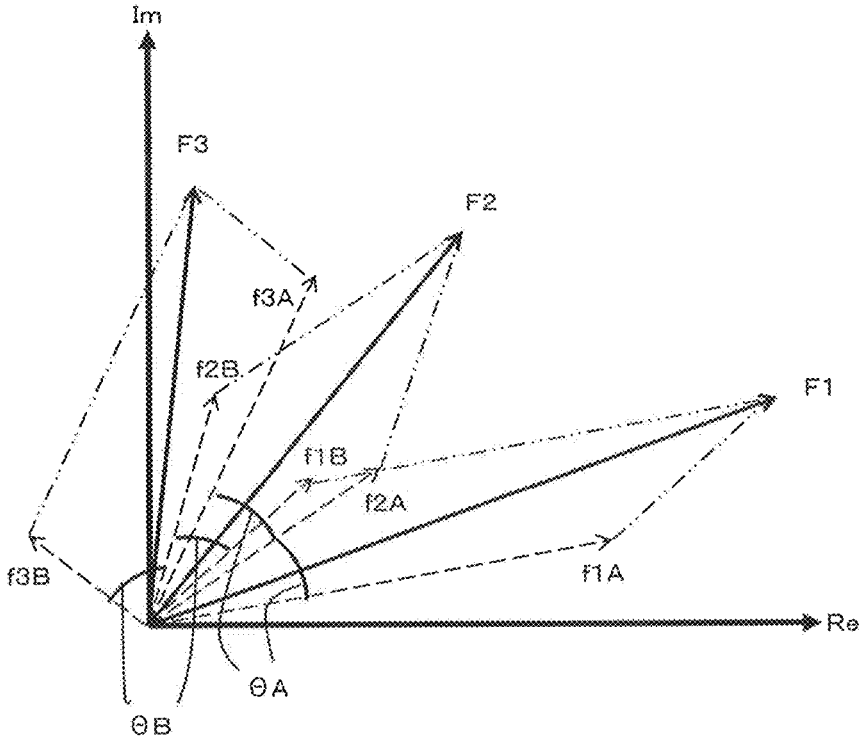
FIG. 36 is a diagram showing a relationship between synthetic spectra F1 to F3 on a complex plane.

FIG. 36 shows a relationship between synthetic spectra F1 to F3 on a complex plane. In the directions of the two vectors composing each of the synthetic spectra F1 to F3, the right vector corresponds to the power spectrum of a reflected wave from target A; i.e., vectors f1A, f2A and f3A, in FIG. 36. On the other hand, in the directions of the two vectors composing each of the synthetic spectra F1 to F3, the left vector corresponds to the power spectrum of a reflected wave from target B; i.e., vectors f1B, f2B and f3B in FIG. 36.

Under a constant difference Δf between the transmission frequencies, the phase difference between the reception signals corresponding to the respective transmission signals of the frequencies f1 and f2 is in proportion to the distance to a target. Therefore, the phase difference between the vectors f1A and f2A and the phase difference between the vectors f2A and f3A are of the same value θA, this phase difference θA being in proportion to the distance to target A. Similarly, the phase difference between the vectors f1B and f2B and the phase difference between the vectors f2B and f3B are of the same value θB, this phase difference GB being in proportion to the distance to target B.

By using a well-known method, the respective distances to targets A and B can be determined from the synthetic spectra F1 to F3 and the difference Δf between the transmission frequencies. This technique is disclosed in U.S. Pat. No. 6,703,967, for example. The entire disclosure of this publication is incorporated herein by reference.

Similar processing is also applicable when the transmitted signals have four or more frequencies.

Note that, before transmitting continuous wave CWs at N different frequencies, a process of determining the distance to and relative velocity of each target may be performed by the 2 frequency CW method. Then, under predetermined conditions, this process may be switched to a process of transmitting continuous waves CW at N different frequencies. For example, FFT computation may be performed by using the respective beat signals at the two frequencies, and if the power spectrum of each transmission frequency undergoes a change over time of 30% or more, the process may be switched. The amplitude of a reflected wave from each target undergoes a large change over time due to multipath influences and the like. When there exists a change of a predetermined magnitude or greater, it may be considered that plural targets may exist.

Moreover, the CW method is known to be unable to detect a target when the relative velocity between the radar system and the target is zero, i.e., when the Doppler frequency is zero. However, when a pseudo Doppler signal is determined by the following methods, for example, it is possible to detect a target by using that frequency.

(Method 1) A mixer that causes a certain frequency shift in the output of a receiving antenna is added. By using a transmission signal and a reception signal with a shifted frequency, a pseudo Doppler signal can be obtained.

(Method 2) A variable phase shifter to introduce phase changes continuously over time is inserted between the output of a receiving antenna and a mixer, thus adding a pseudo phase difference to the reception signal. By using a transmission signal and a reception signal with an added phase difference, a pseudo Doppler signal can be obtained.

An example of specific construction and operation of inserting a variable phase shifter to generate a pseudo Doppler signal under Method 2 is disclosed in Japanese Laid-Open Patent Publication No. 2004-257848. The entire disclosure of this publication is incorporated herein by reference.

When targets with zero or very little relative velocity need to be detected, the aforementioned processes of generating a pseudo Doppler signal may be adopted, or the process may be switched to a target detection process under the FMCW method.

Next, with reference to FIG. 37, a procedure of processing to be performed by the object detection apparatus 570 of the onboard radar system 510 will be described.

The example below will illustrate a case where continuous waves CW are transmitted at two different frequencies fp1 and fp2 (fp1<fp2), and the phase information of each reflected wave is utilized to respectively detect a distance with respect to a target.

Figure 37:
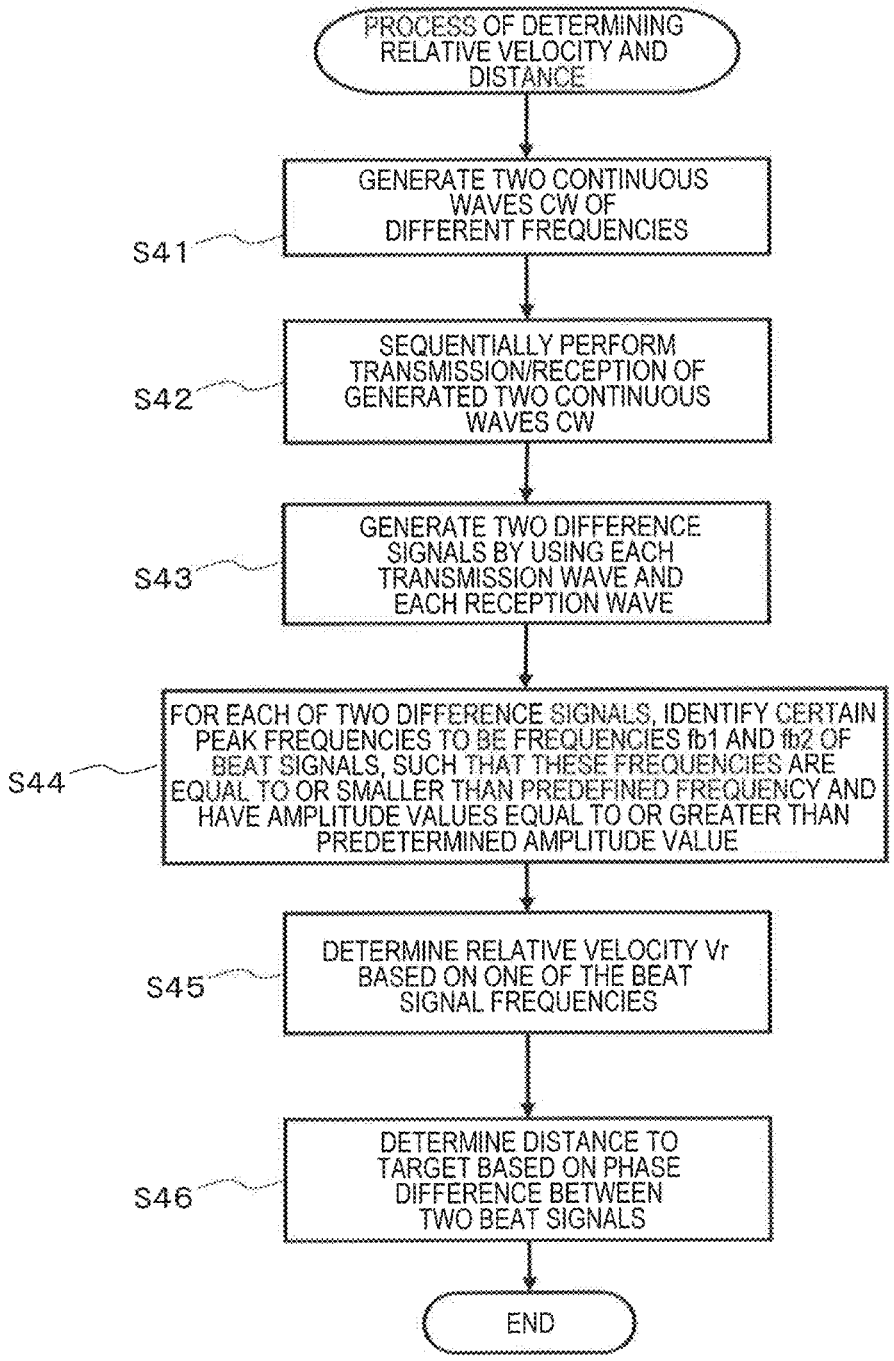
FIG. 37 is a flowchart showing the procedure of a process of determining relative velocity and distance according to a variant.

FIG. 37 is a flowchart showing the procedure of a process of determining relative velocity and distance according to this variant.

At step S41, the triangular wave/CW wave generation circuit 581 generates two continuous waves CW of frequencies which are slightly apart, i.e., frequencies fp1 and fp2.

At step S42, the transmission antenna Tx and the reception antennas Rx perform transmission/reception of the generated series of continuous waves CW. Note that the process of step S41 and the process of step S42 are to be performed in parallel fashion by the triangular wave/CW wave generation circuit 581 and the antenna elements Tx/Rx, rather than step S42 following only after completion of step S41.

At step S43, each mixer 584 generates a difference signal by utilizing each transmission wave and each reception wave, whereby two difference signals are obtained. Each reception wave is inclusive of a reception wave emanating from a still object and a reception wave emanating from a target. Therefore, next, a process of identifying frequencies to be utilized as the beat signals is performed. Note that the process of step S41, the process of step S42, and the process of step 43 are to be performed in parallel fashion by the triangular wave/CW wave generation circuit 581, the antenna elements Tx/Rx, and the mixers 584, rather than step S42 following only after completion of step S41, or step 43 following only after completion of step 42.

At step S44, for each of the two difference signals, the object detection apparatus 570 identifies certain peak frequencies to be frequencies fb1 and fb2 of beat signals, such that these frequencies are equal to or smaller than a frequency which is predefined as a threshold value and yet they have amplitude values which are equal to or greater than a predetermined amplitude value, and that the difference between the two frequencies is equal to or smaller than a predetermined value.

At step S45, based on one of the two beat signal frequencies identified, the reception intensity calculation section 532 detects a relative velocity. The reception intensity calculation section 532 calculates the relative velocity according to $Vr=fb1\cdot c/2\cdot fp1$, for example. Note that a relative velocity may be calculated by utilizing each of the two beat signal frequencies, which will allow the reception intensity calculation section 532 to verify whether they match or not, thus enhancing the precision of relative velocity calculation.

At step S46, the reception intensity calculation section 532 determines a phase difference $\Delta\varphi$ between the two beat signals fb1 and fb2, and determines a distance $R=c\cdot\Delta\varphi/4\pi(fp2-fp1)$ to the target.

Through the above processes, the relative velocity and distance to a target can be detected.

Note that continuous waves CW may be transmitted at N different frequencies (where N is 3 or more), and phase information of the respective reflected wave, distances to plural targets which are of the same relative velocity but at different positions may be detected.

In addition to the radar system 510, the vehicle 500 described above may further include another radar system. For example, the vehicle 500 may further include a radar system having a detection range toward the rear or the sides of the vehicle body. In the case of incorporating a radar system having a detection range toward the rear of the vehicle body, the radar system may monitor the rear, and if there is any danger of having another vehicle bump into the rear, make a response by issuing an alarm, for example. In the case of incorporating a radar system having a detection range toward the sides of the vehicle body, the radar system may monitor an adjacent lane when the driver's vehicle changes its lane, etc., and make a response by issuing an alarm or the like as necessary.

The applications of the above-described radar system 510 are not limited to onboard use only. Rather, the radar system 510 may be used as sensors for various purposes. For example, it may be used as a radar for monitoring the surroundings of a house or a building. Alternatively, it may be used as a sensor for detecting the presence or absence of a person at a specific indoor place, or whether or not such a person is undergoing any motion, etc., without utilizing any optical images.

The aforementioned onboard radar system is only an example. The aforementioned array antenna is usable in any technological field that makes use of an antenna.

A waveguide device according to the present disclosure can be used for the transmission of a radio frequency signal, in the place of a microstrip line or a hollow waveguide. Moreover, an antenna device according to the present disclosure is available for various applications where transmission/reception of electromagnetic waves in the gigahertz band or the terahertz band is to be made, and especially suitably used in onboard radars and wireless communication systems that need downsizing.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2015-203453 filed Oct. 15, 2015 and No. 2016-142181 filed Jul. 20, 2016, the entire contents of which are hereby incorporated by reference.

What is claimed is:

1. A waveguide device comprising:

a first electrically conductive member having an electrically conductive surface which is shaped as a plane or a curved surface;

a second electrically conductive member having a plurality of electrically conductive rods arrayed thereon, each electrically conductive rod having a leading end opposing the electrically conductive surface of the first electrically conductive member; and a waveguide member having an electrically conductive waveguide face opposing the electrically conductive surface of the first electrically conductive member, the waveguide member being disposed among the plurality of electrically conductive rods and extending along the electrically conductive surface, wherein:

the waveguide member includes at least one of a bend at which the direction that the waveguide member extends changes and a branching portion at which the direction that the waveguide member extends ramifies into two or more directions;

a measure of an outer shape of a cross section of at least one of the plurality of electrically conductive rods that is adjacent to the bend or the branch, taken perpendicular to an axial direction of the at least one electrically conductive rod, monotonically decreases from a root that is in contact with the second electrically conductive member toward the leading end;

the second electrically conductive member and each of the plurality of electrically conductive rods are composed of a dielectric coated with an electrically conductive material; and the second electrically conductive member and the plurality of electrically conductive rods are connected one another via the electrically conductive material.

2. The waveguide device of claim 1, wherein at least one electrically conductive rod has one or more side face which is tilted with respect to the axial direction of the electrically conductive rod.

3. The waveguide device of claim 1, wherein at least one electrically conductive rod has one or more side face which is tilted with respect to the axial direction of the electrically conductive rod; and the at least one electrically conductive rod has another side face which is not tilted with respect to the axial direction of the electrically conductive rod.

4. The waveguide device of claim 1, wherein at least one electrically conductive rod has a side face having different tilting angles with respect to an axial direction of the electrically conductive rod between at a leading end and at a root thereof; and the tilting angle at the leading end is smaller than that at the root on a cross-sectional view of the electrically conductive rod along the axial direction.

5. The waveguide device of claim 2, wherein at least one electrically conductive rod has a side face having different tilting angles with respect to an axial direction of the electrically conductive rod between at a leading end and at a root thereof; and the tilting angle at the leading end is smaller than that at the root on a cross-sectional view of the electrically conductive rod along the axial direction.

6. The waveguide device of claim 3, wherein at least one electrically conductive rod has a side face having different tilting angles with respect to an axial direction of the electrically conductive rod between at a leading end and at a root thereof; and the tilting angle at the leading end is smaller than that at the root on a cross-sectional view of the electrically conductive rod along the axial direction.

7. An antenna device comprising:

the waveguide device of claim 1; and an antenna element being connected to a waveguide extending between the electrically conductive surface and the waveguide face of the waveguide device to allow an electromagnetic wave having propagated through the waveguide to be emitted into space.

8. An antenna device comprising:

the waveguide device of claim 3; and an antenna element being connected to a waveguide extending between the electrically conductive surface and the waveguide face of the waveguide device to allow an electromagnetic wave having propagated through the waveguide to be emitted into space.

9. An antenna device comprising:

the waveguide device of claim 4; and an antenna element being connected to a waveguide extending between the electrically conductive surface and the waveguide face of the waveguide device to allow an electromagnetic wave having propagated through the waveguide to be emitted into space.

10. An antenna device comprising:

the waveguide device of claim 5; and an antenna element being connected to a waveguide extending between the electrically conductive surface and the waveguide face of the waveguide device to allow an electromagnetic wave having propagated through the waveguide to be emitted into space.

11. A waveguide device comprising:

a first electrically conductive member having an electrically conductive surface which is shaped as a plane or a curved surface; and a second electrically conductive member having a plurality of electrically conductive rods arrayed thereon, each electrically conductive rod having a leading end opposing the electrically conductive surface of the first electrically conductive member; and a waveguide member having an electrically conductive waveguide face opposing the electrically conductive surface of the first electrically conductive member, the waveguide member being disposed among the plurality of electrically conductive rods and extending along the electrically conductive surface;

wherein, the waveguide member includes at least one of a bend at which the direction that the waveguide member extends changes and a branching portion at which the direction that the waveguide member extends ramifies into two or more directions;

a measure of an outer shape of a cross section of at least one of the plurality of electrically conductive rods that is adjacent to the bend or the branch, taken perpendicular to an axial direction of the at least one electrically conductive rod, monotonically decreases from a root that is in contact with the second electrically conductive member toward the leading end;

an area of a cross section of the at least one electrically conductive rod taken perpendicular to the axial direction is smaller at the leading end than at the root that is in contact with the second electrically conductive member;

the second electrically conductive member and each of the plurality of electrically conductive rods are composed of a dielectric coated with an electrically conductive material; and the second electrically conductive member and each of the plurality of electrically conductive rods are connected one another via the electrically conductive material.

12. The waveguide device of claim 11, wherein at least one electrically conductive rod has one or more side face which is tilted with respect to the axial direction of the electrically conductive rod.

13. The waveguide device of claim 11, wherein at least one electrically conductive rod has one or more side face which is tilted with respect to the axial direction of the electrically conductive rod; and the at least one electrically conductive rod has another side face which is not tilted with respect to the axial direction of the electrically conductive rod.

14. The waveguide device of claim 11, wherein at least one electrically conductive rod has a side face having different tilting angles with respect to an axial direction of the electrically conductive rod between at a leading end and at a root thereof; and the tilting angle at the leading end is smaller than that at the root on a cross-sectional view of the electrically conductive rod along the axial direction.

15. The waveguide device of claim 12, wherein at least one electrically conductive rod has a side face having different tilting angles with respect to an axial direction of the electrically conductive rod between at a leading end and at a root thereof; and the tilting angle at the leading end is smaller than that at the root on a cross-sectional view of the electrically conductive rod along the axial direction.

16. The waveguide device of claim 13, wherein at least one electrically conductive rod has a side face having different tilting angles with respect to an axial direction of the electrically conductive rod between at a leading end and at a root thereof; and the tilting angle at the leading end is smaller than that at the root on a cross-sectional view of the electrically conductive rod along the axial direction.

17. An antenna device comprising:

the waveguide device of claim 11; and an antenna element being connected to a waveguide extending between the electrically conductive surface and the waveguide face of the waveguide device to allow an electromagnetic wave having propagated through the waveguide to be emitted into space.

18. An antenna device comprising:

the waveguide device of claim 13; and an antenna element being connected to a waveguide extending between the electrically conductive surface and the waveguide face of the waveguide device to allow an electromagnetic wave having propagated through the waveguide to be emitted into space.

19. An antenna device comprising:

the waveguide device of claim 14; and an antenna element being connected to a waveguide extending between the electrically conductive surface and the waveguide face of the waveguide device to allow an electromagnetic wave having propagated through the waveguide to be emitted into space.

20. An antenna device comprising:

the waveguide device of claim 15; and an antenna element being connected to a waveguide extending between the electrically conductive surface and the waveguide face of the waveguide device to allow an electromagnetic wave having propagated through the waveguide to be emitted into space.

* * * * *